US005752133A

United States Patent [19]

Nagase et al.

[11] Patent Number: 5,752,133

[45] Date of Patent: May 12, 1998

[54] ELECTROPHOTOGRAPHIC COLOR IMAGE FORMING APPARATUS WITH IMAGE EXPOSURE MEANS INSIDE OF PHOTORECEPTOR DRUM

[75] Inventors: Hisayoshi Nagase; Satoshi Haneda; Hiroyuki Tokimatsu; Shuta Hamada, all of Hachioji; Toshihide Miura, Koganei; Masakazu Fukuchi; Tadayoshi Ikeda, both of Hachioji, all of Japan

[73] Assignee: Konica Corporation, Tokyo, Japan

[21] Appl. No.: 695,299

[22] Filed: Aug. 9, 1996

Related U.S. Application Data

[63] Continuation-in-part of Ser. No. 662,817, Jun. 12, 1996, Pat. No. 5,663,787, which is a continuation of Ser. No. 397,918, Mar. 3, 1995, abandoned.

[30] Foreign Application Priority Data

| | | | |
|---|---|---|---|
| Jun. 24, 1994 | [JP] | Japan | 6-143360 |
| Sep. 2, 1994 | [JP] | Japan | 6-209743 |
| Aug. 17, 1995 | [JP] | Japan | 7-209650 |
| Sep. 8, 1995 | [JP] | Japan | 7-231438 |
| Sep. 11, 1995 | [JP] | Japan | 7-232655 |
| Sep. 11, 1995 | [JP] | Japan | 7-232656 |

[51] Int. Cl.[6] ..... G03G 15/00; G03G 15/01

[52] U.S. Cl. ..... 399/112; 379/117; 347/138

[58] Field of Search ..... 399/110, 111, 399/112, 113, 114, 117, 118; 347/138, 152, 245

[56] References Cited

U.S. PATENT DOCUMENTS 4,470,689 9/1984 Nomura et al. ..... 399/114

FOREIGN PATENT DOCUMENTS 63-6574 1/1988 Japan .
5-307307 11/1993 Japan .

OTHER PUBLICATIONS

Patent Abstracts of Japan, Publication No. 07–248715 A, Sep. 26, 1995, Japanese Patent Office.
Patent Abstracts of Japan, Publication No. 08–006339 A, Jan. 12, 1996, Japanese Patent Office.
Patent Abstracts of Japan, Publication No. 08–063057 A, Mar. 8, 1996, Japanese Patent Office.
Patent Abstracts of Japan, Publication No. 08–076545 A, Mar. 22, 1996, Japanese Patent Office.
Patent Abstracts of Japan, Publication No. 08–082973 A, Mar. 26, 1996, Japanese Patent Office.

*Primary Examiner*—Joan Pendegrass
*Attorney, Agent, or Firm*—Frishauf, Holtz, Goodman, Langer & Chick

[57] ABSTRACT

An image forming apparatus includes: a photoreceptor drum; a charger for charging an outer surface of the photoreceptor drum; image exposure devices each for exposing the photoreceptor drum to form a latent image thereon, wherein the image exposure devices are provided inside the photoreceptor drum, and are detachably mountable with the photoreceptor drum to the image forming apparatus; a developing device for developing the latent image to form a toner image on the outer surface of the photoreceptor drum; and a supporting member on which the image exposure devices are mounted, wherein the supporting member and the photoreceptor drum are connected through bearing members on both ends of the photoreceptor drum, and the supporting member has an engaging portion for engaging with a part of the image forming apparatus to fix the image exposure devices through the supporting member, while the photoreceptor drum is rotated around the image exposure devices through the bearing members.

41 Claims, 49 Drawing Sheets

FIG. 33 ( a )
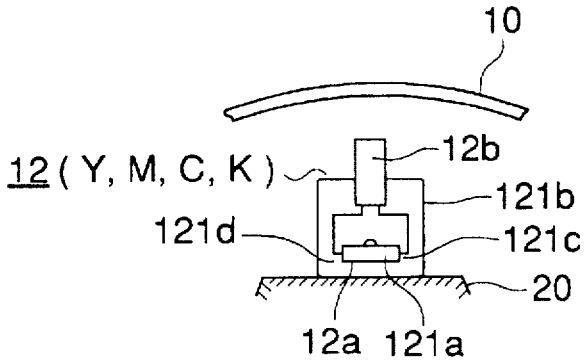
FIG. 33 ( b )
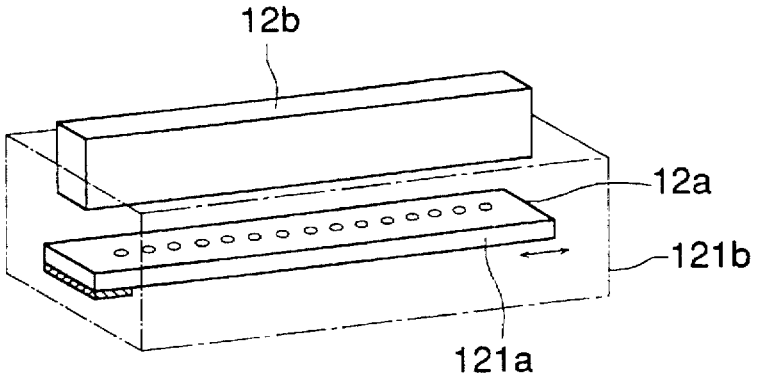

ELECTROPHOTOGRAPHIC COLOR IMAGE FORMING APPARATUS WITH IMAGE EXPOSURE MEANS INSIDE OF PHOTORECEPTOR DRUM

This is a Continuation-In-Part application of Ser. No. 08/662,817 filed Jun. 12, 1996, (now U.S. Pat. No. 5,663,787 issued on Sep. 2, 1997) which is hereby incorporated in its entirety by this reference. Application Ser. No. 08/662,817 filed Jun. 12, 1996 is a Continuation Application of Ser. No. 08/397,918 filed Mar. 3, 1995 which is now abandoned.

BACKGROUND OF THE INVENTION

The present invention relates to an electrophotographic color image forming apparatus in which a plurality of image exposure means and developing means are arranged along the circumferential surface of an image-forming object (a photoreceptor), the configuration of which is mainly formed to be drum-shaped, and toner images are formed and superimposed while the image-forming object is rotated by one revolution.

Concerning the method for forming a multi-color image, there have been known some methods including apparatus (A) in which photoreceptors, charging units and developing units each in number equivalent to the number of colors necessary for the multi-color image are provided, and toner images each being a mono-color formed on each photoreceptor are superimposed on an intermediate transfer object to form a color image, apparatus (B) in which one photoreceptor is rotated plural times so that charging, image exposure and developing for each color are repeated for forming a color image for each rotation, and apparatus (C) in which charging, image exposure and developing for each color are conducted in succession while one photoreceptor makes one turn for forming a color image.

However, the apparatus (A) has a drawback that the dimensions of the apparatus are increased because a plurality of photoreceptors and intermediate transfer objects are required, while the apparatus (B) has a restriction that the size of a formed image is limited to the surface area or less of the photoreceptor although the dimensions of the apparatus can be small because the required number of each of the charging means, image exposure means and photoreceptor is just one.

In the case of the apparatus (C), which makes it possible to form images at high speed, it still has a contradiction that the diameter of a photoreceptor is large and thereby the apparatus is also large due to the following two reasons; one is necessity that a plurality of charging units, image exposure means and developing units need to be arranged within a circumferential surface of the photoreceptor, and the other is necessity that the distance between the image exposure means and the developing unit needs to be long for avoiding a possibility that image quality is deteriorated by toner leaking from the developing unit to which an image exposure optical system is located close.

For the purpose of avoiding the drawback of the aforementioned contradiction in the apparatus (C), there has been suggested an apparatus in which the base of an image-forming object is formed from a transparent material, a plurality of image exposure means are housed in the image-forming object, and a light-sensitive layer formed on the external surface of the base is exposed to light reflected on an image through the base (for example, Japanese Patent Publication Open to Public Inspection No. 307307/1993).

However, the above apparatus has drawbacks including complicated structure due to the arrangement of many image exposure means provided inside the image-forming object and many charging units and developing units provided outside the image-forming object, inefficient handling due to complicated mounting and dismounting of developing units, image-forming objects and image exposure means, and difficulty of keeping positional accuracy between various units. In particular, it requires an advanced technique to provide an optical system fixed inside the image-forming object and to rotate it or to mount and dismount it.

With regard to the exposure optical system, in particular, positional relationship between various parts in the optical system and that between the optical system and the image-forming object are kept to be highly accurate. Therefore, when deformation or displacement is caused by the mounting or dismounting of the image-forming object, registration or an image forming position is changed, resulting in inability to obtain excellent color images.

The above problems are solved by the present invention. The first object of the present invention is to provide a color image forming apparatus characterized in that: it is possible to replace the image-forming body without affecting the image exposure means arranged in high accuracy; the layout of units is rationalized so that the positional accuracy of each unit can be maintained high and further each unit is arranged in a well-balanced condition; and the apparatus is made compact and handy.

A photoreceptor drum, which is an image-forming body, is rotated in the process of image formation and subjected to image exposure. A plurality of images are simultaneously superimposed on the photoreceptor drum by a plurality of optical exposure means. Due to the fluctuation of drive and unevenness of rotation, the accuracy of superimposed dots is deteriorated, so that the dots tend to be shifted. Since the photoreceptor drum is rotated while a plurality of developing units are being pressed against a surface of the photoreceptor drum, the rotation of the photoreceptor drum is fluctuated and image formation is made in an unstable condition. Each time the photoreceptor drum is attached to and detached from the apparatus body, the positional setting of the image exposure means with respect to the optical system must be conducted, and even if the position of each unit is mechanically regulated, an optical fluctuation which can not be neglected is caused and further the optical system is damaged. Therefore, it is impossible to form a clear image.

It is the second object of the present invention to solve the above problems so that the photoreceptor drum and developing units can be stably driven and the fluctuation of the photoreceptor drum is avoided and further the photoreceptor drum is combined with a stable exposure system so as to form an image of high quality.

It is required for an apparatus based on aforesaid proposal that an imagewise exposure means arranged inside an image forming body and the image forming body are positioned accurately to be in parallel with each other and maintained. Further, a plurality of imagewise exposure means are required to be positioned accurately after being registered and maintained.

However, due to temperature change caused by heat generation of an exposure element such as an LED or the like emitting exposure light used as an imagewise exposure means, expansion and contraction caused by difference of thermal expansion between the exposure element and a fixing member that fixes the exposure element creates deformation of the exposure element, expansion and contraction caused by difference of thermal expansion between a fixing member that fixes an imagewise exposure means and a supporting shaft that fixes the fixing member creates deformation of the imagewise exposure means, and expansion and contraction caused by difference of thermal expansion between an image forming body and a supporting shaft that fixes the image forming body creates deformation of the image forming body. Therefore, it is difficult to keep accuracy of relative positions among various members, which is a disadvantage.

After solving the problem mentioned above for improvement, the third object of the invention is to offer an image forming apparatus wherein deformation of an exposure element, an imagewise exposure means and an image forming body created by temperature change that is caused by heat generation of an exposure element or the like used as an imagewise exposure means can be prevented, and accuracy of relative positions among various components can be kept, and thereby excellent images can be obtained.

On the other hand, when an image forming body is represented by a thin-walled photoreceptor drum whose end portion is press-fitted in a flange member, deformation tends to be caused on the occasion of the press-fitting, and the image forming body is constantly pressed by stopper rollers of a sleeve roller. Therefore, an extent of deformation is further enhanced. For preventing the deformation, shapes of a drum-shaped image forming body and a flange member are devised variously, and a means for keeping machining accuracy and assembling accuracy is taken for uniting the image forming body and the flange member concentrically without any deformation. However, these measures require skilled ability and are costly and insufficient in terms of effects.

When imagewise exposure means are arranged inside a drum-shaped image forming body, adjustment of a focusing position and adjustment in the main-scanning direction and sub-scanning direction are considerably difficult.

Since many image forming components and units are arranged densely around a drum-shaped image forming body in an image forming apparatus as explained above, accurate machining and assembling are required so that the drum-shaped image forming body may be a cylindrical body having accurate dimensions, and it is necessary that relative positions among the components and units are always kept constant. Satisfying the conditions mentioned above, however, is costly and requires complicated structure, and it has been difficult to realize.

In addition to the foregoing, when imagewise exposure means are housed in a drum-shaped image forming body, an optical component that is a line-shaped imagewise exposure means needs naturally to be machined and assembled accurately in advance, and an optical component such as an LED or the like needs to be subjected to fine adjustment which is carried out while observing images after assembling. However, the adjustment is extremely difficult under the condition that a plurality of optical systems are stuffed in the drum-shaped image forming body.

The invention has been achieved in view of the circumstances mentioned above, and the fourth object thereof is to develop a means capable of holding stably a drum-shaped image forming body under accurate conditions with a simple structure, and to offer a color image forming apparatus wherein fine adjustment for the image forming body after assembling can be carried out from the outside of the drum-shaped image forming body based on the stable state, and further from the outside of a process cartridge housing therein the image forming body together with a plurality of charging units, developing units and cleaners, and a process cartridge therefor, and further to offer an adjusting method wherein position adjustment for imagewise exposure means, in particular, can be done simply, accurately and stably, and a method for maintaining high image quality.

SUMMARY OF THE INVENTION

An embodiment for attaining the first object mentioned above is as follows.

An image forming apparatus, comprising:

a photoreceptor drum, charger means for charging an outer surface of the photoreceptor drum;

image exposure means for exposing the photoreceptor drum so as to form a latent image thereon, wherein the image exposure means is provided in the photoreceptor drum, and is detachably mountable with the photoreceptor drum on the image forming apparatus;

developing means for developing the latent image so as to form a toner image on an outer surface of the photoreceptor drum;

an image exposure means supporting member on which the image exposure means are mounted;

wherein the image exposure means supporting member and the photoreceptor drum are connected through bearing members on both ends of the photoreceptor drum, and the image exposure means supporting member has an engaging portion for engaging with a part of the image forming apparatus so as to fix the image exposure means through the image exposure means supporting member, while the photoreceptor drum is rotated around the image exposure means through bearing members.

Another embodiment for attaining the first object mentioned above is as follows.

A unit detachably mountable on an image forming apparatus, comprising:

a photoreceptor drum, image exposure means for exposing the photoreceptor drum, wherein the image exposure means is provided in the photoreceptor drum; and an image exposure means supporting member on which the image exposure means are mounted;

wherein the image exposure means supporting member and the photoreceptor drum are connected through bearing members on both ends of the photoreceptor drum, and the image exposure means supporting member has an engaging portion for engaging with a part of the image forming apparatus so as to fix the image exposure means through the image exposure means supporting member, while the photoreceptor drum is rotated around the image exposure means through the bearing members.

Further embodiment for attaining the first object is as follows.

An image forming apparatus in which a charging unit, imagewise exposure means and developing units are arranged for an image forming body and toner images are superposed and formed on the image forming body through repetition of a cycle of charging, imagewise exposure and development for the image forming body, then the toner images are transferred collectively onto a transfer material, is characterized in that the image forming body is a drum-shaped one housing therein aforesaid plural imagewise exposure means fixed to the apparatus main body, and aforesaid developing units are arranged to be in contact with an outer surface of the drum-shaped image forming body, thus, the image forming body and the imagewise exposure means are solidly mountable on or dismountable from the apparatus main body when the developing units which are in contact with the image forming body are retreated. Owing to this, the image forming body and imagewise exposure means which are required to be highly accurate for positioning can easily be mounted or dismounted solidly, which makes maintenance for them to be easy.

Still further embodiment for attaining the first object is as follows.

A color image forming apparatus in which toner images are superposed and formed, through repetition of a cycle of charging, imagewise exposure and development for an image forming body, on aforesaid image forming body, and then, the toner images are transferred collectively onto a transfer material, is characterized in that aforesaid image forming body is a drum-shaped one housed in a process cartridge together with imagewise exposure means contained in the image forming body solidly, and the process cartridge can be mounted on or dismounted from the apparatus main body from the transfer section side when the apparatus main body is opened at the transfer section and developing units are retreated.

The second object of the present invention is accomplished by a color image forming apparatus in which a plurality of chargers, image exposure means and developing units are arranged in the moving direction of an image forming body, and the color image forming apparatus characterized in that: the image exposure means is arranged on a common support; a gear integrated with the image forming body is meshed with a drive gear of a drive source arranged outside the image forming body; and the developing unit is operated being meshed with a drive gear of a drive source arranged at the center of the image forming body. It is preferable that the image exposure means is arranged inside the image forming body. It is also preferable that the image exposure means is arranged outside the image forming body.

An embodiment for attaining the third object mentioned above is as follows.

An image forming apparatus in which a charging unit and developing units are arranged outside a cylindrical image forming body, imagewise exposure means are arranged inside thereof, and the image forming body is charged by the charging unit, then, the image forming body is subjected to imagewise exposure conducted by the imagewise exposure means, and images are formed on the image forming body by forming toner images on the image forming body through development conducted by the developing units, is characterized in that a supporting shaft that passes through the inside of the cylindrical image forming body and imagewise exposure means supporting member and thereby supports the image forming body and the imagewise exposure means is provided, and one end of the supporting member is fixed on the supporting shaft while the other end thereof is a free end.

Another embodiment is represented by an image forming apparatus in which a charging unit and developing units are arranged outside a cylindrical image forming body, imagewise exposure means are arranged inside thereof, and the image forming body is charged by the charging unit, then, the image forming body is subjected to imagewise exposure conducted by the imagewise exposure means, and images are formed on the image forming body by forming toner images on the image forming body through development conducted by the developing units, characterized in that a fixing member that fixes an exposure element of the imagewise exposure means is provided, and one end of the exposure element is fixed on the fixing member while the other end thereof is a free end.

The fourth object mentioned above is attained by any one of the following embodiments (1)–(5).

(1) A color image forming apparatus having a drum-shaped image forming body and a plurality of imagewise exposure means arranged on a supporting member inside the drum-shaped image forming body, wherein flange members through which a supporting shaft of the supporting member passes are infitted concentrically with the image forming body from both ends of the drum-shaped image forming body to be fixed therein, and both ends of the supporting shaft of the supporting member are supported by both side plates of a process cartridge or of the color image forming apparatus and the image forming body is rotated by a driving member provided concentrically and solidly with the flange members.

(2) A unit having an image forming body and a plurality of line-shaped imagewise exposure means which perform imagewise exposure, wherein a moving means that moves positions of the imagewise exposure means from the outside of the image forming body is provided.

(3) In an adjusting method for a unit having an image forming body and a plurality of line-shaped imagewise exposure means which perform imagewise exposure, an adjusting method for a color in the unit characterized in that an image of the exposure means is adjusted by moving a position of each imagewise exposure means with the moving means from the outside of the image forming body.

(4) A color image forming apparatus having a plurality of line-shaped imagewise exposure means which perform imagewise exposure inside an image forming body, wherein there is provided a moving means that moves a position of each imagewise exposure on a common supporting member from the outside of the image forming body under the condition that the imagewise exposure means are housed in the image forming body.

(5) An adjusting method for a color image in a color image forming apparatus having a plurality of line-shaped imagewise exposure means which perform imagewise exposure inside an image forming body, wherein a moving means that moves a position of each imagewise exposure means on a common supporting member is provided, and an image of the imagewise exposure means is adjusted by moving the imagewise exposure means with the moving means by maneuvering it from the outside of the image forming body.

BRIEF DESCRIPTION OF THE DRAWINGS

FIGS. 33(*a*), 33(*b*) are diagrams showing an example of how to fix exposure elements of exposure optical systems to a fixing member for the exposure elements.

Figure 39:
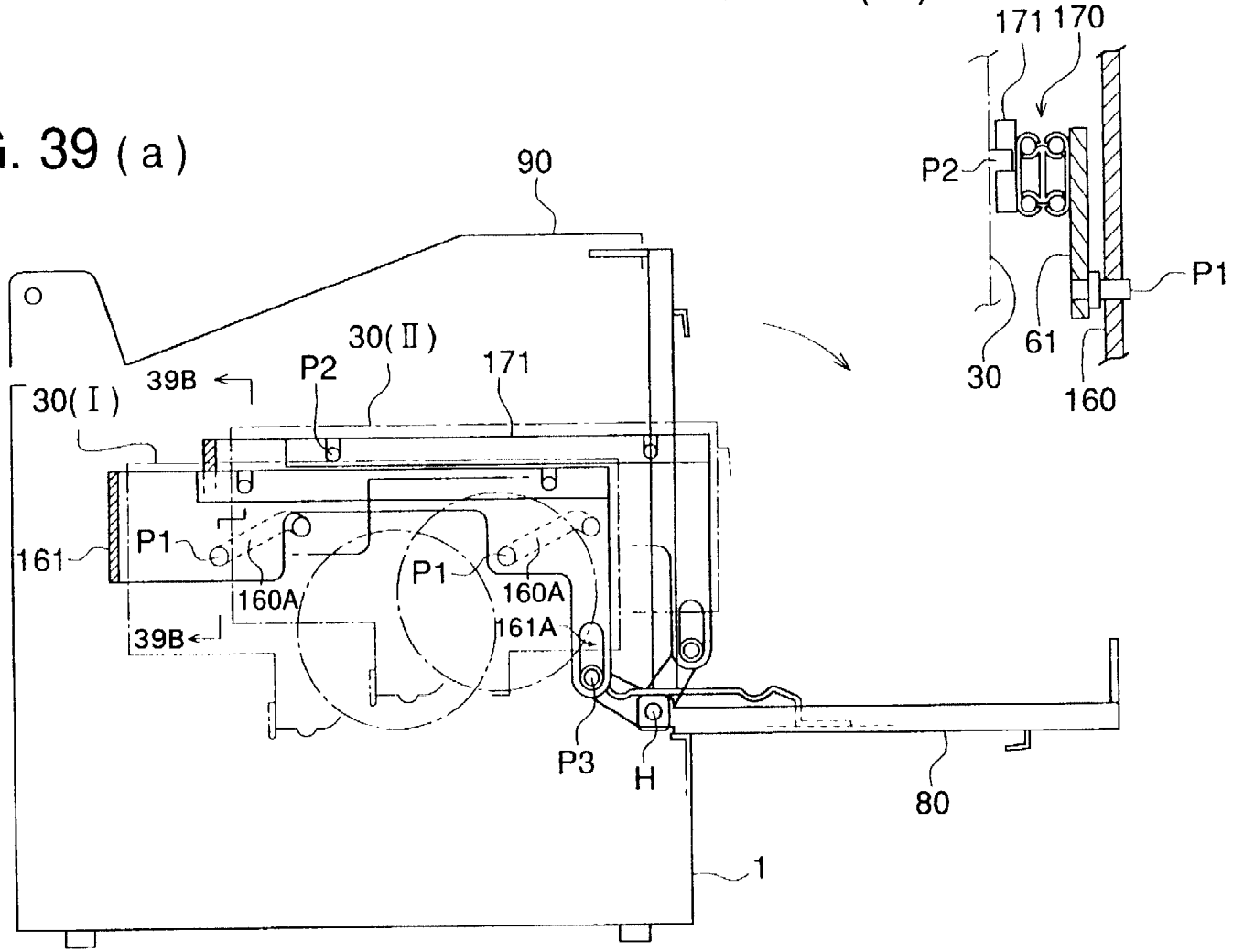

Each of FIGS. 39(*a*) and 39(*b*) represents an illustration showing the relation between an image forming position of a process cartridge and a drawing out position thereof.

Figure 40:
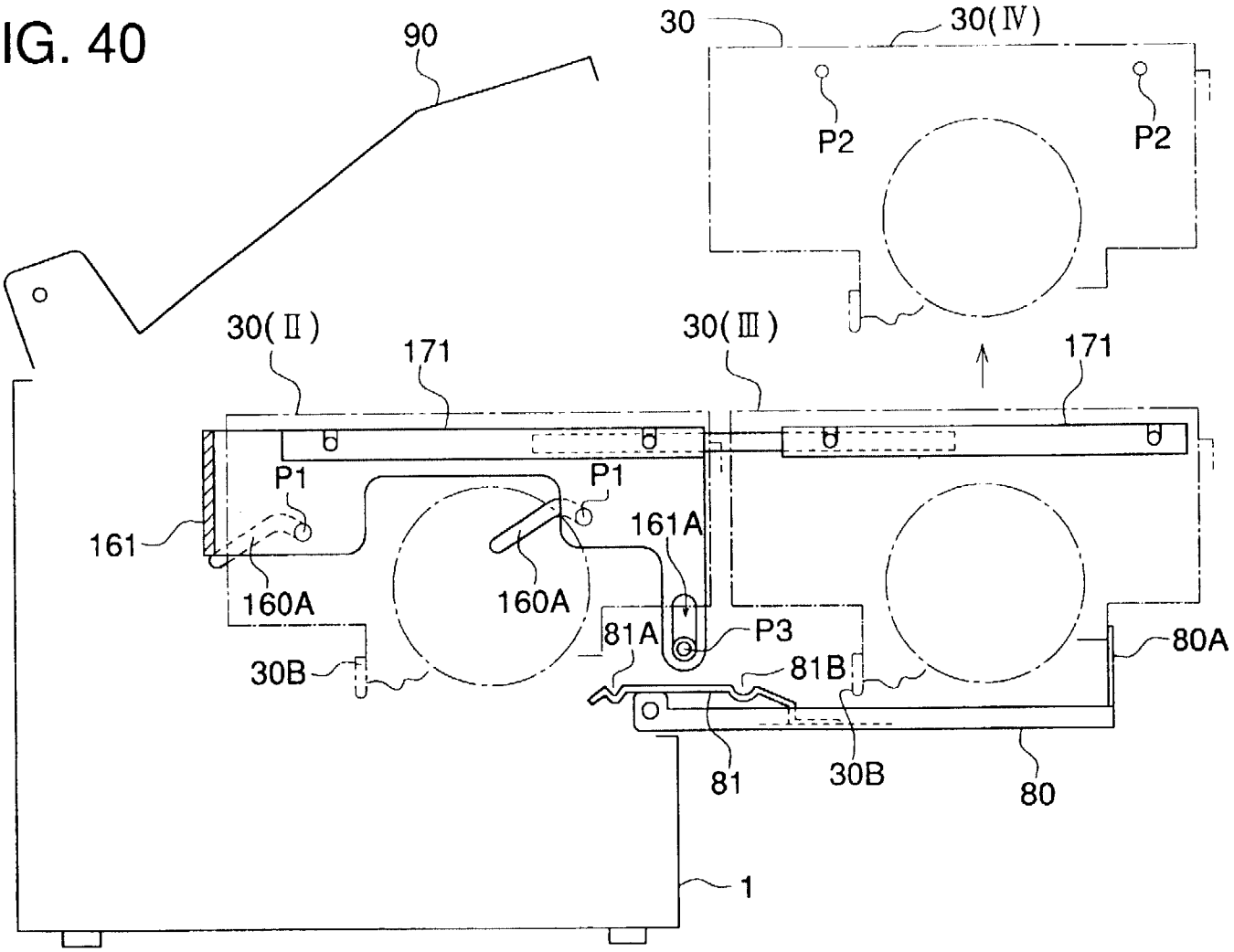

FIG. 40 is an illustration showing the structure for drawing out a process cartridge and restriction to a specific position.

Figure 41:
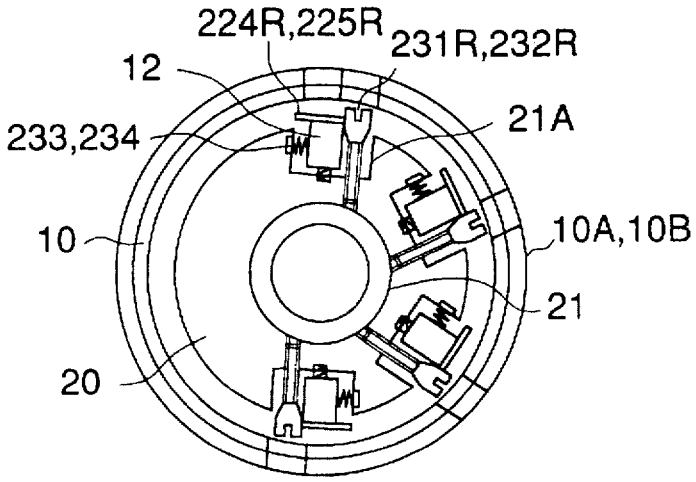

FIG. 41 is a sectional view perpendicular to the axis showing an example of adjustment of a photoreceptor drum and exposure optical systems housed therein.

Figure 42:
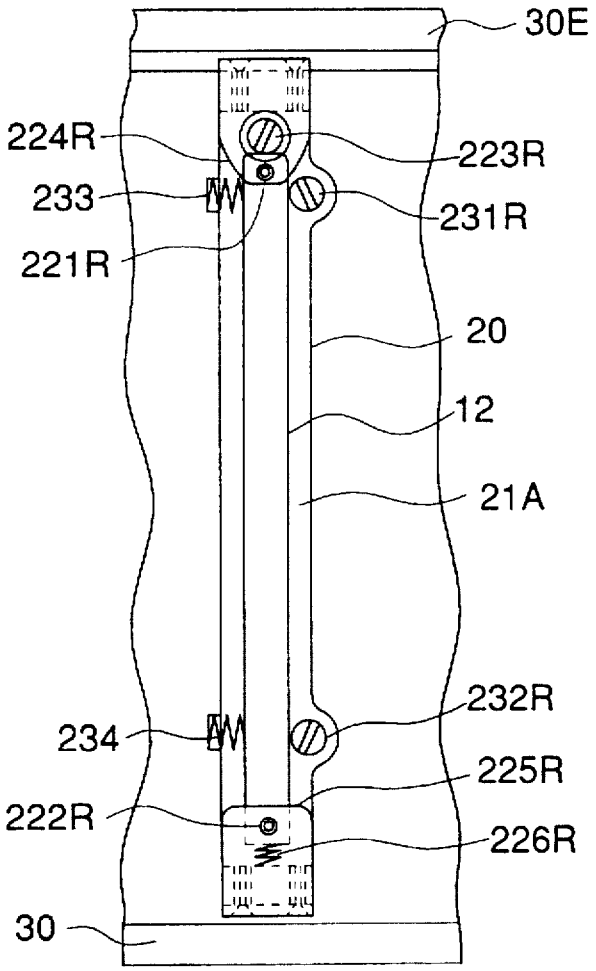

FIG. 42 is a top view showing an example of adjustment of a photoreceptor drum and exposure optical systems housed therein.

Figure 43:
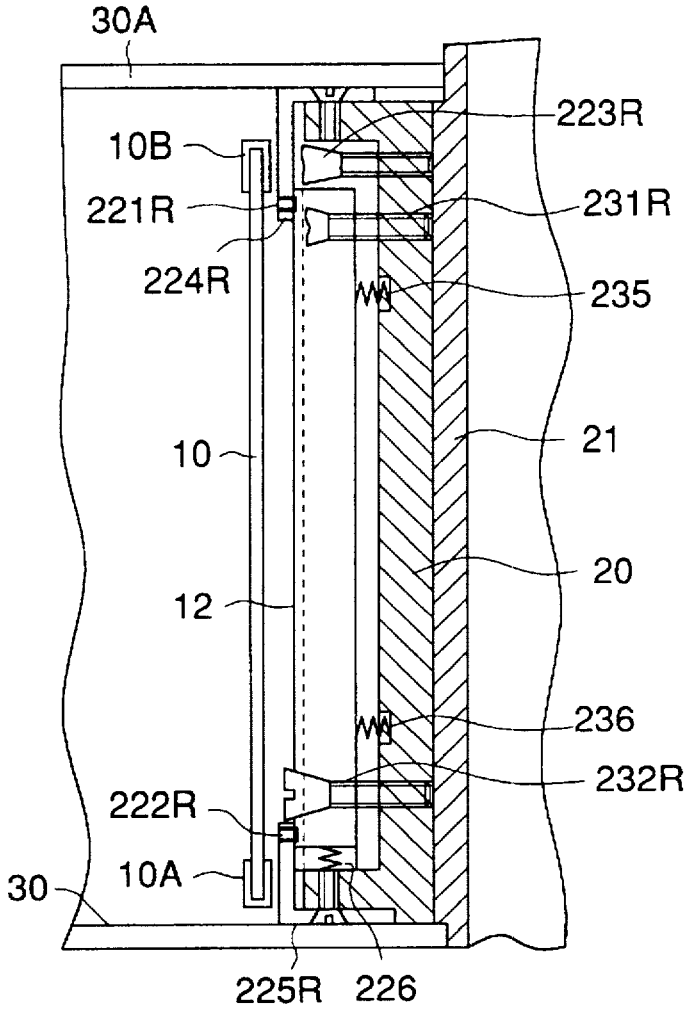

FIG. 43 is a cross-sectional side view showing an example of adjustment of a photoreceptor drum and exposure optical systems housed therein.

Figure 44:
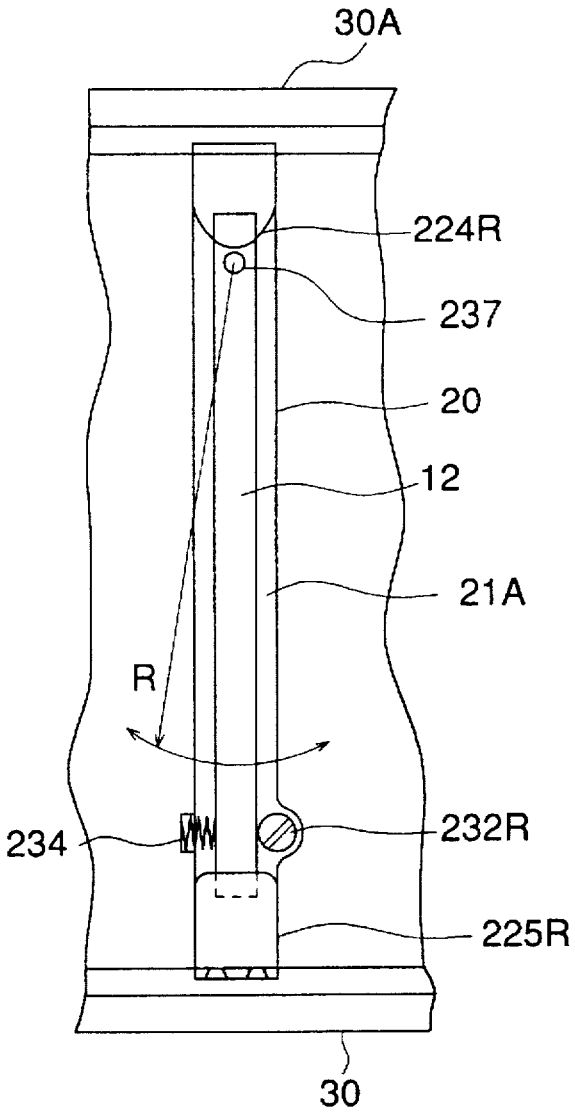

FIG. 44 is a top view showing another example of adjustment of a photoreceptor drum and exposure optical systems housed therein.

Figure 45:
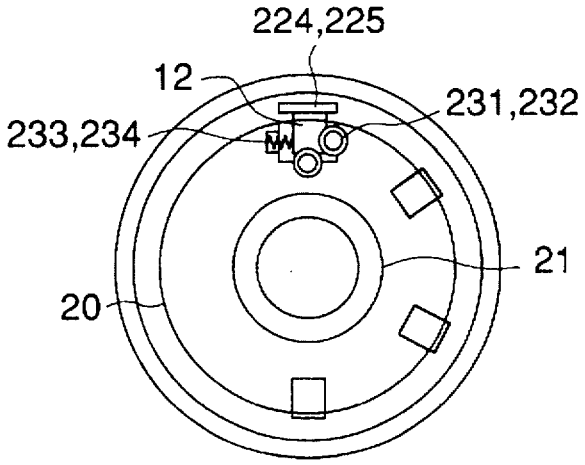

FIG. 45 is a sectional view perpendicular to the axis showing still another example of adjustment of a photoreceptor drum and exposure optical systems housed therein.

Figure 46:
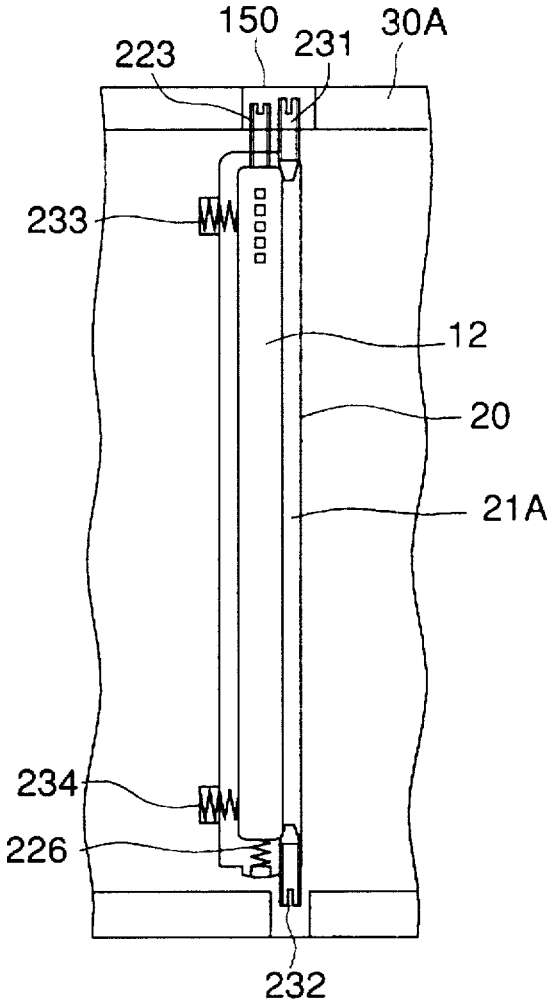

FIG. 46 is a top view showing still another example of adjustment of a photoreceptor drum and exposure optical systems housed therein.

Figure 47:
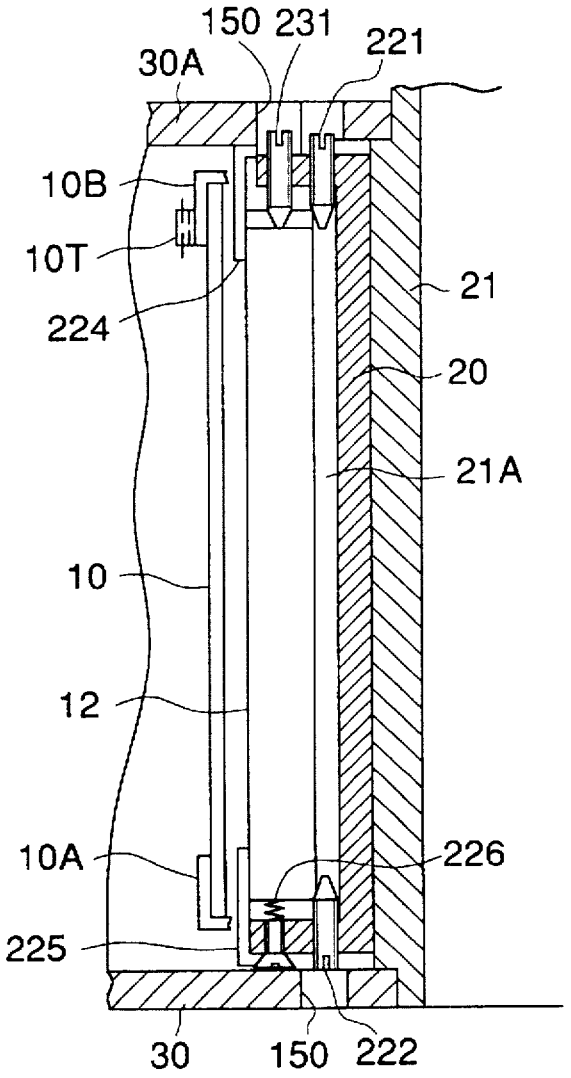

FIG. 47 is a cross-sectional side view showing another example of adjustment of a photoreceptor drum and exposure optical systems housed therein.

Figure 48:
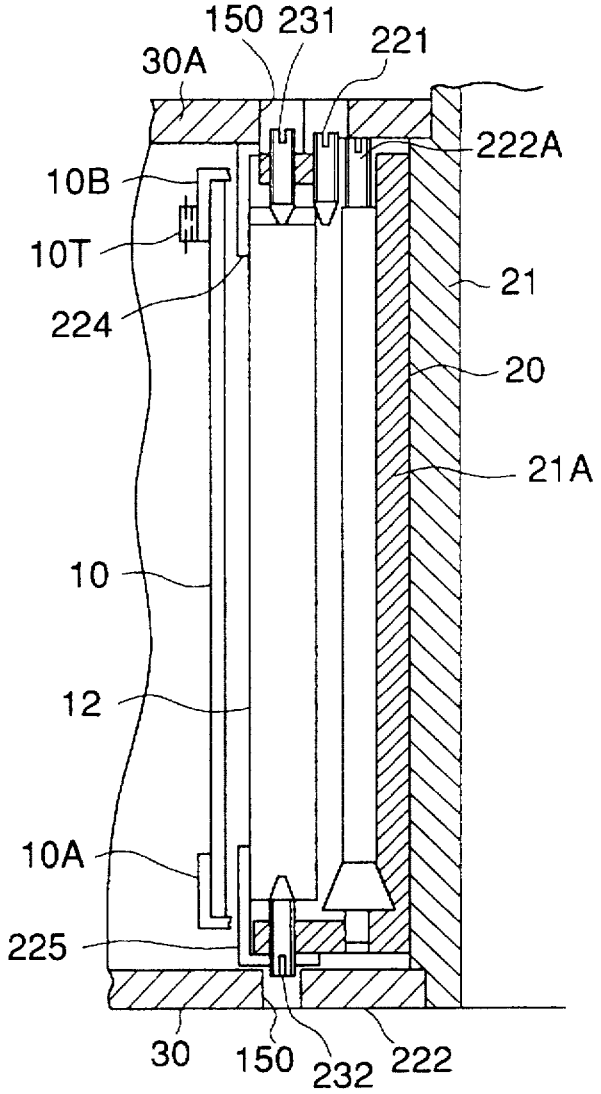

FIG. 48 is a cross-sectional side view showing still another example of adjustment of a photoreceptor drum and exposure optical systems housed therein.

Figure 49:
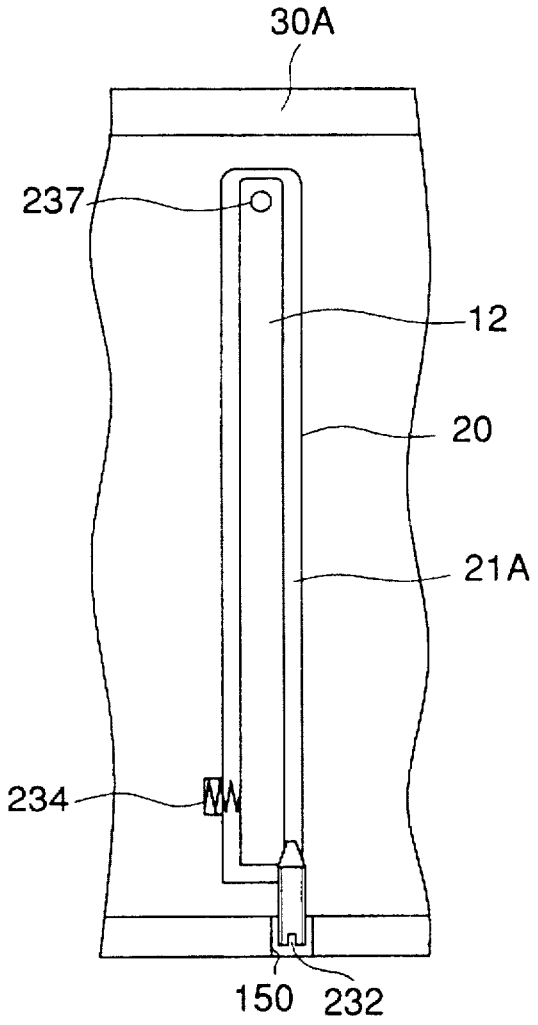

FIG. 49 is a top view showing still further another example of adjustment of a photoreceptor drum and exposure optical systems housed therein.

Figure 50:
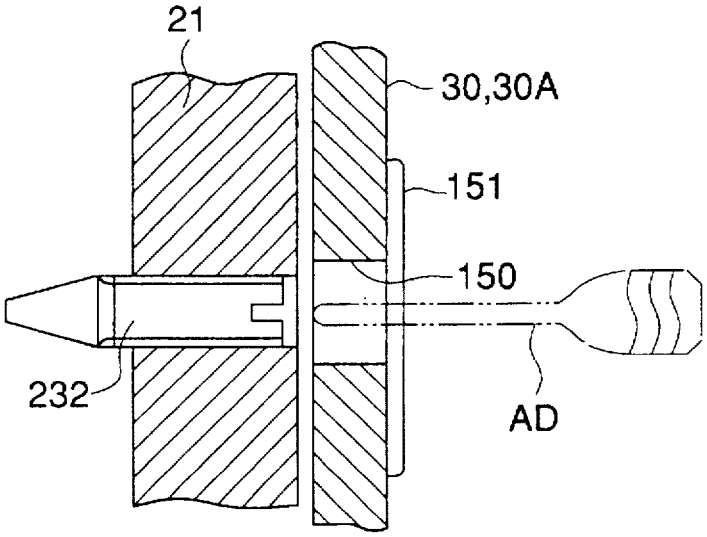

FIG. 50 is a local sectional view showing a dust-proof cover located at the adjustment section.

Figure 51:
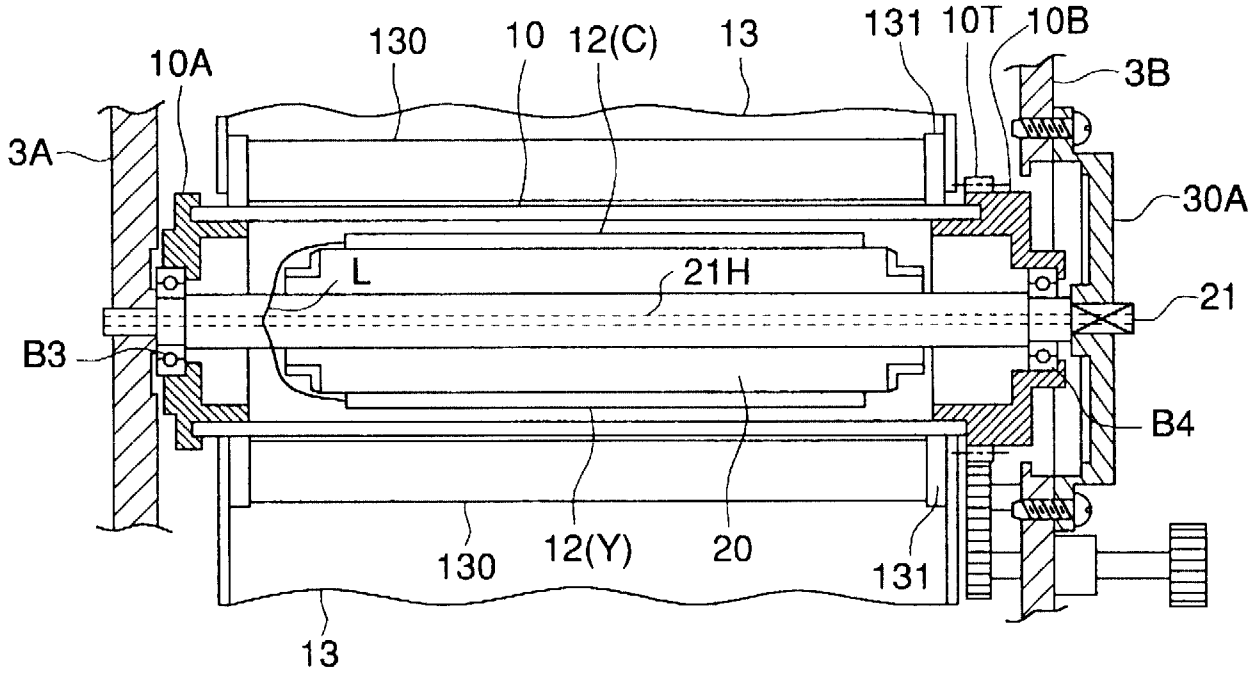

FIG. 51 is a sectional view perpendicular to the axis of an example showing how a photoreceptor drum and exposure optical systems are structured and assembled.

Figure 52:
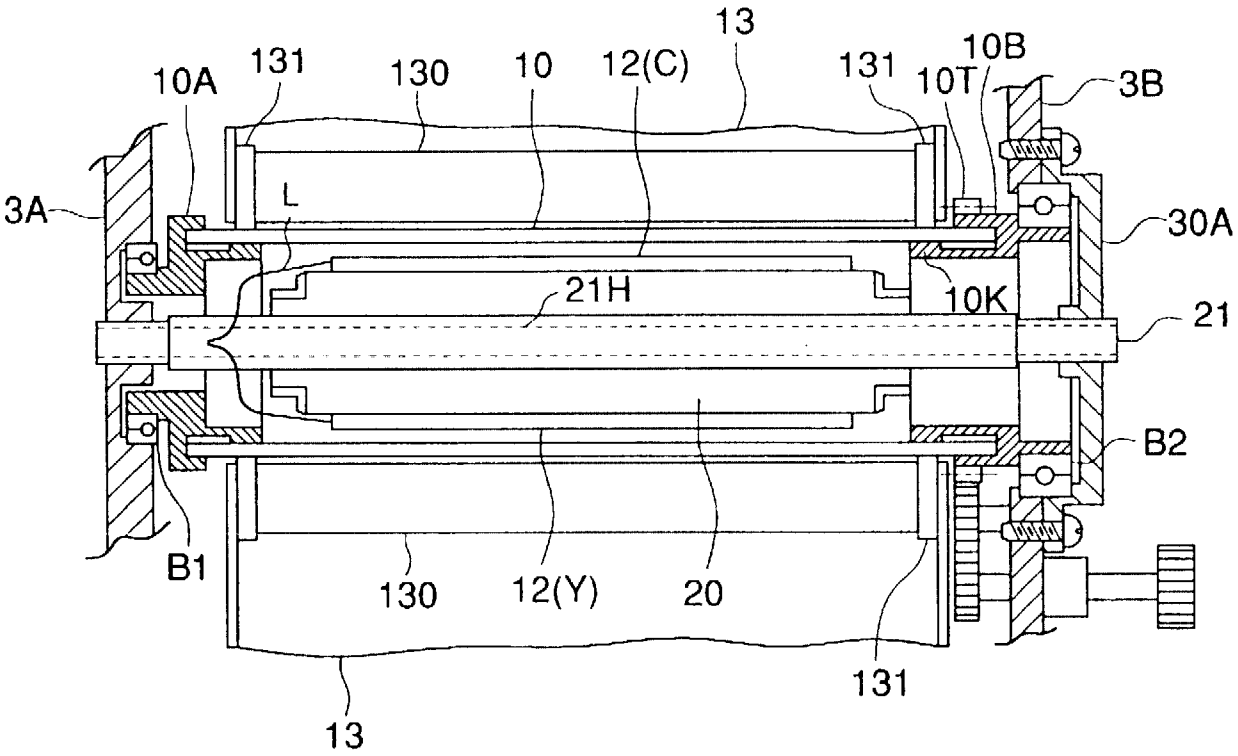

FIG. 52 is a sectional view perpendicular to the axis of an example showing how a photoreceptor drum and exposure optical systems are structured and assembled.

DETAILED DESCRIPTION OF THE PREFERRED EMBODIMENT

Prior to explanation of the examples for attaining the first object of the invention, constitution of a color image forming apparatus which is common to all examples will be explained as follows, referring to FIGS. 1 and 2.

The numeral 10 is a drum-shaped image-forming object, that is, a photoreceptor drum, and it is composed of a cylindrical base object made of optical glass or a transparent member such as transparent acrylic resins whose external circumferential surface is coated with a transparent conductive layer, an a-Si layer or an organic photoconductor layer (OPC).

The numeral 11 represents a scorotron charging unit, and it charges electrically the aforementioned organic photoconductor layer of the photoreceptor drum 10 by means of a grid retained at a predetermined potential level and of corona discharge by a corona wire, and thus the photoreceptor drum 10 is given uniform potential.

Numeral 12 (Y, M, C, K) represents an optical exposure system composed of FL, EL, PL and LED in which light emitting diodes are aligned in the axial direction of the photoreceptor drum 10, and also composed of LISA, PLZT and LCS in which elements having an optical shutter function are aligned, and also composed of Selfoc lenses serving as a life-size image forming element. Image signals for each color read by a separate image reading device are taken out successively from a memory and are inputted as electric signals into each of the aforesaid optical exposure systems 12(Y, M, C, K). Each of the aforesaid optical exposure systems 12(Y, M, C, K) is attached on cylindrical supporting member 20, thus the aforesaid optical exposure systems are housed inside the base of the photoreceptor drum 10.

The numerals 13Y to 13K are developing units containing respectively developing agents of yellow (Y), magenta (M), cyan (C) and K (black), and they are equipped respectively with developing sleeves 130 (Y, M, C, K) which rotate in the same direction keeping a predetermined distance with each other around the circumferential surface of the photoreceptor drum 10, while the predetermined distance is maintained by the action of collision rollers (Y, M, C, K). They are also equipped with supply rollers 131 (Y, M, C, K) for supplying developer to the developing sleeves 130 (Y, M, C, K). Further, they are equipped with stirring rollers 132 (Y, M, C, K) and 133 (Y, M, C, K). The developing sleeves 130 (Y, M, C, K) and the developer in the developing units 13 (Y, M, C, K) are maintained in a non-contact condition with respect to the photoreceptor drum 10. In this case, a distance between the photoreceptor drum 10 and each of the developing sleeves 130 (Y, M, C, K) is maintained by the action of each of the collision rollers 140 (Y, M, C, K) which pushes the photoreceptor drum 10 in the non-image portion at the drum end while idly rotating.

In this way, an electrostatic latent image is formed on the photoreceptor drum 10 by the charging conducted by the scorotron chargers 11 (Y, M, C, K) and the image exposure conducted by the optical exposure systems 12 (Y, M, C, K). The thus formed electrostatic latent image is subjected to reversal development by the developing units 13 (Y, M, C, K).

With regard to an image on a document, the image read by an image sensor in an image reading device which is separate from the present apparatus, or the image compiled by a computer is stored in a memory momentarily as image signals of each color of Y, M, C and K.

At the start of image recording, the photoreceptor driving motor starts rotating, and photoreceptor drum 10 is thereby rotated clockwise and the scorotron charging unit 11 (Y) starts giving potential to the photoreceptor drum 10 through its charging action simultaneously.

After the photoreceptor drum 10 is given potential, exposure by means of electric signals corresponding to the first color signals, namely yellow (Y) image signals is started in the exposure optics system 12 (Y), and an electrostatic latent image corresponding to yellow (Y) image of the document image is formed on a light-sensitive layer on the surface of the drum through rotary scanning of the drum.

The latent image mentioned above is subjected to reversal development conducted by developing unit 13 (Y) under the condition that developing agent on a developing sleeve is in the non-contact state, and a yellow (Y) toner image is formed as the photoreceptor drum 10 rotates.

Then, photoreceptor drum 10 is given potential on the yellow (Y) toner image thereon through charging operation of the scorotron charging unit 11 (M), then it is exposed to electric signals of optical exposure system 12 (M) corresponding to the second color signals, namely to magenta (M) image signals, and thereby a magenta (M) toner image is superposed on the aforementioned yellow (Y) toner image through reversal development of a non-contact type conducted by developing unit 13 (M).

In the same process as in the foregoing, a cyan (C) toner image corresponding to the third color signals formed by the scorotron charging unit 11 (C), optical exposure system 12 (C) and developing unit 13 (C) and a black (K) toner image corresponding to the fourth color signals formed by the scorotron charging unit 11 (K), optical exposure system 12 (K) and developing unit 13 (K) are formed and superposed in succession, thus a color toner image is formed on the circumferential surface of the photoreceptor drum 10 within its one rotation.

Exposure to an organic photoconductor layer of photoreceptor drum 10 is conducted by optical exposure systems 12 (Y, M, C, K) mentioned above through the transparent base object from the inside of the drum. Therefore, exposures of images corresponding respectively to the second, third and fourth color signals can be conducted without being affected by toner images formed in the preceding steps, and thus it is possible to form an electrostatic latent image identical to that corresponding to the first color signals. Incidentally, with regard to stabilization of a temperature and prevention of temperature rise in photoreceptor drum 10 relating to generation of heat caused by optical exposure systems 12(Y, M, C, K), a material having an excellent thermal conductivity is used for the supporting member 20, and when the temperature is low, a heater is used, while when it is high, a heat pipe is used for radiation of heat. In the case of developing operation conducted by each developing unit 13 (Y, M, C, K), developing bias to which DC is added or AC is further added is impressed on each developing sleeve 130 (Y, M, C, K), then jumping development by means of monocomponent or two-component developing agent contained in a developing unit is conducted, and reversal development of a non-contact basis is carried out for the photoreceptor drum 10 having a grounded transparent conductive layer while a DC bias, the polarity of which is the same as that of the toner, is impressed upon the photoreceptor drum 10.

A color toner image thus formed on the peripheral surface of the photoreceptor drum 10 is transferred onto a transfer sheet P by the action of the transfer unit 14*a*, wherein the transfer sheet P is sent out from the sheet feed cassette 15 by the feed roller 15*a* and conveyed to the timing roller 16 by a pair of conveyance rollers 15*b*, 15*c*, and the transfer sheet P is fed synchronously with the toner image on the photoreceptor drum 10 by the drive of the timing roller 16. In the case where the transfer sheet is a thick sheet of paper of OHT, the transfer sheet is sent to a manual feed tray 210 and then conveyed to the timing roller 16 by the manual feed roller 15*d* and a pair of conveyance rollers 15*e*.

Transfer sheet P onto which the toner image has been transferred is electrically discharged by the discharger 14*b*, so that the transfer sheet P is separated from the peripheral surface of the drum. Then the transfer sheet P is conveyed to the fixing unit 17 by the conveyance belt 14*e* provided between the drive conveyance roller 14*c* and the idle roller 14*d*. In the fixing unit 17, toner is heated and pressed by the fixing roller 17*a* and the pressure roller 17*b* so that the toner is fused and fixed onto the transfer sheet P. Then the transfer sheet P is discharged from the fixing unit 17 by the pulling rollers 17*c* and the fixing delivery rollers 17*d*. After that, the transfer sheet P is conveyed by the discharge paper conveyance rollers 18*a* and discharged to the paper discharge tray 200 on the apparatus through the paper discharge rollers 18.

After the transfer sheet has been separated from the photoreceptor drum 10, the surface of the photoreceptor drum 10 is rubbed by the cleaning blade 19*a* of the cleaning unit 19 so that the residual toner can be removed. In this way, the toner image formation is continued, or alternatively the toner image formation is once stopped and the formation of a new toner image is started. Used toner scraped off by the cleaning blade 19*a* is discharged to a used toner container not illustrated in the drawing by the action of the toner conveyance screw 19*b*.

Since the optical exposure system is arranged inside the photoreceptor drum 10, even if the drum diameter is relatively small, it is possible to arrange a plurality of scorotron chargers 11 (Y, M, C, K) and developing units 13 (Y, M, C, K) on the outer peripheral surface of the photoreceptor drum 10. When a drum of a small diameter of 60 mm to 150 mm is used, the apparatus can be made compact.

Spaces on the circumferential surface of the photoreceptor drum can be effectively utilized, and a compact well-balanced layout of the units can be provided when each unit is arranged in the following manner:

The developing units 13(M) and 13(C) are arranged symmetrically with respect to the vertical line M-O-N passing through the center O of the photoreceptor drum 10. The developing units 13(Y) and 13(K) are also arranged symmetrically with respect to the vertical line M-O-N passing through the center O of the photoreceptor drum 10. The developing units 13(Y) and 13(K) are symmetrically arranged with respect to the center O on the horizontal line passing through the center O. Angle θ1 formed by the lower vertical line O-N and the cleaning unit 19 arranged on the downstream side of the drum rotation is determined to be 5° to 45°. Angle θ2 formed by the lower vertical line O-N and the transfer unit 14*a* arranged on the upstream side of the drum rotation is determined to be 25° to 65°. When the units are arranged in the manner described above, it is possible to integrate the photoreceptor drum 10 and the optical exposure systems 12 (Y, M, C, K) with the scorotron chargers 11 (Y, M, C, K), the cleaning unit 19 and the developing units 13 (Y, M, C, K).

Figure 3:
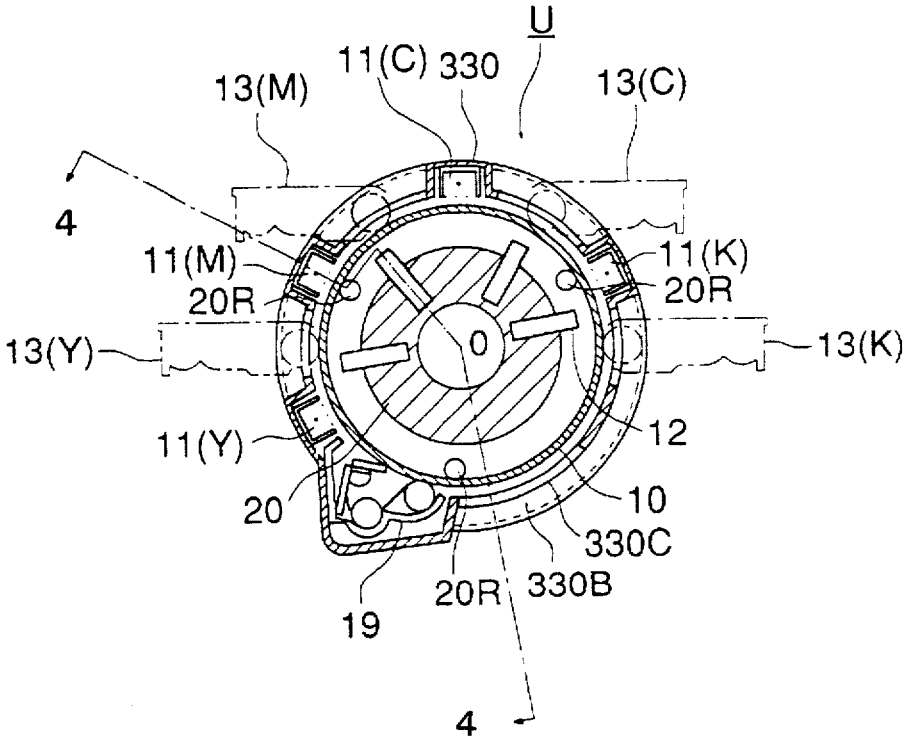
FIG. 3 is a sectional view of the unit of the first example to accomplish the first object of the present invention.
Figure 4:
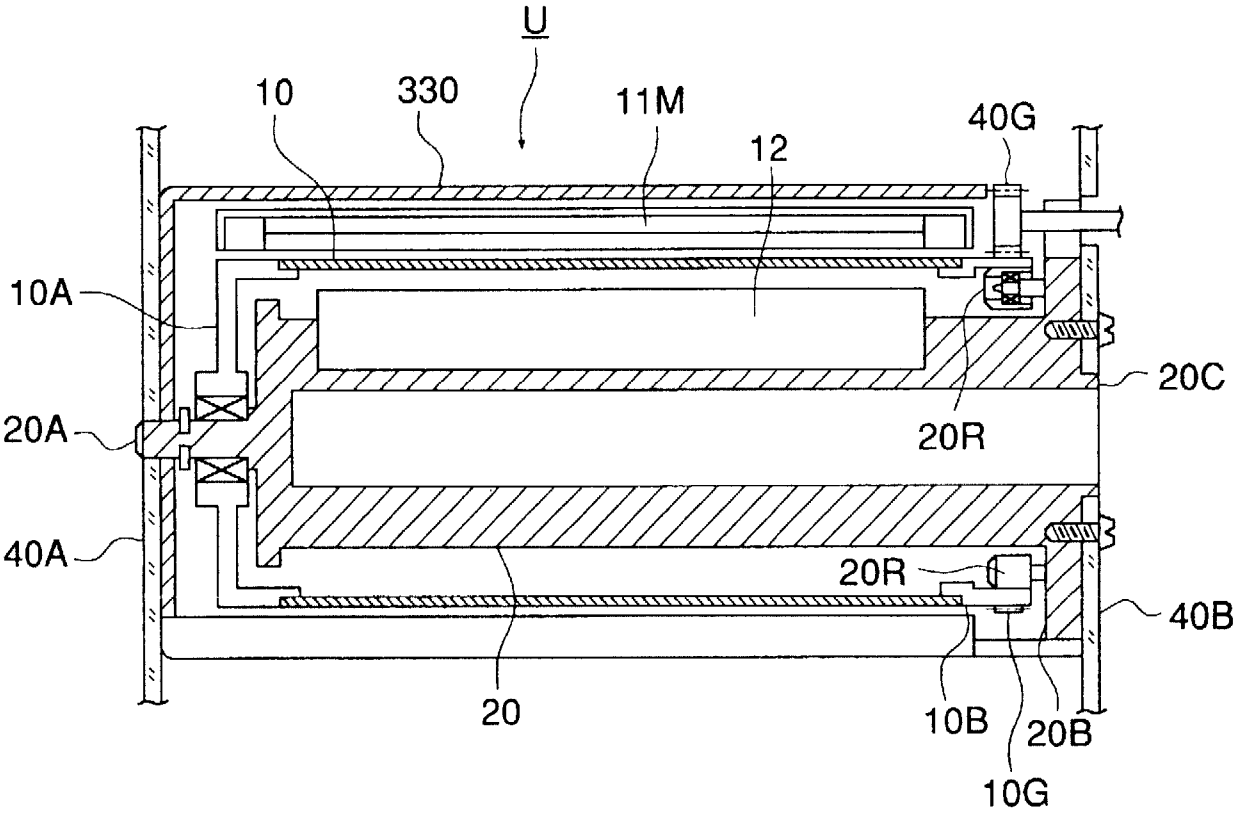
FIG. 4 is a sectional view taken along line 4-0-4 in FIG. 3, of the primary portion of the unit described above.

With reference to FIGS. 3 and 4, the first example of the first embodiment to accomplish the first object of the present invention will be explained as follows.

FIG. 3 is a sectional view of the photoreceptor drum 10 taken on a line in the rotational shaft direction. FIG. 4 is a sectional side view taken on line 4-0-4 in FIG. 3.

On both sides of the photoreceptor drum 10, there are integrally provided flanges 10A and 10B. The flange 10A is supported through a bearing by a support shaft 20A protruding from the center of a support member 20 of the optical exposure system 12. On the other hand, the flange 10B is rotatably supported by three guide rollers 20R provided in the flange portion 20B of the support member 20.

The photoreceptor drum 10 and the support member 20 are integrally accommodated in a cylindrical protective cover 330 engaged with the support shaft 20A and the flange portion 20B, so that they are integrated into a unit U. The support shaft 20A is engaged with a base plate 40A of the apparatus body, and the engaging portion 20C of the flange portion 20B is engaged with the base plate 40B of the apparatus body. In this way, the support shaft 20A and the flange portion 20B are positioned and fixed.

Consequently, the photoreceptor drum 10 and the optical exposure system 12 are handled as an integrated unit U. As a result, the image formation distance of the optical system can be always maintained constant with respect to the photosensitive layer.

The protective cover 330 integrally accommodates not only the photoreceptor drum 10 but also the chargers 11 and cleaning unit 19. On the circumferential surface 330B of the protective cover 330 formed around the drum surface, there is provided an opening 330C through which the developing unit 13, transfer unit 14*a* or discharger 14*b* is opposed to the photoreceptor surface.

After the unit U has been attached to the apparatus body, the developing unit 13, transfer unit 14*a* and discharger 14*b* are installed at predetermined positions.

In this connection, it is also possible to extend the dimensions of the unit U, so that each developing unit 13 can be integrally accommodated in the unit U. Also, it is possible to integrally accommodate only the photoreceptor drum 10 and each optical exposure system 12 in the unit U:

Simultaneously when the unit U is attached to the apparatus body, the gear 10G provided on the outer circumference of the flange 10B of the photoreceptor drum 10 is meshed with the drive gear 40G provided on the apparatus body side, so that the photoreceptor drum 10 is driven through the gears.

Figure 7:
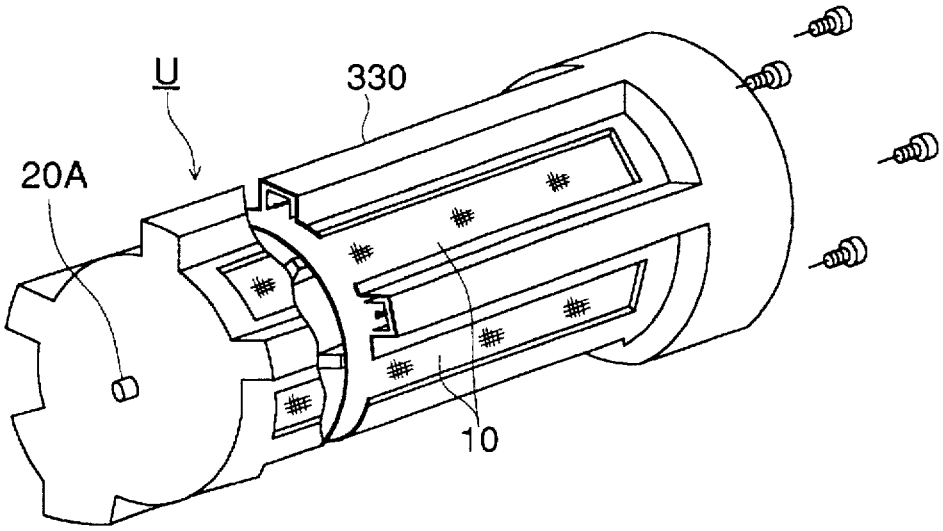
FIG. 7 is a perspective view showing the appearance of the unit shown in FIG. 3.

FIG. 7 is a perspective view showing the appearance of the unit U.

Next, with reference to FIGS. 5 and 6, the second example to accomplish the first object of the present invention will be explained below.

Figure 5:
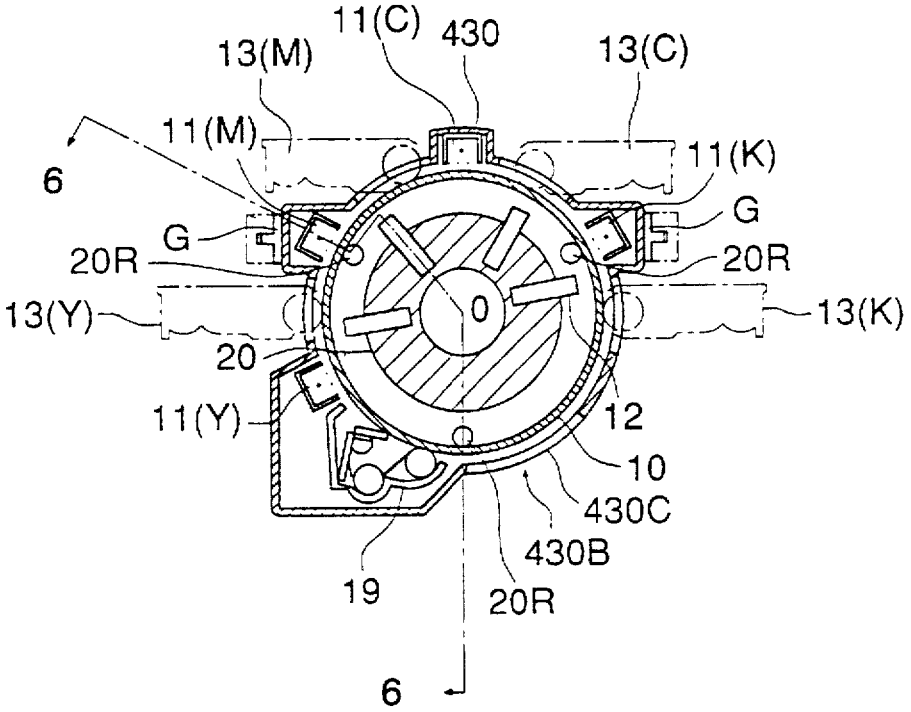
FIG. 5 is a sectional view of the cartridge of the second example to accomplish the first object of the present invention.
Figure 6:
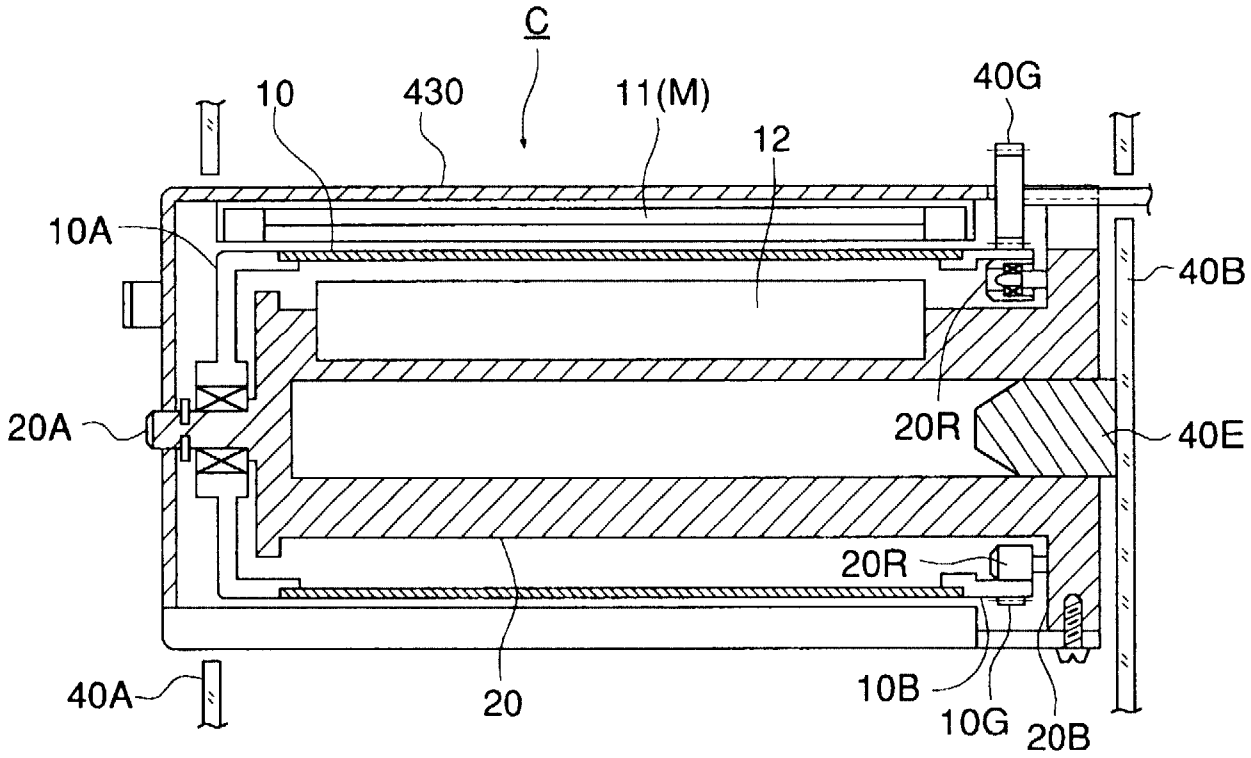
FIG. 6 is a sectional view taken along line 6-0-6 in FIG. 5, of the primary portion of the cartridge.

FIG. 5 is a sectional view of the photoreceptor drum 10 taken on a line in the axial direction. FIG. 6 is a sectional side view taken on line 6-0-6 in FIG. 5.

On both sides of the photoreceptor drum 10, there are integrally provided flanges 10A and 10B. The flange 10A is supported through a bearing by a support shaft 20A protruding from the center of a support member 20 of the optical exposure system 12. On the other hand, the flange 10B is rotatably supported by three guide rollers 20R provided in the flange portion 20B of the support member 20.

The photoreceptor drum 10 and the support member 20 are integrally accommodated in a cylindrical casing 430 engaged with the support shaft 20A and the flange portion 20B, so that they are integrated into a cartridge C. Guide rails G attached on both sides are inserted into guide members (shown by a one-dotted chain line in the drawing) provided on the apparatus body side, and a reference pin 40E is engaged with the cartridge C, and other portions not shown in the drawing are engaged. In this way, the cartridge C is installed at a predetermined position between the base plates 40A and 40B of the apparatus body. When the engaging members described above are released, the cartridge C can be easily picked up from the apparatus.

Accordingly, the photoreceptor drum 10 and the optical exposure system 12 are integrally attached to and detached from the apparatus body in the form of the cartridge C. As a result, the image formation distance of the optical system can be always maintained constant with respect to the photosensitive layer.

The casing 430 integrally accommodates not only the photoreceptor drum 10 but also the chargers 11 and cleaning unit 19. On the circumferential surface 430B of the casing 430 formed around the drum surface, there is provided an opening 430C through which the developing unit 13, transfer unit 14A or discharger 14B is opposed to the photoreceptor surface.

When the cartridge C is attached to or detached from the apparatus body, the developing unit 13, transfer unit 14A and discharger 14B are withdrawn from the photosensitive surface of the photoreceptor drum 10 in order to avoid interference.

In this connection, it is also possible to extend the dimensions of the cartridge C, so that each developing unit 13 can be integrally accommodated in the unit U. Also, it is possible to integrally accommodate only the photoreceptor drum 10 and each optical exposure system 12 in the unit U.

Simultaneously when the cartridge C is attached to the apparatus body, the gear 10G provided on the outer circumference of the flange 10B of the photoreceptor drum 10 is meshed with the drive gear 40G provided on the apparatus body side, so that the photoreceptor drum 10 is driven through the gears.

Figure 8:
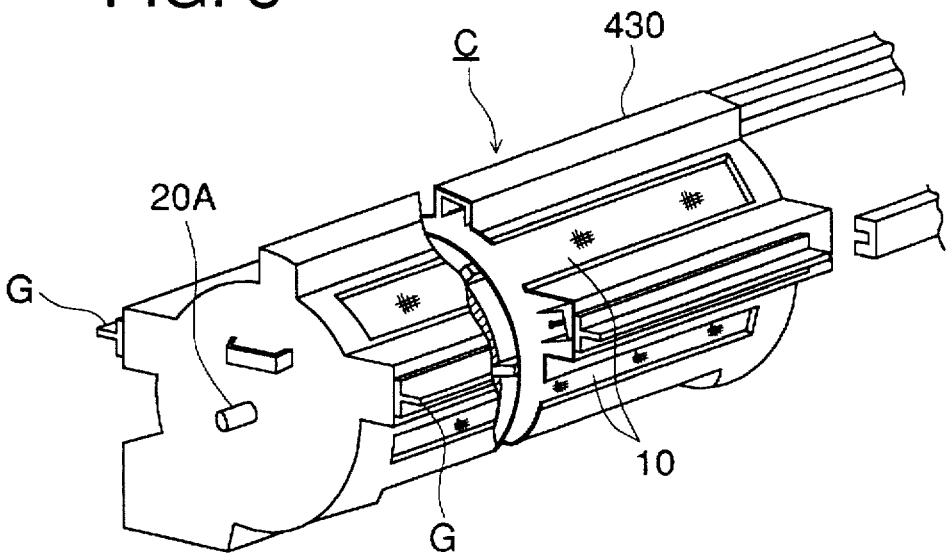
FIG. 8 is a perspective view showing the appearance of the cartridge shown in FIG. 5.

FIG. 8 is a perspective view showing the appearance of the cartridge C.

According to the first example of the present invention, the image forming body and the exposure means are always handled in the form of one unit. Therefore, a positional relation between the image forming body and the exposure means is not varied, and the image formation accuracy of the optical exposure system is maintained to be stable. As a result, it is possible to provide a color image forming apparatus capable of forming an image of high resolution and quality.

EXAMPLES 3 TO 7

Figure 9:
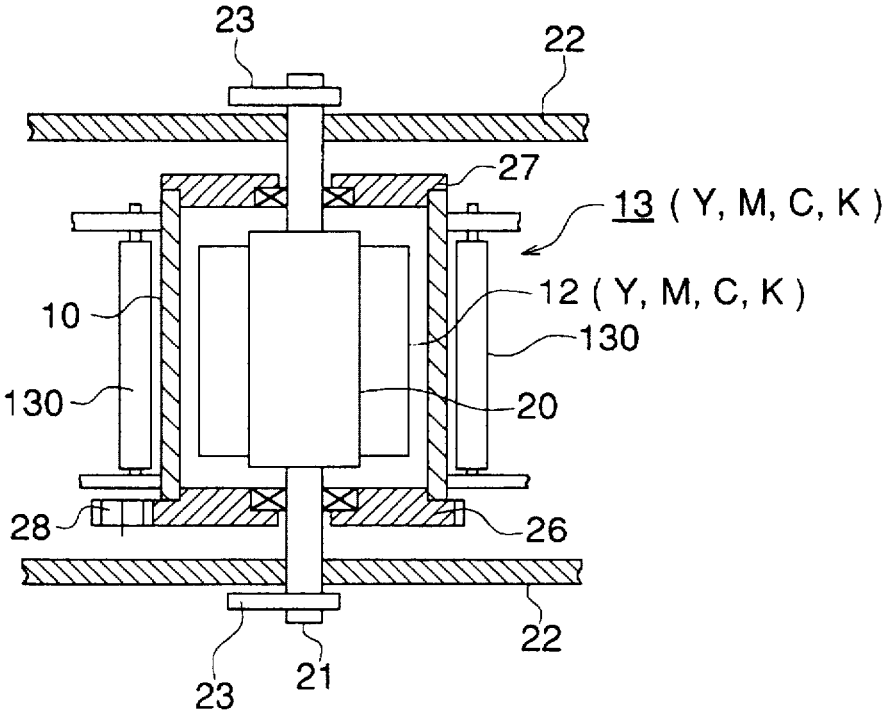
FIG. 9 is a sectional view of main portions suitable for working of examples 3 to 7 for attaining the first object of the invention.
Figure 10:
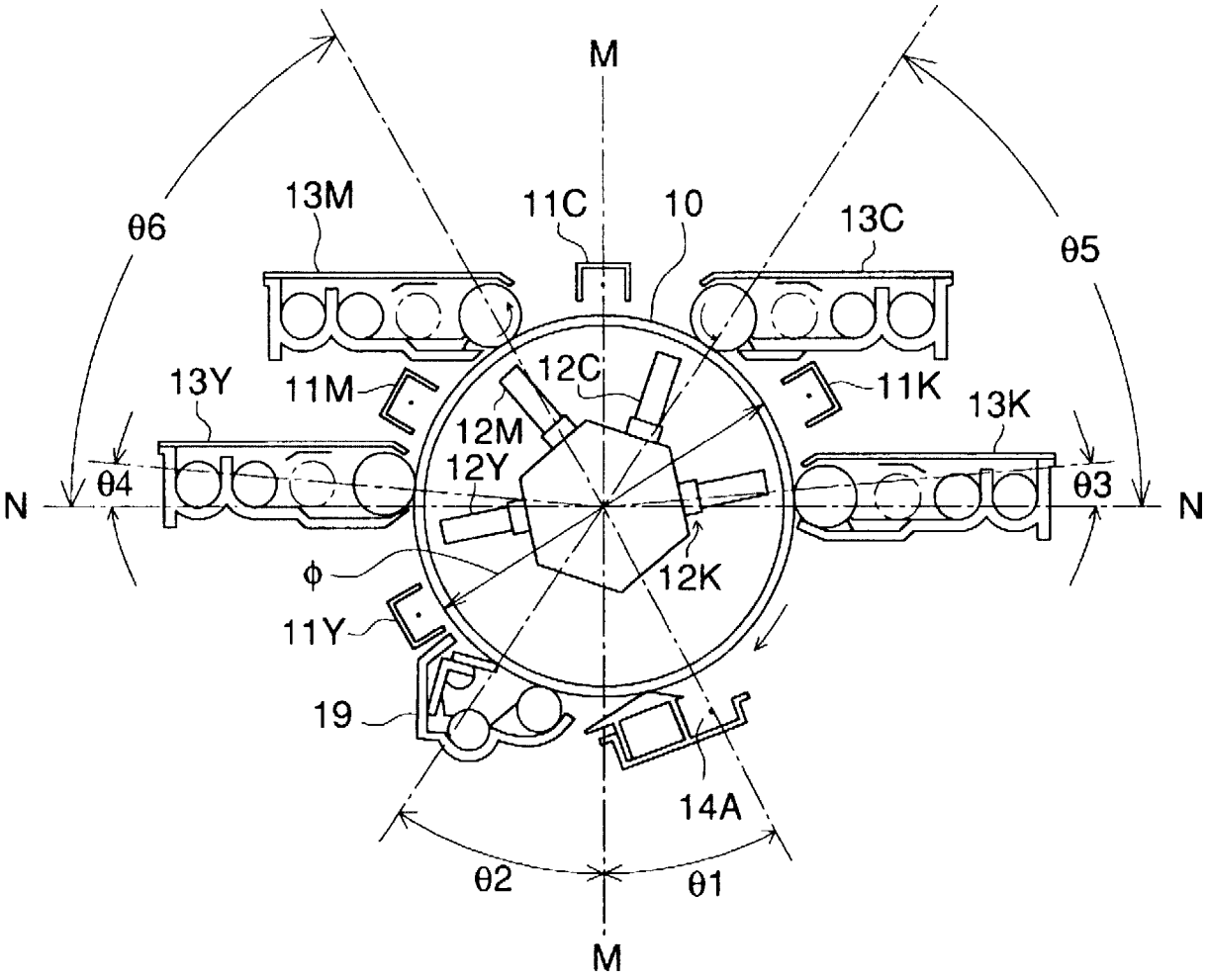
FIG. 10 is a layout illustration of a unit suitable for working of the invention.

Prior to explanation of each example, the constitution of an image forming apparatus suitable for examples 3–7 for attaining the first object of the invention will be explained as follows, referring to FIGS. 1, 9 and 10. FIG. 9 is a sectional view of primary portions suitable for working of the invention, and FIG. 10 is an illustration for layout of a unit suitable for working of the invention.

Each of both ends of photoreceptor drum 10 is provided with a flange supported by a bearing as shown in FIG. 9, and a gear provided on the outer circumferential surface of the flange is engaged with a driving gear whose power rotates photoreceptor drum 10 clockwise in the figure while a transparent conductive layer is grounded.

Next, the constitution of an image forming body and an imagewise exposure means will be explained, referring to FIG. 9. Both ends of image forming body 10 are fixed respectively by flange 26 and flange 27 which are rotatable around shaft 21 through bearings. On the other hand, each of imagewise exposure means 12Y, 12M, 12C and 12K constituted respectively by an LED and a SELFOC lens is fixed on supporting member 20 which is further fixed on the shaft 21. The shaft 21 is fixed on side plate 22 by means of locking member 23. A method of locking will be explained in detail, referring to FIG. 11. An outer circumferential surface of the flange 26 is provided with a gear which is engaged with driving gear 28. Rotation of the driving gear 28 causes the image forming body 10 to be rotated. Each of developing units 13Y, 13M, 13C and 13K is arranged to be retractable from the image forming body 10, and a gap between developing sleeve 130 and the circumferential surface of the image forming body 10 can be kept constant by a gap maintaining member on each of developing units 13Y, 13M, 13C and 13K.

After the start of image recording, an unillustrated motor for driving a photoreceptor starts rotating driving gear 28 (see FIG. 9) which then rotates the photoreceptor drum 10 clockwise. Concurrently with this, charging unit 11Y starts donating potentials through its charging action to the photoreceptor drum 10.

Next, in FIG. 10, for the reason that exposure optical systems 12Y, 12M, 12C and 12K are housed in the photoreceptor drum 10, even a drum diameter of the photoreceptor drum 10 is relatively small, a plurality of charging units 11Y, 1M, 11C and 11K and developing units 13Y, 13M, 13C and 13K can be provided on the outer circumferential surface of the photoreceptor drum 10. Thus, it is possible to make a volume of an apparatus small by using a drum having a small outside diameter of 60 mm–160 mm.

Further, two of exposure optical systems 12Y, 12M, 12C and 12K and of developing units 13Y, 13M, 13C and 13K respectively are arranged on the left side and the other two of the exposure optical systems 12Y, 12M, 12C and 12K and of the developing units 13Y, 13M, 13C and 13K respectively are arranged on the right side both of vertical line M—M which passes through the center of photoreceptor drum 10 and serves as an axis of symmetry in the figure, and transfer unit **14*a* is arranged on one side and cleaning unit 19 is arranged on the other side both below horizontal line N—N passing through the center of the photoreceptor drum 10** in the figure.

When arranging exposure optical systems 12Y, 12M, 12C and 12K and developing units 13Y, 13M, 13C and 13K to be almost symmetrical about vertical line M—M as shown in the figure and arranging transfer unit **14*a* so that angle θ1 formed by vertical line M—M below horizontal line N—N and a line passing through the center of transfer unit 14*a* and being deflected toward the upstream side in terms of rotation of photoreceptor drum 10 may be 5–40 degrees, and arranging cleaning unit 19 so that angle θ2 formed by vertical line M—M below horizontal line N—N and a line passing through the point where the cleaning unit touches the photoreceptor drum 10 and being deflected toward the downstream side in terms of rotation of photoreceptor drum 10 may be 20–50 degrees, and when setting θ3 and θ4 formed respectively by horizontal line N—N and a line passing through the center of a developing sleeve in each of a pair of developing units 13K and 13Y arranged at right and left on the upper side to be within ±31 degrees and setting θ5 and θ6 formed respectively by horizontal line N—N and a line passing through the developing units 13C and 13M arranged at right and left on the upper side to be within a range from 45 degrees to 75 degrees, it is possible to use the circumferential surface of a photoreceptor effectively and thereby to obtain layout well-balanced in terms of outer shape and vertical direction. Incidentally, a transfer roller or a transfer belt may also be used in place of a corona discharger for transfer unit 14*a***.

When developing units are arranged at right and left on the upper side so that they come in contact with an image forming body, force to move the image forming body downward is produced. Owing to such arrangement, the image forming body 10 can cause a shaft supporting imagewise exposure means 12Y, 12M, 12C and 12K to be fixed and supported stably by side grooves on side plates on both sides provided on the apparatus main body. For the purpose of fixing the image forming body 10, a locking member is provided for firm fixing (see FIG. 11).

EXAMPLE

An image forming apparatus in an example related to the third example of the invention will be explained based on FIG. 11 as follows, referring to FIGS. 1, 9 and 10.

Figure 11:
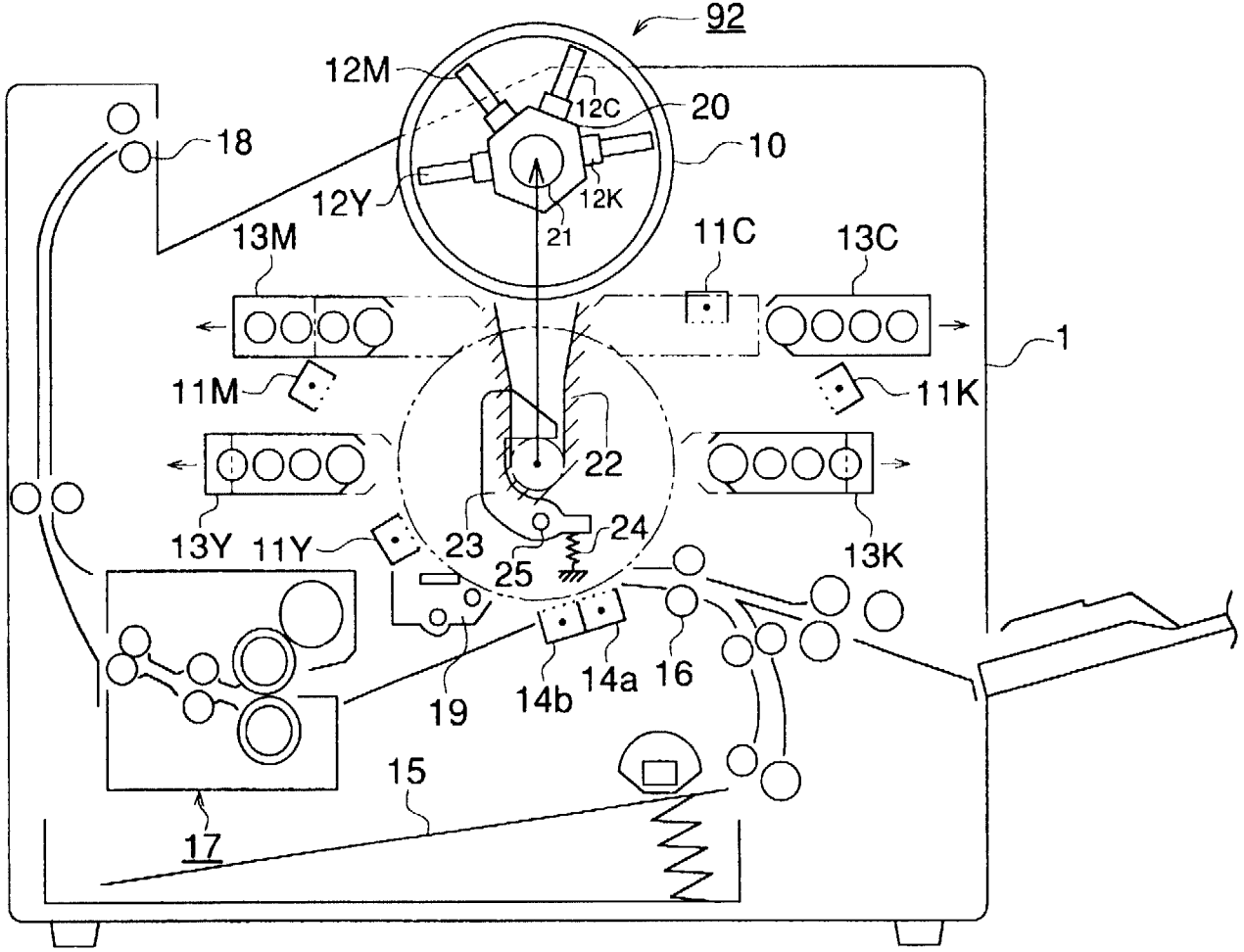
FIG. 11 is a total structural sectional view of an image forming apparatus wherein units of example 3 are mounted.

FIG. 11 is a sectional view of the overall structure of an image forming apparatus on which a unit in example 3 is mounted or from which the unit is dismounted. Incidentally, members common to those in FIGS. 1, 9 and 10 are given the same symbols, and explanation for those remaining unchanged structurally and functionally will be omitted.

Main body 1 is provided with side plate 22, and developing unit 13M and charging unit 11M can be moved solidly toward the left side in the figure when unit 92 is mounted on or dismounted from the main body. In the same manner, developing unit 13Y can also be moved to the left side. Further, developing unit 13C, charging unit 11C and charging unit 11K can be moved solidly to the right side, and developing unit 13K can also be moved to the right side similarly. On the other hand, the unit 92 is provided with image forming body 10, imagewise exposure means 12Y, 12M, 12C and 12K and shaft 21. The unit 92 is fixed in the manner wherein the shaft 21 enters a U-shaped groove on the main body and is pushed, and the unit 92 is fixed by locking member 23 provided with shaft 25. Incidentally, the locking member 23 is urged by spring 24.

EXAMPLE 4

An image forming apparatus in an example related to the fourth example of the invention will be explained based on FIG. 12 as follows.

Figure 12:
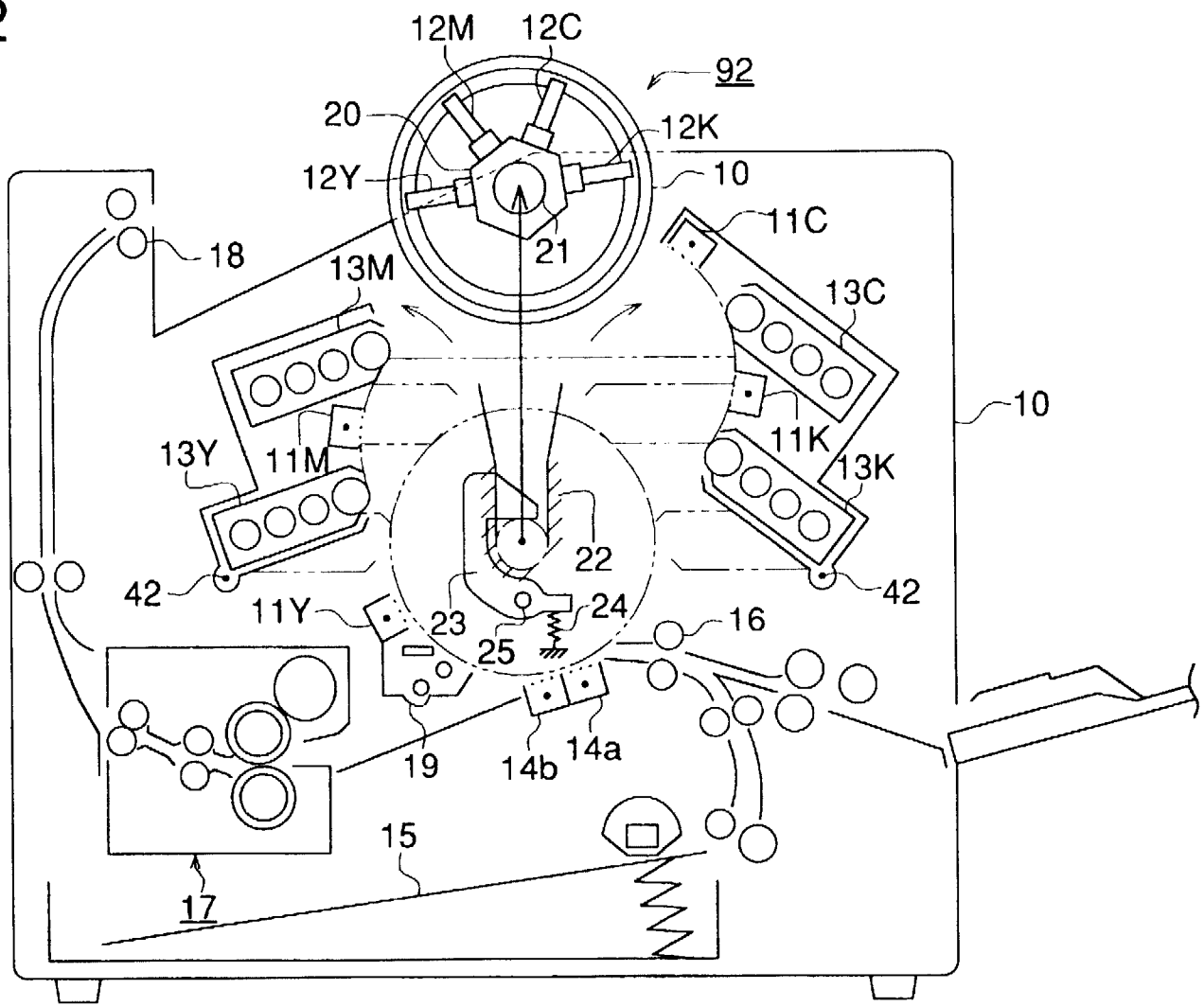
FIG. 12 is a total structural sectional view of an image forming apparatus wherein units of example 4 are mounted.

FIG. 12 is a sectional view of the overall structure of an image forming apparatus on which a unit in an example is mounted or from which the unit is dismounted. Incidentally, members common to those in FIGS. 1, 9 and 10 are given the same symbols, and explanation for those remaining unchanged structurally and functionally will be omitted.

In FIG. 12, retreat of a developing unit and a charging unit is of a rotary type, which is a variation of FIG. 11. Unit 92 is provided with image forming body 10, imagewise exposure means 12Y, 12M, 12C and 12K and shaft 21. Side plate 22 provided on main body 1 is provided with locking member 23 that is supported by shaft 25, and on the side plate 22, there is provided a bearing portion that supports the shaft 25. On the main body 1, developing units 13M and 13Y as well as charging unit 11M are rotatable solidly around shaft 42. Further, in the same manner, developing units 13C and 13K as well as charging units 11C and 11K are rotatable solidly around shaft 42. The unit 92 is arranged so that it can be taken out of the apparatus upward when a claw of locking member 23 is disengaged. In the same manner as in Example 3, the unit 92 can be fixed on the apparatus main body through contact of developing units.

Now, how to take out a unit will be explained as follows. First, each developing unit and each charging unit are rotated clockwise or counterclockwise as shown in the figure in an unillustrated method. After that, the unit 92 is taken out of the apparatus upward.

EXAMPLE 5

An image forming apparatus in an example related to the fifth embodiment of the invention will be explained based on FIG. 13 as follows, referring to FIGS. 1, 9 and 10.

Figure 13:
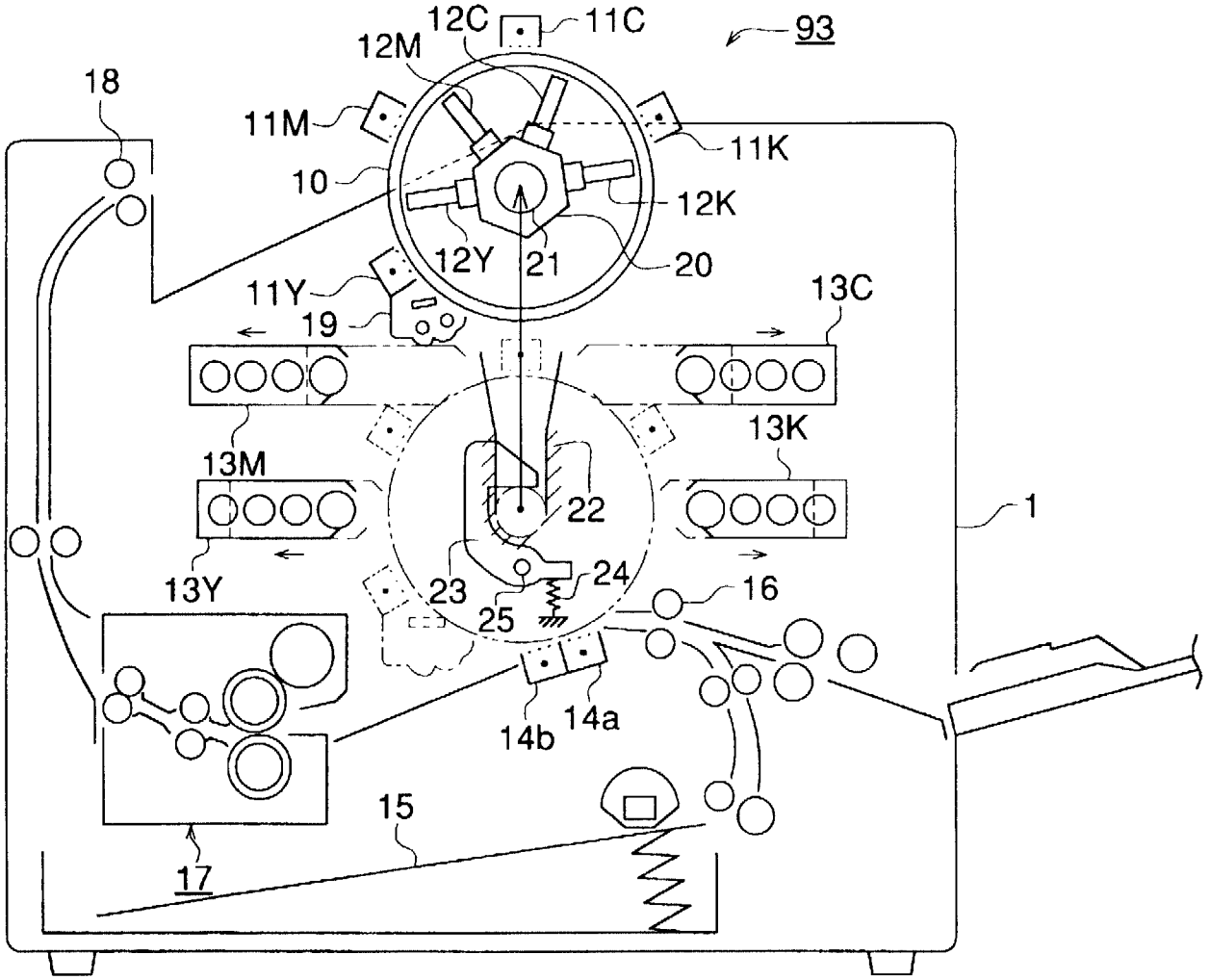
FIG. 13 is a total structural sectional view of an image forming apparatus showing how units are taken out of a process unit of example 5 that is taken out of the apparatus.

FIG. 13 is a sectional view of the overall structure of an image forming apparatus showing how a unit is taken out of the mounted process unit in the example. Incidentally, members common to those in FIGS. 1, 9 and 10 are given the same symbols, and explanation for those remaining unchanged structurally and functionally will be omitted.

Side plate 22 provided on main body 1 is provided with locking member 23 that is supported by shaft 25, and on the side plate 22, there is provided a bearing portion that supports the shaft 21. Further, developing units 13M, 13Y, 13C and 13K are arranged to be movable respectively. Unit 93 is provided with image forming body 10, imagewise exposure means 12Y, 12M, 12C and 12K, charging units 11Y, 1M, 11C and 11K as well as cleaning unit 19 and shaft 21.

Now, how to take out a unit will be explained as follows. First, each developing unit is retreated to the left side or the right side of the apparatus main body in an unillustrated method. After that, locking member 23 is disengaged from the unit 93 and the unit 93 is taken out upward. With regard to the cleaning unit 19, since the unit 93 is mounted or dismounted upward, toner is not spilt. In the same manner as in Example 3, the unit 93 can be fixed on the apparatus main body through contact of developing units.

EXAMPLE 6

An image forming apparatus in an example related to the sixth example of the invention will be explained based on FIG. 14 as follows.

Figure 14:
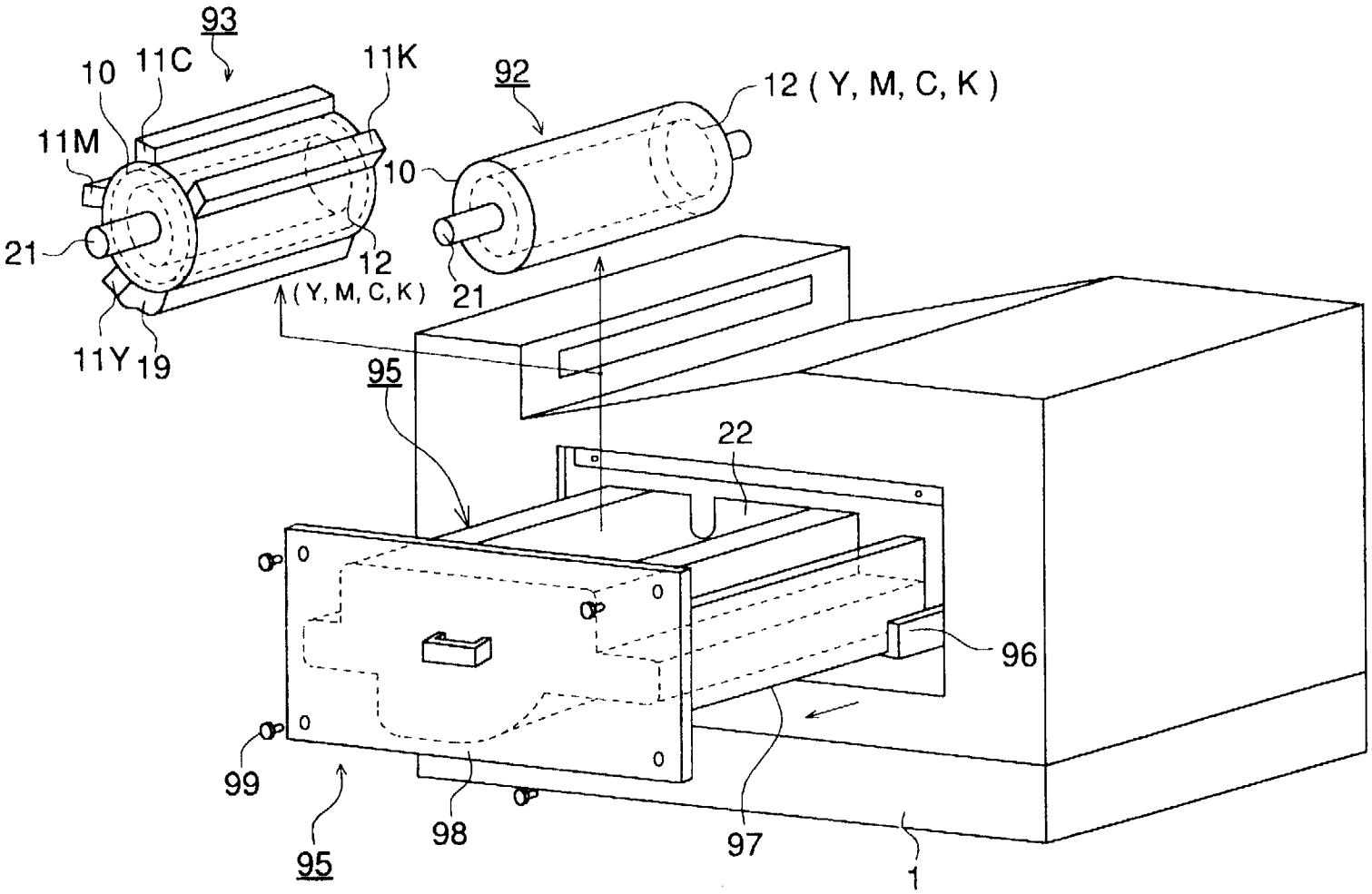
FIG. 14 is a perspective view of an image forming apparatus showing how units are taken out of a process unit of example 6 that is mounted on the apparatus.

FIG. 14 is a perspective view of an image forming apparatus showing how the unit is taken out of the mounted process unit in the example. Incidentally, members common to those in FIGS. 1, 9 and 10 are given the same symbols, and explanation for those remaining unchanged structurally and functionally will be omitted.

Main body 1 is provided with guide plate 96 which holds process unit 95 having thereon drawer plate 97. The process unit 95 is a process unit having thereon aforesaid unit 92 and its surrounding image forming means such as a charging unit, a cleaning means, or a unit 93 including the same, or further a developing unit. The drawer plates 97 and 98 are fixed with spring 99 so that it may be drawn out of the apparatus main body through drawing. On the other hand, the unit 92 is provided with image forming body 10, imagewise exposure means 12Y, 12M, 12C and 12K and shaft 21. In addition to those, a cleaning means and a charging unit are provided on the unit 93. Both unit 92 and unit 93 can be either mounted on or dismounted from unit 95.

Now, how to take out unit 92 and unit 93 will be explained as follows.

The process unit 95 is drawn out to the left side in the figure. Then, a developing unit, a charging unit and a cleaning unit are further retreated from the process unit 95 drawn out. After that, the unit 92 can be taken out of the apparatus main body upward. Incidentally, after retreating a developing unit, it is also possible to take out of unit 95 the unit 93 on which a charging unit and a cleaning unit are united solidly.

EXAMPLE 7

An image forming apparatus in an example related to the seventh example of the invention will be explained based on FIG. 15 as follows.

Figure 15:
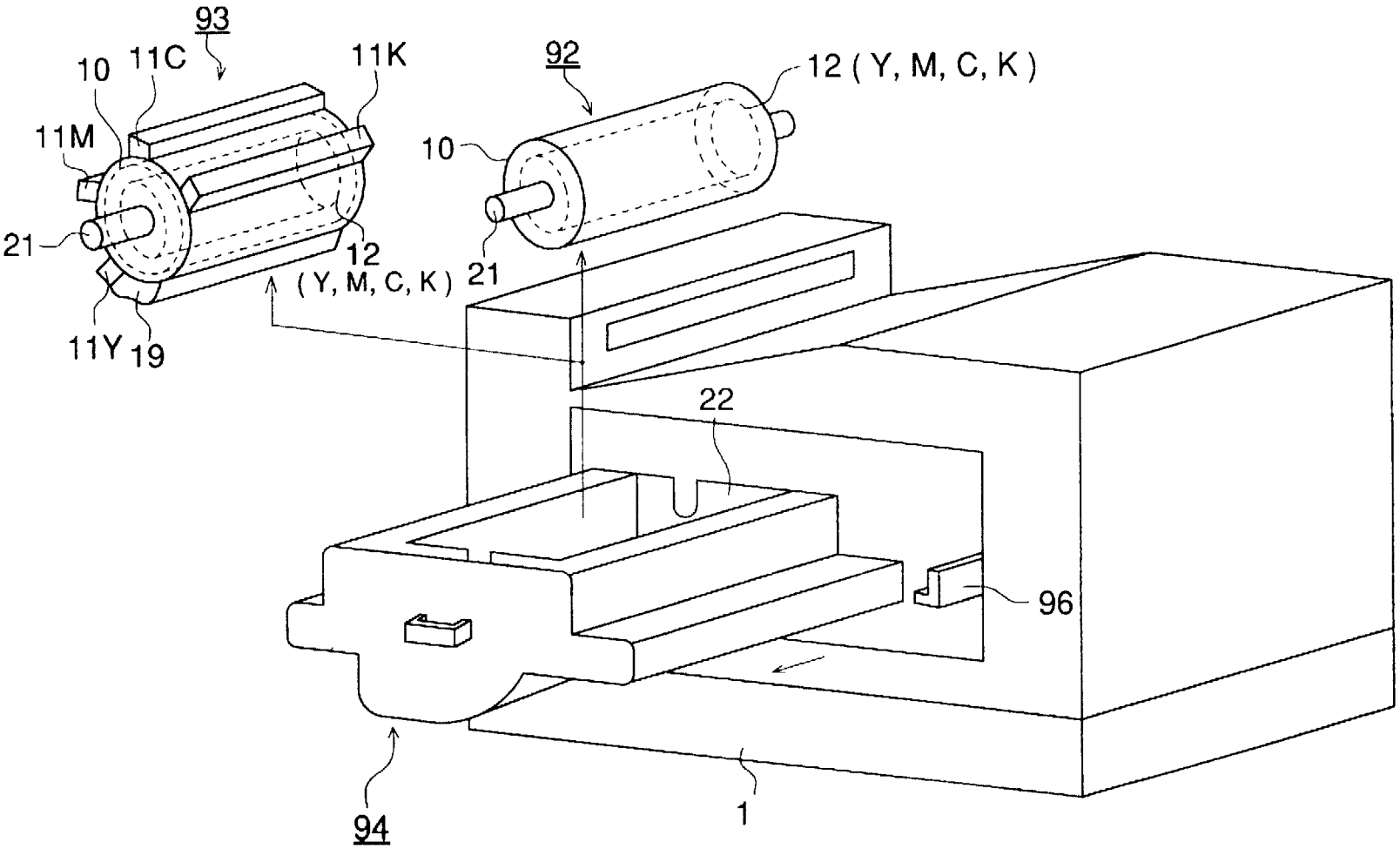
FIG. 15 is a perspective view of an image forming apparatus showing how a process unit of example 7 is mounted or dismounted.
Figure 16:
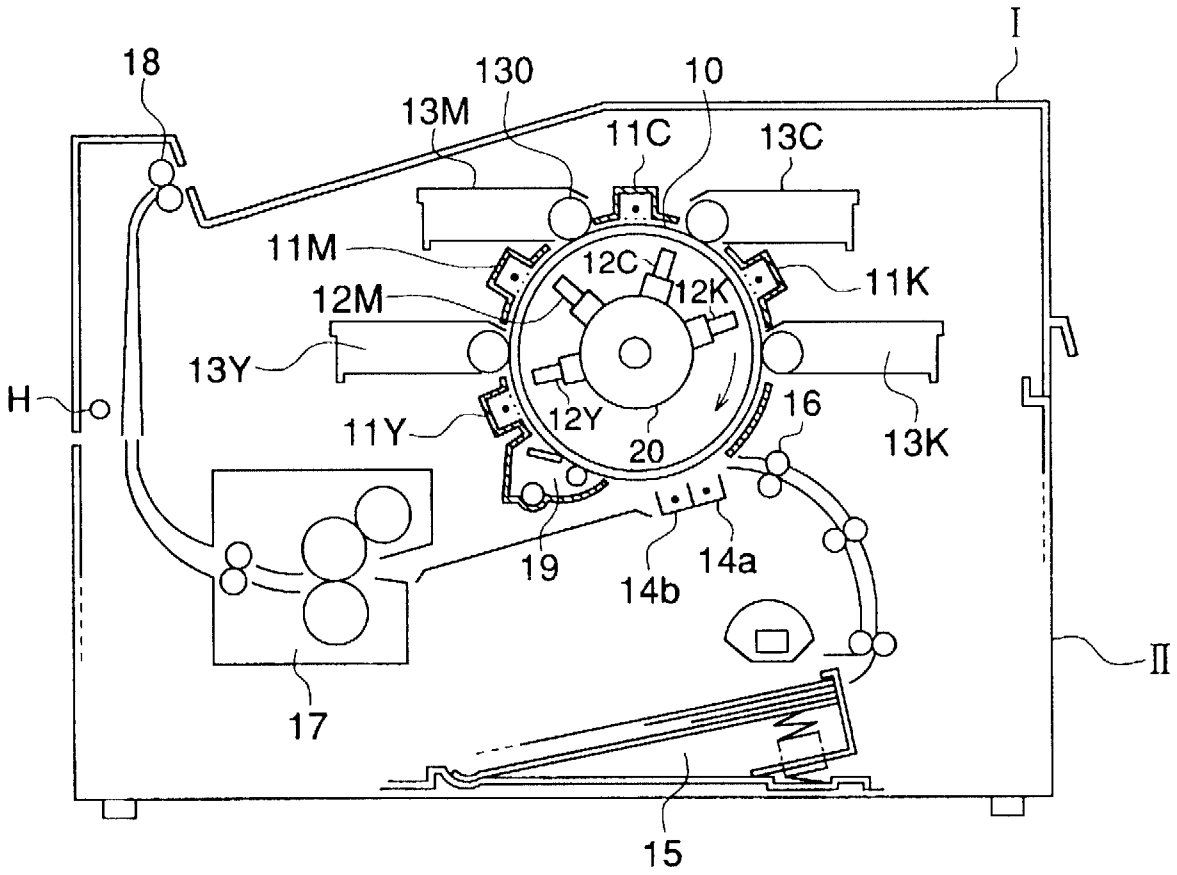
FIG. 16 is a diagram of the sectional structure of a color image forming apparatus.

FIG. 15 is a perspective view of an image forming apparatus showing how the process unit of the example is mounted or dismounted. Incidentally, members common to those in FIGS. 1, 9 and 10 are given the same symbols, and explanation for those remaining unchanged structurally and functionally will be omitted.

Main body 1 is provided with guide plate 96 which holds process unit 94. The process unit 94 is a process unit having thereon aforesaid unit 92 and its surrounding image forming means such as a charging unit, a cleaning means, or a unit 93 including the same, or further a developing unit. Aforesaid unit 92 is provided with image forming body 10, imagewise exposure means 12Y, 12M, 12C and 12K and shaft 21. In addition to those provided on unit 92, a cleaning means and a charging unit are provided on unit 93. Incidentally, the process unit 92 can be fixed stably through contact of developing units in the same manner as in other examples, though it is not illustrated.

Now, how to take out units 92 and 93 will be explained as follows. The process unit 94 can be taken out and mounted when it is drawn to the left side in FIG. 15, and unit 92 or unit 93 can further be taken out of the process unit 94 taken out upward on the apparatus main body 1 in the same manner as in the explanation of FIG. 14.

Due to the constitution mentioned above, an image forming body and an imagewise exposure means both requiring high positioning accuracy can be mounted or dismounted solidly in an image forming apparatus of a type wherein an imagewise exposure means is incorporated in the image forming body. Accordingly, it has become possible to take the structure wherein mounting on and dismounting from the apparatus main body are easy, by retreating a developing unit for mounting and dismounting. Further, due to developing units of the image forming body arranged on the top portion to be symmetrical between right and left, the image forming body is not subjected to unbalanced force, and thereby is fixed easily and is mounted from the top or dismounted upward easily. In addition, there has been realized an image forming apparatus capable of maintaining high accuracy and of being maintained easily.

EXAMPLE 8

Another example of the invention will be explained as follows referring to FIGS. 16–21.

Figure 17:
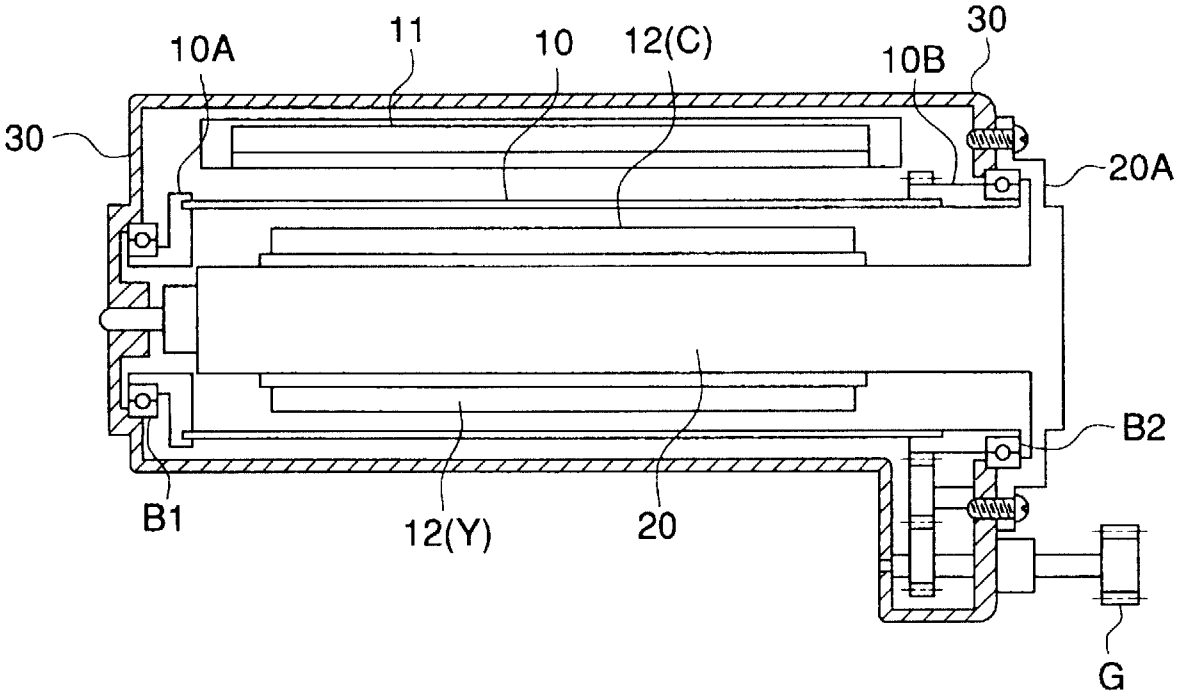
FIG. 17 is a diagram of the sectional structure of a process cartridge.

Aforesaid photoreceptor drum 10 is arranged to be rotated clockwise by driving power of gear G transmitted from a driving system located on the apparatus main body, with its flange member 10A constituting its one end supported on a wall surface on one side of process cartridge 30 described later through a bearing as shown in FIG. 17 and with flange member 10B constituting an end on the other side supported by bearing B2 that is sandwiched and supported between a wall surface on the other side of process cartridge 30 and supporting member 20 for exposure optical systems 12Y, 12M, 12C and 12K.

Aforesaid process cartridge 30 accommodates solidly supporting member 20 that unites aforesaid photoreceptor drum 10 and exposure optical systems 12Y, 12M, 12C and 12K and both or at least one of charging units 11Y, 11M, 11C and 11K and cleaning unit 19, and it is mounted on or dismounted from the apparatus main body independently of developing units 13Y, 13M, 13C and 13K.

On the other hand, aforesaid apparatus main body is composed of upper main body I accommodating process cartridge 30 and developing units 13Y, 13M, 13C and 13K and of lower main body II accommodating transfer unit **14*a*, separation unit 14*b*, sheet-feed cassette 15 and fixing unit 17**.

Figure 18:
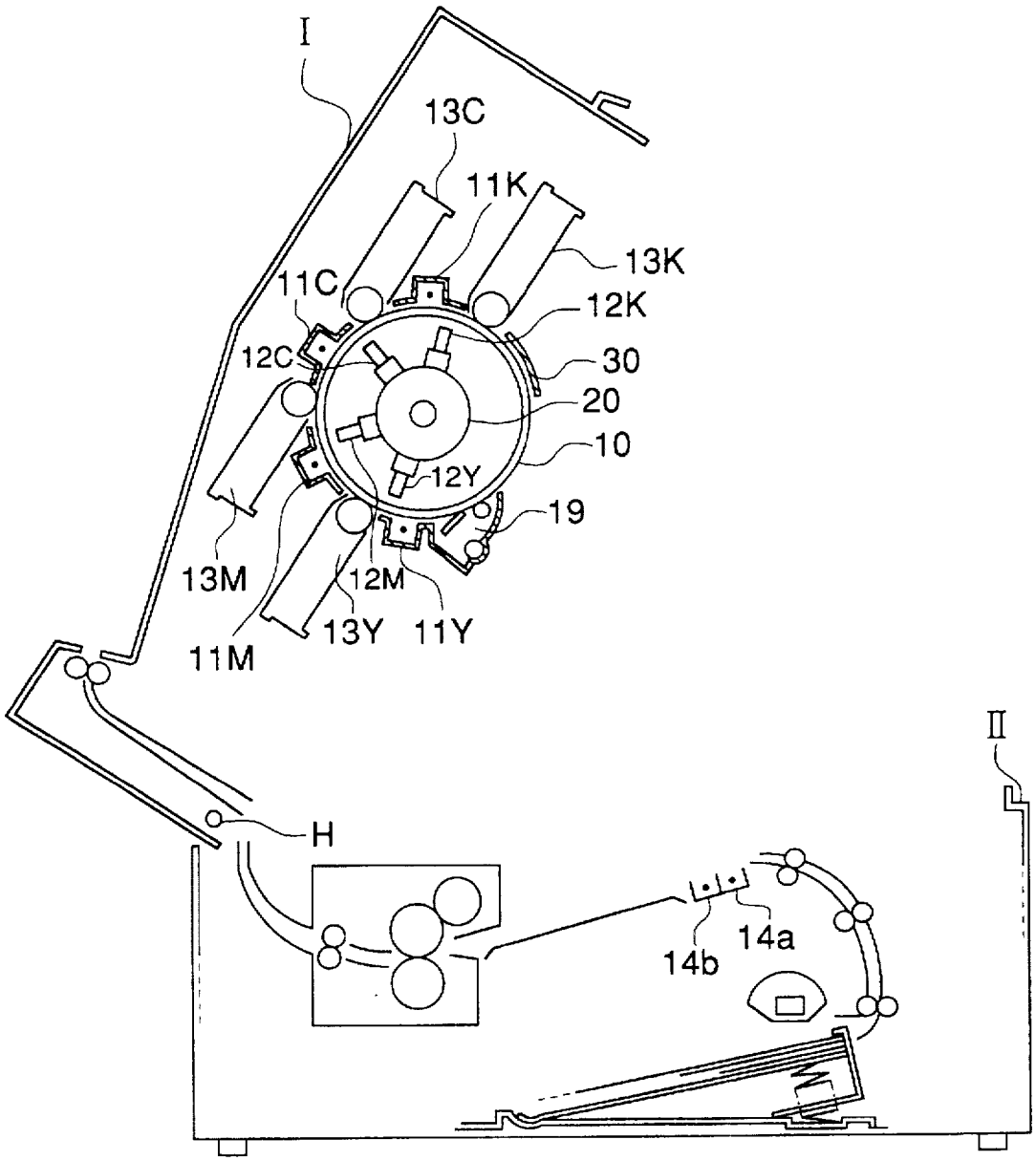
FIG. 18 is a diagram of the sectional structure showing how an apparatus is opened (first type).

As shown in FIG. 18, aforesaid upper main body I is capable of being swiveled around hinge H to be opened from the side of feeding a recording sheet, namely, from the right side of the apparatus main body, thus, the process cartridge 30 and developing units 13Y, 13M, 13C and 13K are moved up above a transfer portion, namely the transfer unit **14*a***, where they can be amounted or dismounted.

Figure 19:
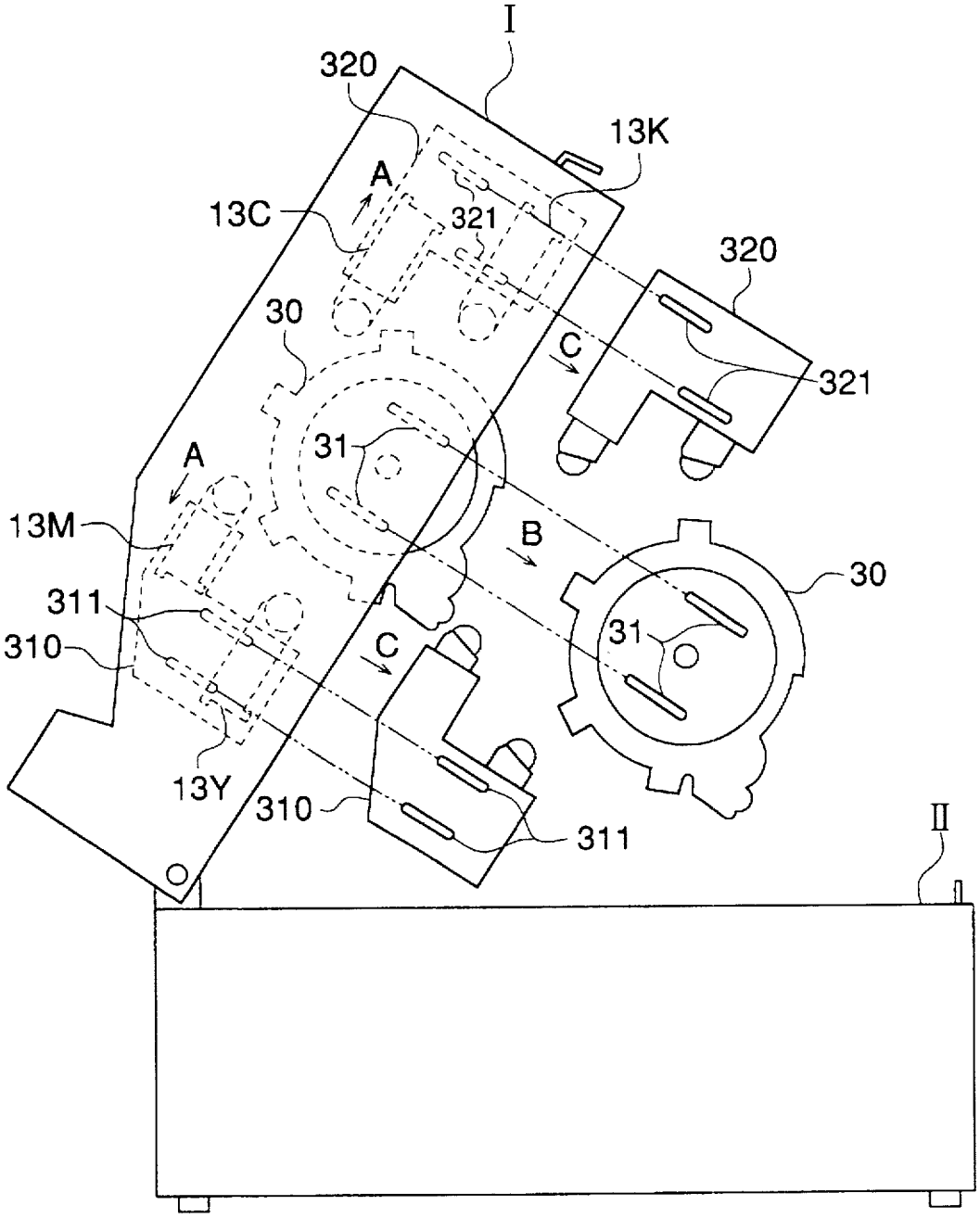
FIG. 19 is an illustration showing how a process cartridge and developing units are mounted or dismounted.

As shown in FIG. 19, aforesaid process cartridge 30 is provided with a pair of projections for guide 31 on each of front and rear sides thereof, so that it may be locked at the position where aforesaid paired projections are engaged with a pair of guide grooves (unillustrated) arranged on each of front and rear base boards in the upper main body I, thus, the process cartridge 30 is set to the prescribed image forming position with power supply and power transmission both connected automatically.

On the other hand, aforesaid developing units 13Y, 13M, 13C and 13K are housed separately in two developing components 310 and 320 which are placed on a carriage (not shown), so that they are set to the prescribed developing position to be brought into contact with a circumferential surface of photoreceptor drum 10, with power supply and power transmission both connected automatically.

Each of aforesaid developing components 310 and 320 is arranged to be retreated from process cartridge 30 through parallel movement on the carriage in the direction of arrow A in FIG. 19. Under this condition, the projections for guide 31 are disengaged from aforesaid guide grooves and thereby the process cartridge 30 can be taken out in the direction toward a transfer section, namely, in the direction of arrow B.

On the other hand, each of aforesaid developing components 310 and 320 is provided with a pair of projections for guide 311 and 321 on each of front and rear sides thereof in the same way as in the process cartridge 30, so that it may be locked at the position where the projections for guide are engaged with guide grooves (not shown) provided on the carriage mentioned above.

After the process cartridge 30 is taken out, each developing component is disengaged from the carriage through the release of locking between them, and is taken out in the direction of arrow C, namely, in the same direction as for process cartridge 30.

When mounting each developing component, it is placed on the carriage first, then process cartridge 30 is set to an image forming position, and each developing component is brought into pressure contact with photoreceptor drum 10 in the direction opposite to the direction of arrow A, so that the developing component is set again to the developing position facing the photoreceptor drum 10.

Figure 20:
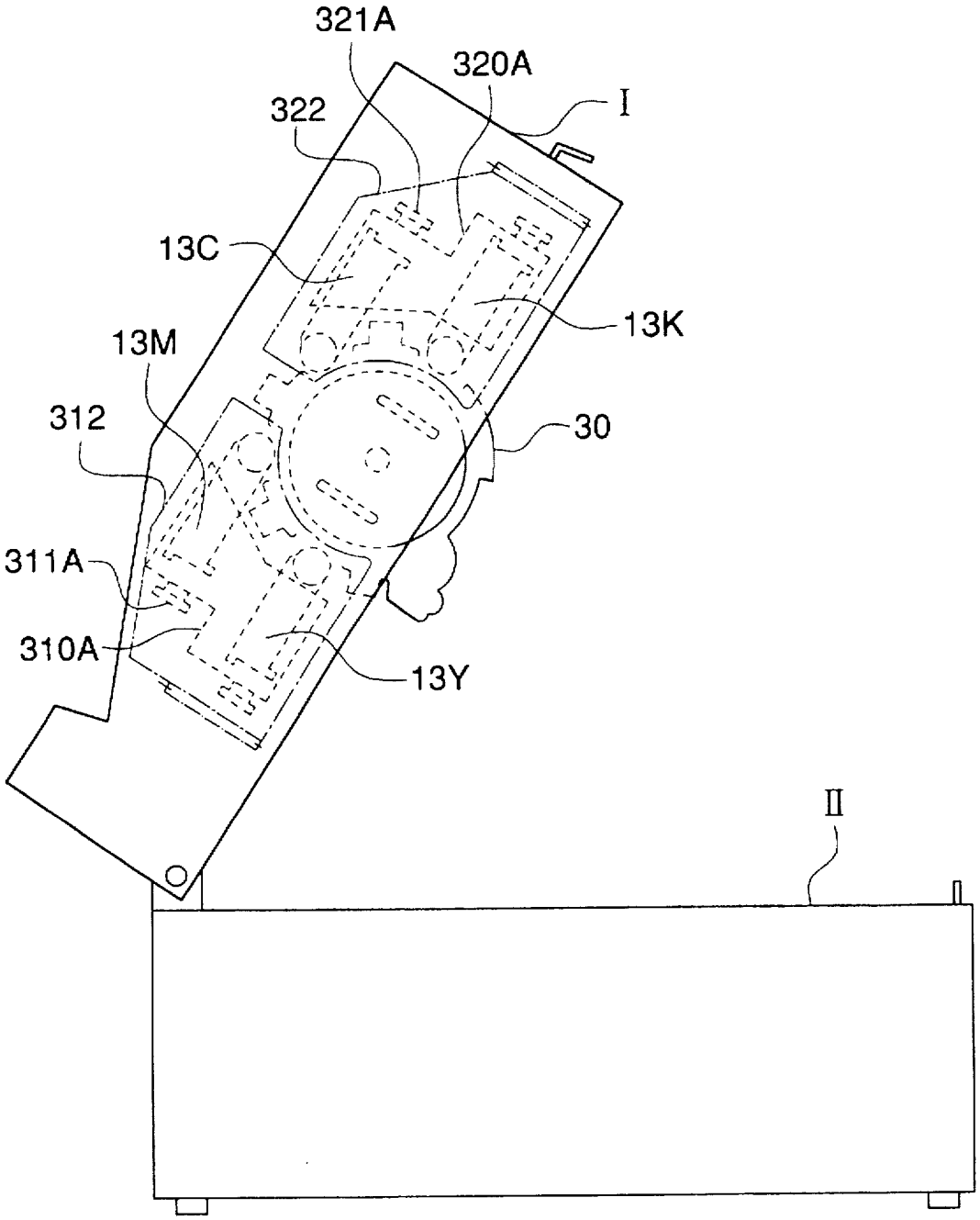
FIG. 20 is an illustration showing how developing units are mounted or dismounted.

As shown in FIG. 20, each of developing units 13Y, 13M, 13C and 13K can also be mounted or dismounted separately and independently of process cartridge 30. Namely, the developing units 13Y, 13M, 13C and 13K are housed separately in two developing components 310A and 320A each of which is inserted in a carriage (not shown) in the direction perpendicular to the page surface through a pair of guide rails 311A and 321A to be set to the developing position while being in pressure contact with photoreceptor drum 10.

Upper main body I is provided on its front side with doors of an open type 312 and 322 (each being shown with one-dot chain lines), and when the pressure contact with photoreceptor 10 is released under the condition that aforesaid doors are opened, developing components 312 and 322 can be taken out along guide rails 311A and 321A in the direction upward on the page surface without taking out process cartridge 30. Therefore, each developing unit can be subjected to maintenance independently of process cartridge 30 and the process cartridge 30 itself can also be taken out in the direction toward a transfer section after taking out developing components, in the same way as in the example shown in FIG. 19 explained earlier.

Incidentally, it is preferable that the process cartridge 30 is equipped with a light-shielding device of a sliding door type, for example, which is opened or closed automatically in the case of mounting or dismounting after the process cartridge 30 is removed from the upper main body I, for the purpose of protecting the photoreceptor surface corresponding to a transfer area of the exposed photoreceptor drum 10.

Even in the case of structure wherein the upper main body I is opened from the side opposite to the feeding side for a recording sheet, namely, from the left side of the apparatus main body, it is also possible to mount or dismount process cartridge 30 and developing units 13Y, 13M, 13C and 13K through the same constitution and procedures of operation.

Figure 21:
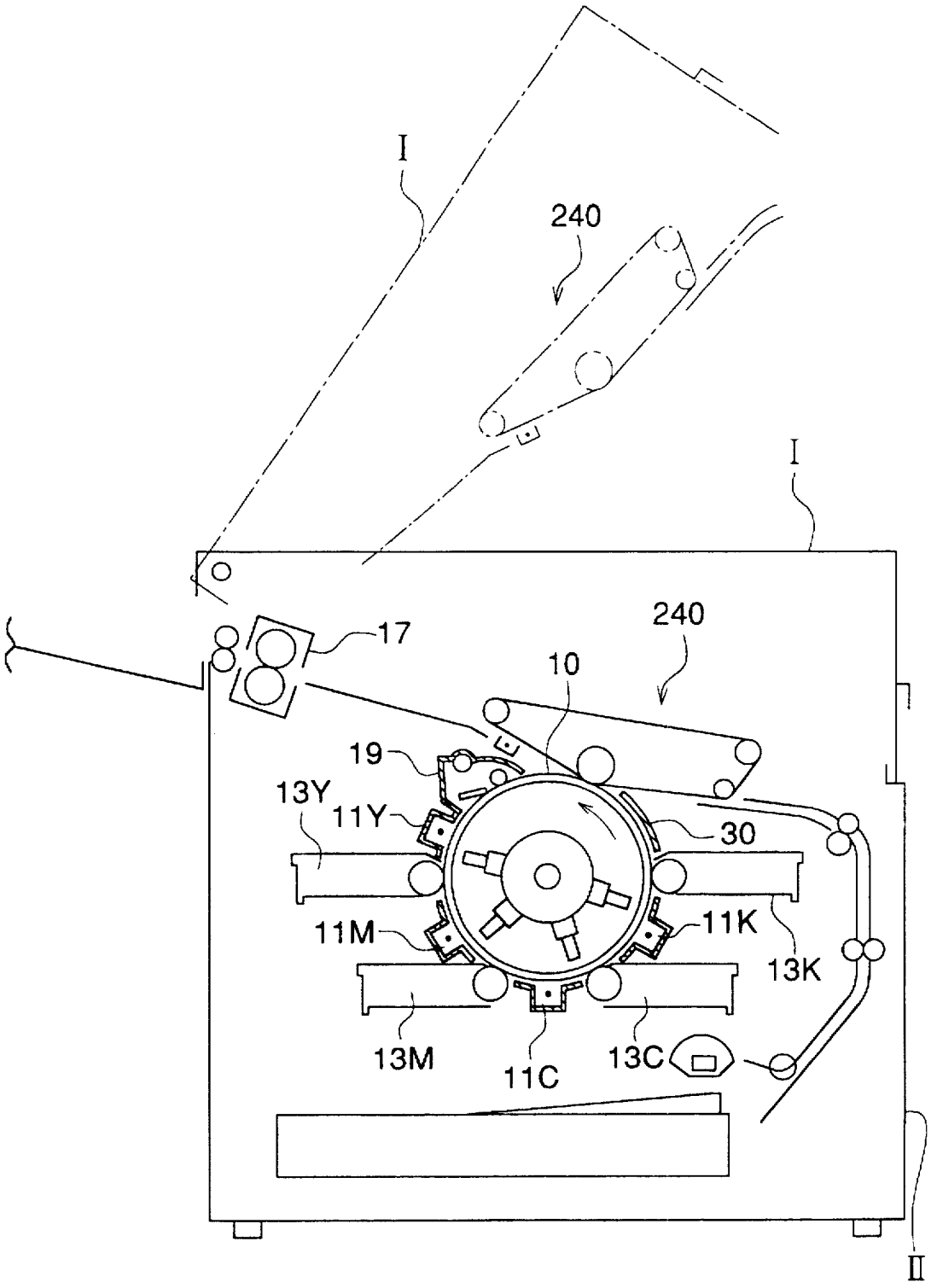
FIG. 21 is a diagram of the sectional structure showing how an apparatus is opened (second type).

In the present example, there has been explained about a color image forming apparatus wherein process cartridge 30 and developing units 13Y, 13M, 13C and 13K are housed in upper main body I. However, as shown in FIG. 21, even in the case of an apparatus of the invention wherein process cartridge 30 and developing units 13Y, 13M, 13C and 13K are housed in lower main body II and a transfer section, such as transfer belt unit 240, for example, is moved upward when upper main body I is opened, process cartridge 30 can be mounted on or dismounted from the lower main body II in the upward direction corresponding to the transfer direction, after retreating the transfer belt unit 240 through the same constitution and operations for the process cartridge 30 and developing units 13Y, 13M, 13C and 13K

Owing to the invention, there have been realized easy and quick replacement and maintenance of main components constituting an image forming section such as an image forming body and a developing unit, and it has become possible to offer a color image forming apparatus wherein functions and performance are always kept at their best conditions, and thereby images with high image quality can be recorded for a long time.

An example to accomplish the second object of the present invention will be explained as follows.

Figure 22:
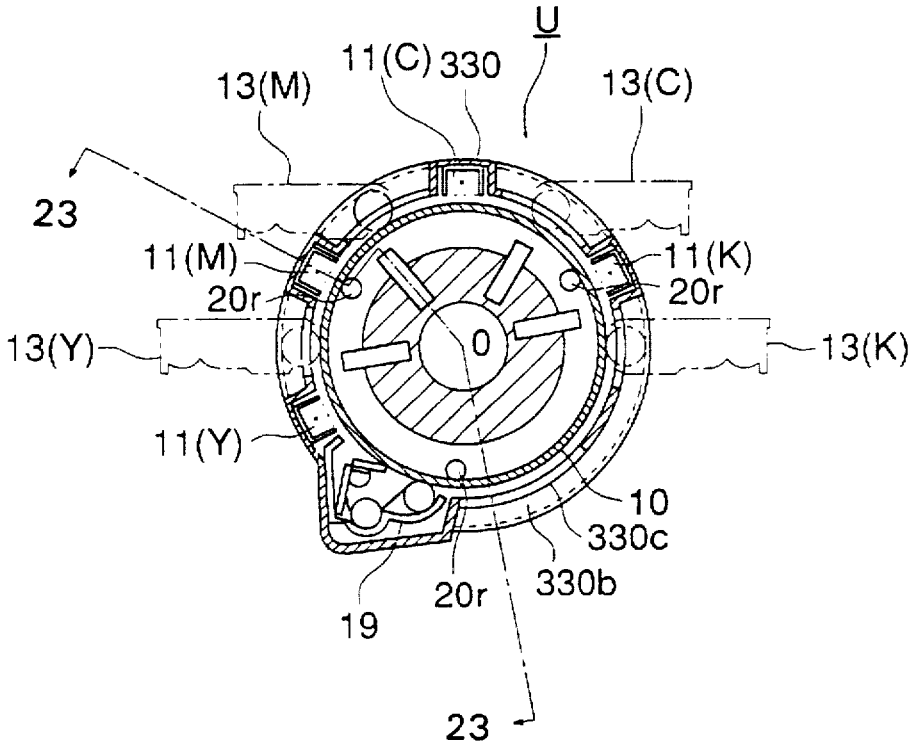
FIG. 22 is a sectional view of the photoreceptor drum taken on a line in the rotational shaft direction for explaining an example to accomplish the second object of the present invention.
Figure 23:
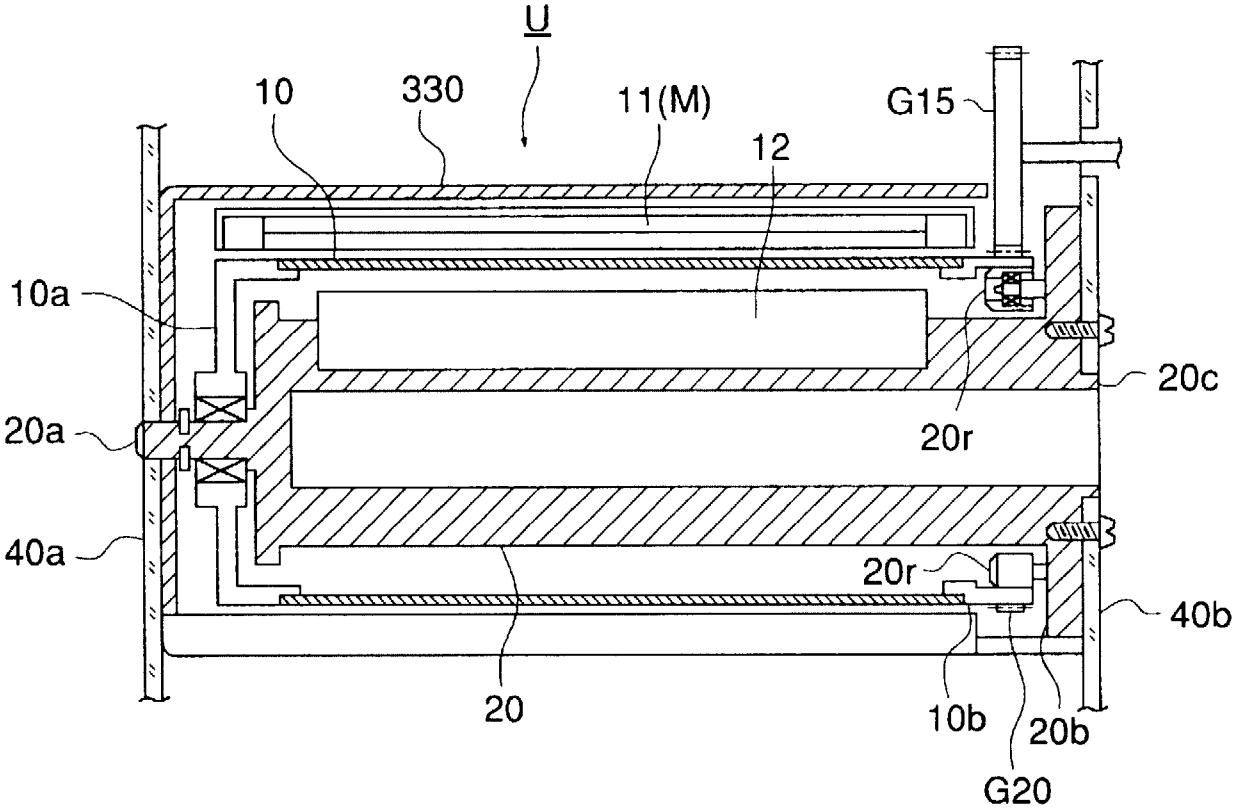
FIG. 23 is a sectional side view taken on line 23-0-23 in FIG. 22.

As illustrated in FIGS. 22 and 23, flanges 10*a*, 10*b* are integrally attached onto both sides of the photoreceptor drum 10. The flange 10*a* is supported through a bearing by a support shaft 20*a* protruding from the axial center of the support member 20. On the other hand, the flange 10*b* is rotatably supported by 3 guide rollers 20*r* arranged on the flange 20*b* of the support member 20.

The photoreceptor drum 10 and the support member 20 are accommodated in a cylindrical protective cover 330 engaged with and fixed to the support shaft 20*a* and the flange 20*b* of the support member 20, so that they are integrated into one unit U. The support shaft 20*a* protruding from the front surface is engaged with the base plate 40*a* of the apparatus body, and the engaging section 20*c* at the rear of the flange portion 20*b* is engaged with the base plate 40*b* of the apparatus body. In this way, the photoreceptor drum 10 and the support member 20 are positioned and fixed onto the base plate 40*b* side by means of screws.

As a result, the photoreceptor drum 10 and the optical exposure systems 12 (Y, M, C, K) are integrally formed into one unit U. Therefore, an image formation distance of the optical system with respect to the photosensitive layer can be always maintained constant.

In the protective cover 330, the scorotron chargers 11 (Y, M, C, K) and the cleaning unit 19 are integrally accommodated together with the photoreceptor drum 10. The inner circumferential surface between the units is formed into a curved surface 330*b*. On the curved surface 330*b*, openings are formed so that the developing units 13 (Y, M, C, K), transfer unit 14*a* and discharger 14*b* can be opposed to the photoreceptor surface through the openings 330*c*.

After the developing units 13 (Y, M, C, K), transfer unit 14*a* and discharger 14*b* have been attached to the unit U, they are set at the predetermined positions.

It is possible to extend the dimensions of the unit U so as to integrally accommodate the developing units 13 (Y, M, C, K). On the contrary, only the photoreceptor drum 10 and the optical exposure systems 12 (Y, M, C, K) may be integrated.

Simultaneously when the unit U is assembled to the apparatus body, the drum gear G20 provided on the outer circumference of the flange 10*b* of the photoreceptor drum 10 is meshed with the drum gear G15 provided on the apparatus body side, so that the photoreceptor drum 10 can be driven through the gears.

Figure 24:
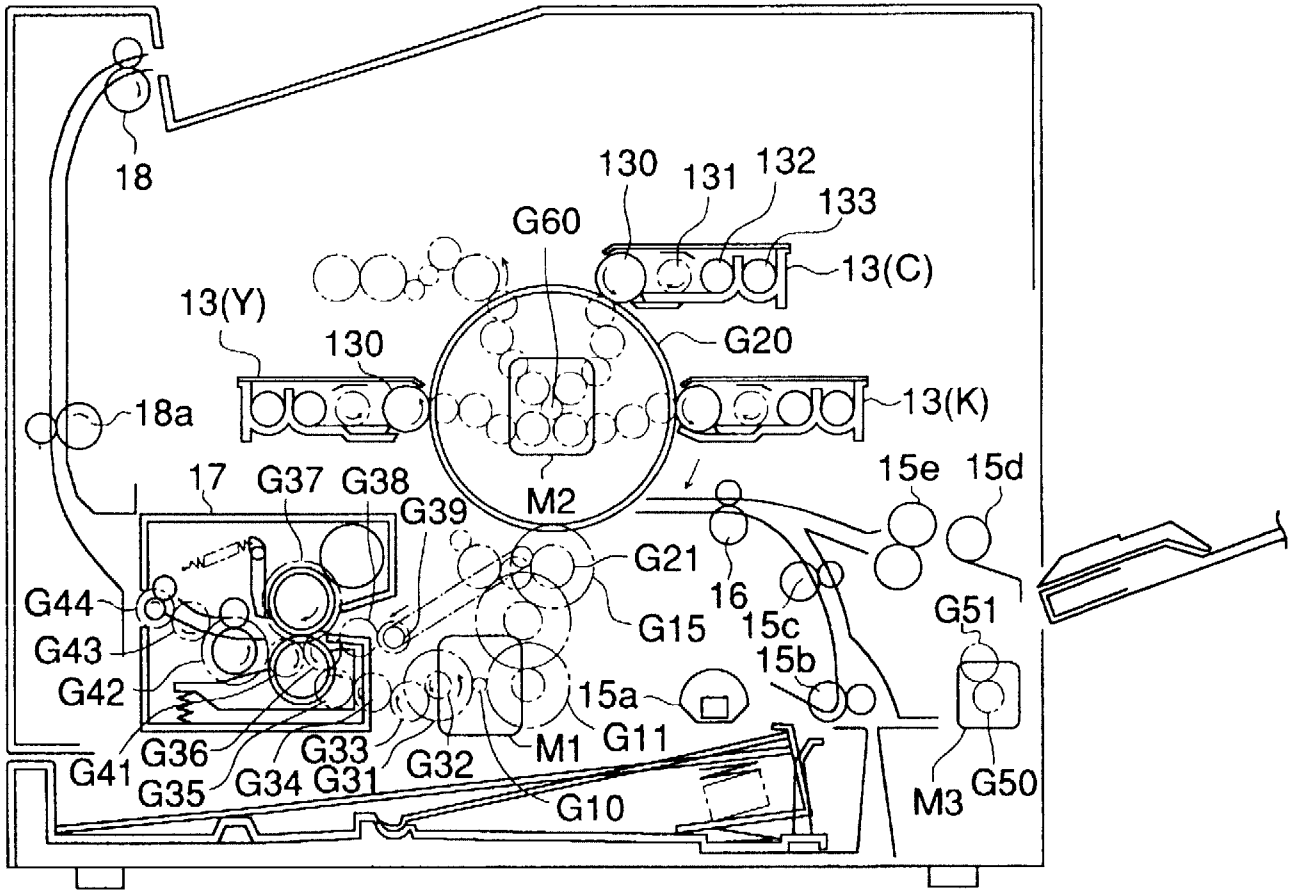
FIG. 24 is a schematic illustration of the drive system of the color image forming apparatus.
Figure 25:
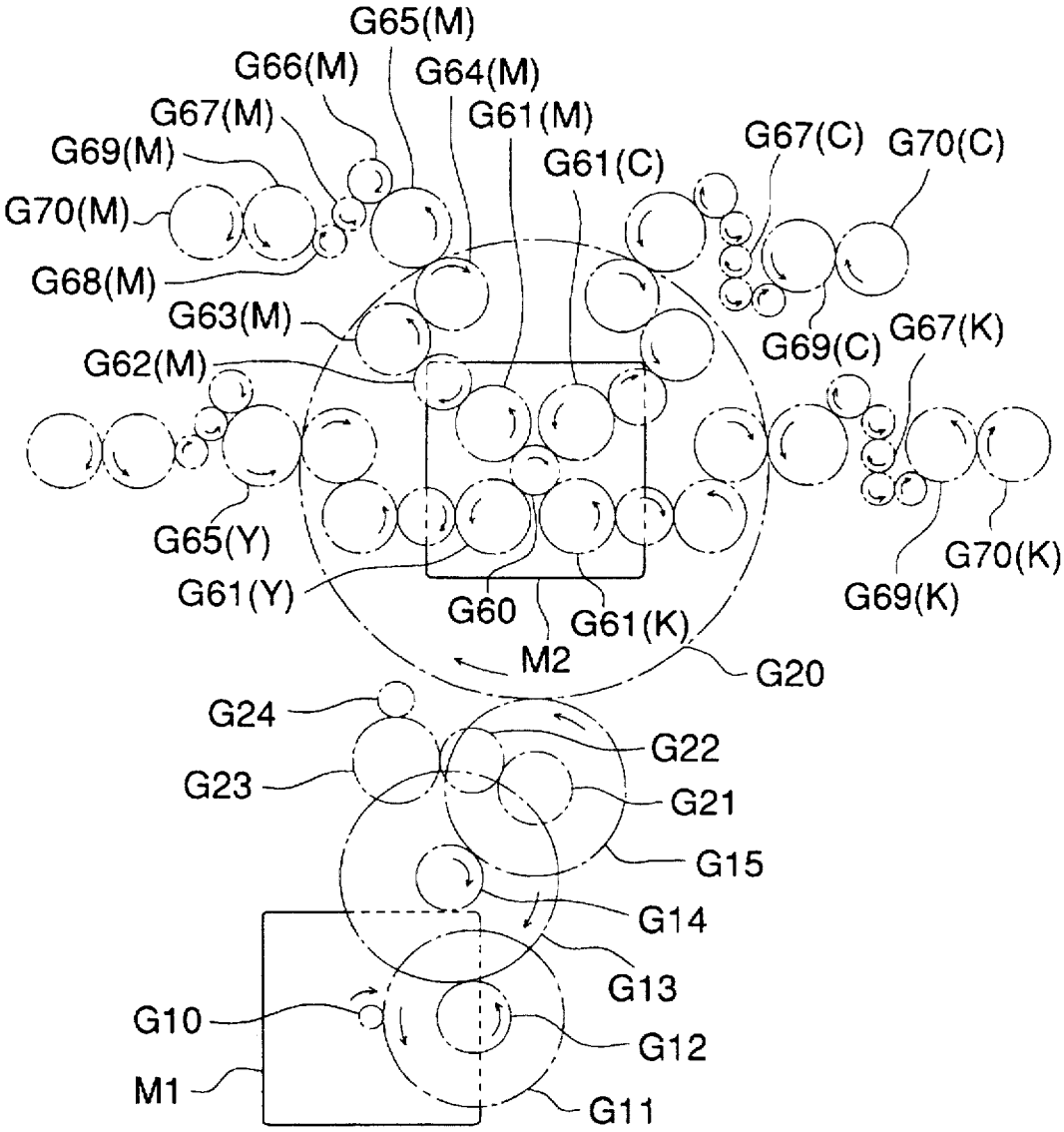
FIG. 25 is a view showing the primary portion of the drive system.

With reference to FIGS. 24 and 25, the drive system will be explained as follows. FIG. 24 is a schematic illustration of the drive system of the color image forming apparatus. FIG. 25 is a view showing the primary portion of the drive system shown in FIG. 24.

M2 is a motor for driving the developing units, and the motor is arranged at the center of the drive shaft of the photoreceptor drum 10. Gear G60 is mounted on the motor shaft and rotated clockwise. When the gear G60 is driven, gears G61, G62, G63 and G64, which are meshed the gear G60, are driven, so that gears G65 (Y, M, C, K) are rotated. Therefore, the developing sleeves 130 (Y, M, C, K) of the developing units (Y, M, C, K) arranged at the same distance from the center of the image forming body, are rotated counterclockwise as illustrated by the arrow in the drawing. When gears G65 (Y, M, C, K) are driven, the developer supply rollers 131 (Y, M, C, K) for supplying developer to the developing sleeves 130 (Y, M, C, K) are rotated by the gears G67 (Y, M, C, K) so that toner can be supplied from the bottoms of the developing units 13 (Y, M, C, K) to the developing sleeves 130 (Y, M, C, K) as illustrated in FIG. 24. Also, the stirring rollers 132 (Y, M, C, K) and 133 (Y, M, C, K) are respectively rotated by gears G69 (Y, M, C, K) and G70 (Y, M, C, K) in the direction shown by the arrow in the drawing. Motor Ml shown in FIG. 25 is a motor for driving the photoreceptor drum 10. Gear G10 mounted on the motor shaft is meshed with the successive gears G11 to G15, and gear G15 is meshed with the drum gear G20 provided on the outer circumference of the flange 10B of the photoreceptor drum 10, so that the photoreceptor drum 10 can be rotated. When gear G21 mounted on the same shaft as that of drive gear G15 is driven, gears G22 to G24 are driven, so that the toner conveyance screw 19*b* of the cleaning unit 19 is driven by gear G24. As illustrated in FIG. 24, motor M1 for driving the drum drives gear G37 for driving the fixing roller of the fixing unit 17 through gears G31 to G34 meshed with gear G10. Also, motor M1 for driving the drum drives the pressure roller 17*b* through a pressure roller drive gear not shown in the drawing. Further, a pair of pulling rollers 17*c* are driven by gear G42 meshed with gear G34, so that a pair of fixing delivery rollers 17*d* are driven by gear G44. By gear G44, a pair of discharge sheet conveyance rollers 18*a* and a pair of discharge sheet rollers 18 are driven by gear G44 through belts and gears not shown in the drawing. When gear G34 is driven, the conveyance drive roller 14*c* is driven by gear G39, so that the conveyance belt 14e provided between the idle rollers 14d can be driven. M3 shown in FIG. 24 is a motor for driving the sheet feed system. When the fixed gear G50 is driven, a roller 15a for feeding transfer sheets from the sheet feed cassette 15, a pair of conveyance rollers 15b, 15b, a timing roller 16, a roller 15d for manually feeding transfer sheets from the manual feed sheet tray 210, and a pair of conveyance rollers 15e are driven through a drive system composed of gears and belts not shown in the drawing. In the above drive system, when necessary, a spring clutch or one way clutch is used.

Figure 26:
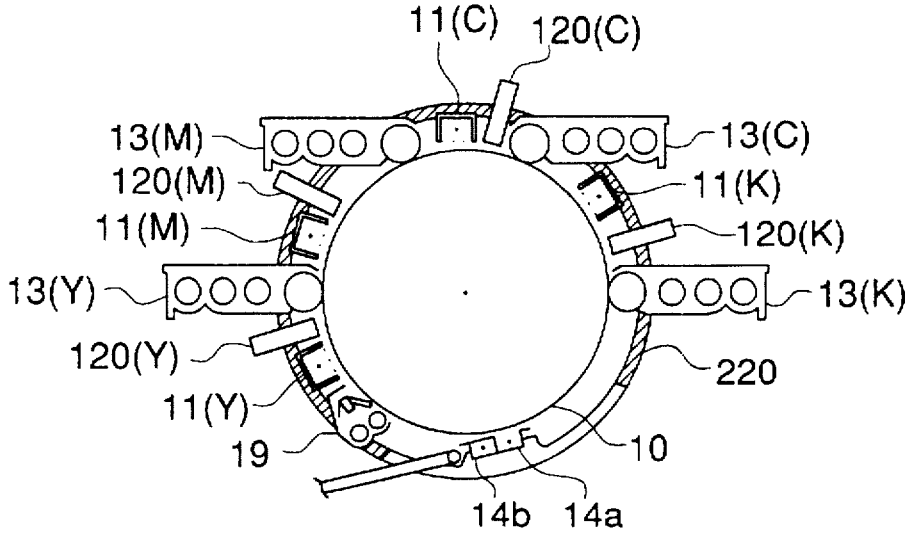
FIG. 26 is a view showing another example of the arrangement of the optical exposure system.

FIG. 26 is an arrangement view showing another example of the optical image exposure system. Optical exposure systems 120 (Y, M, C, K) are arranged outside the photoreceptor drum 10. The optical exposure systems 120 (Y, M, C, K) are attached to a support member 220 fixed to an apparatus body not shown in the drawing so that the photoreceptor drum 10 in the same manner as the example described before. In this case, the process and function of color image formation are the same as those explained in FIG. 1. Therefore, like reference characters are used to indicate like parts in the views.

Figure 27:
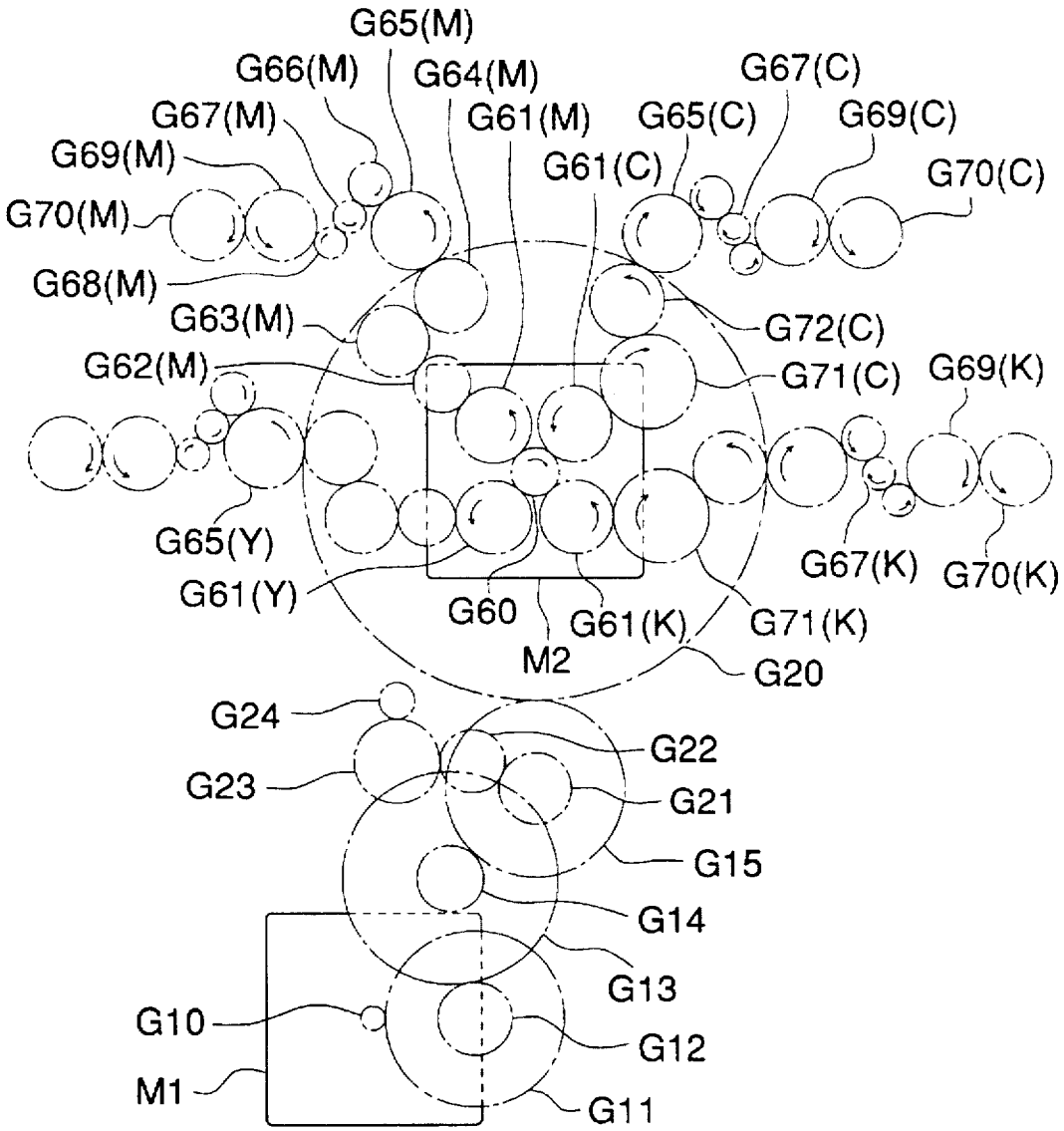
FIG. 27 is a view showing another example of the primary portion of the drive system.

In the above example including the apparatus illustrated in FIG. 25, when the development drive motor M2 is driven, all developing sleeves 130 (Y, M, C, K) of the developing units 13 (Y, M, C, K) are rotated in the same direction, that is, they are rotated counterclockwise. However, as illustrated in FIG. 27 which shows another example of the drive system, it is possible to rotate the developing sleeves 130 (Y, M) of the developing units 13 (Y, M) in the opposite direction to that of the developing sleeves 130 (C, B) of the developing units 13 (C, B), wherein the developing units 13 (Y, M) are arranged symmetrically to the developing units 13 (C, B) with respect to the photoreceptor drum 10. Due to the foregoing, it is possible to make the structure of the developing units 13 (Y, M) to be the same as that of the developing units 13 (C, B).

Figure 28:
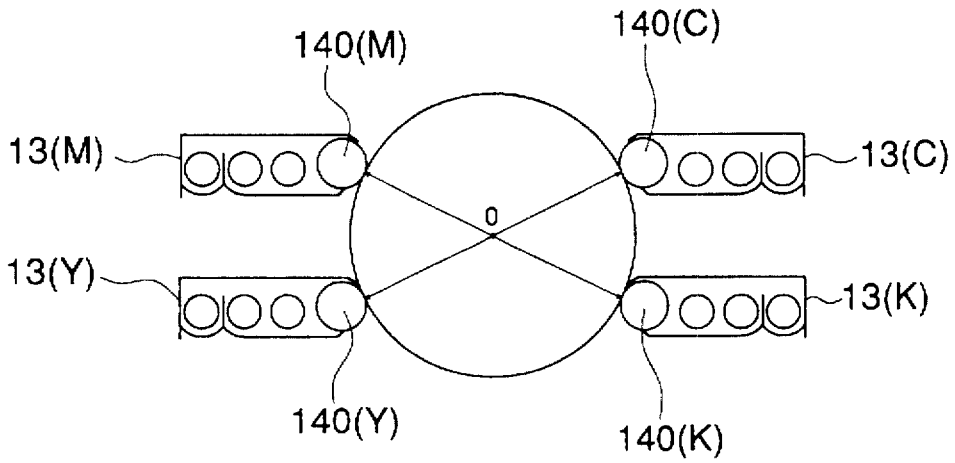
FIG. 28 is a preferable arrangement view of the developing units.

FIG. 28 is an arrangement view showing a preferable arrangement of the developing units. As shown in FIG. 28, the developing sleeves 130(Y) and 130 (C) are arranged on a diagonal line passing through the center O of the photoreceptor drum 10, and also the developing sleeves 130(M) and 130 (K) are arranged on a diagonal line passing through the center O of the photoreceptor drum 10. In the above arrangement, the collision rollers 140 (Y, M, C, K) come into contact with the photoreceptor drum 10 by the same pushing force. Therefore, the photoreceptor drum 10 can be uniformly rotated.

According to the present invention, in the color image forming apparatus in which a charger and plural sets of image exposure means and developing units are arranged in the moving direction of the image forming body, the image exposure means are arranged in the common support body on a concentric circle, and the gear integrated with the image forming body is meshed with the drive gear connected with the drive source arranged outside the image forming body, and further the developing units are operated being meshed with the drive gear of the drive source arranged at the center of the image forming body. Therefore, the drive system is simple and compact, and the image forming body and the developing sleeves are smoothly rotated without causing the fluctuation of rotation. Further, the plurality of developing units are contacted with the image forming body with the same pushing force through the collision rollers. Therefore, the fluctuation of rotation of the image forming body can be reduced. Accordingly, the accuracy of superimposed images can be enhanced. As a result, it is possible to provide a color image forming apparatus in which image resolution is enhanced so that images of high quality can be formed.

An image forming process and each mechanism of examples 1 to 3 of a color image forming apparatus for attaining the third object of the invention will be explained as follows.

EXAMPLE 1

Figure 1:
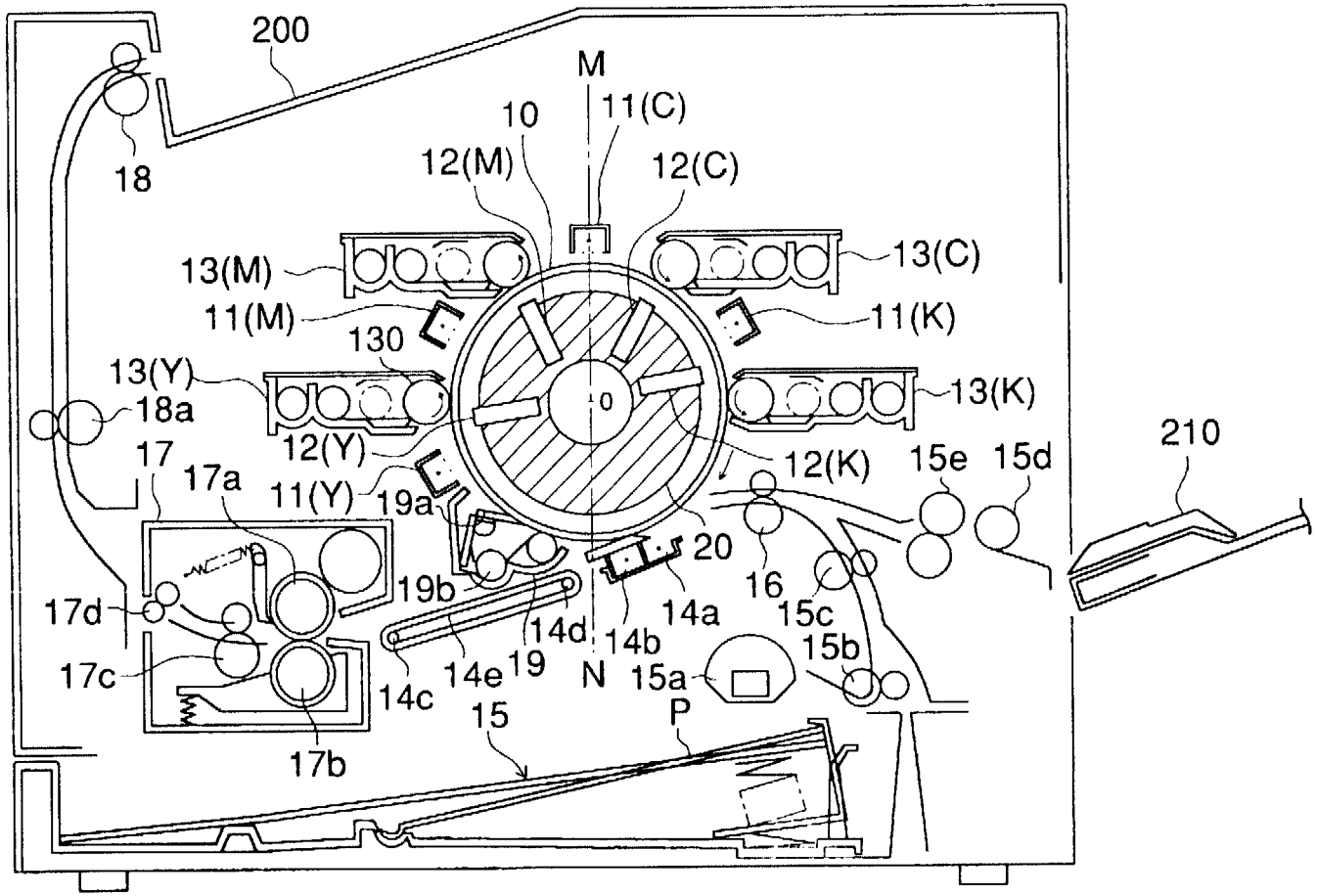
FIG. 1 is a sectional view showing the construction of the color image forming apparatus of the present invention.
Figure 2:
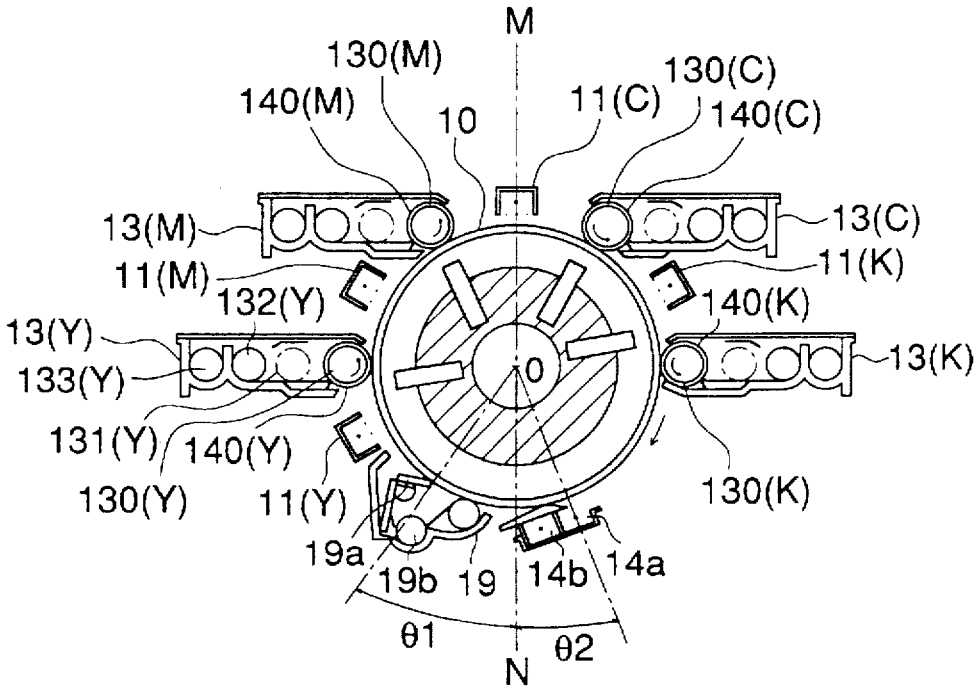
FIG. 2 is a view showing the primary portion of the apparatus described above.
Figure 29:
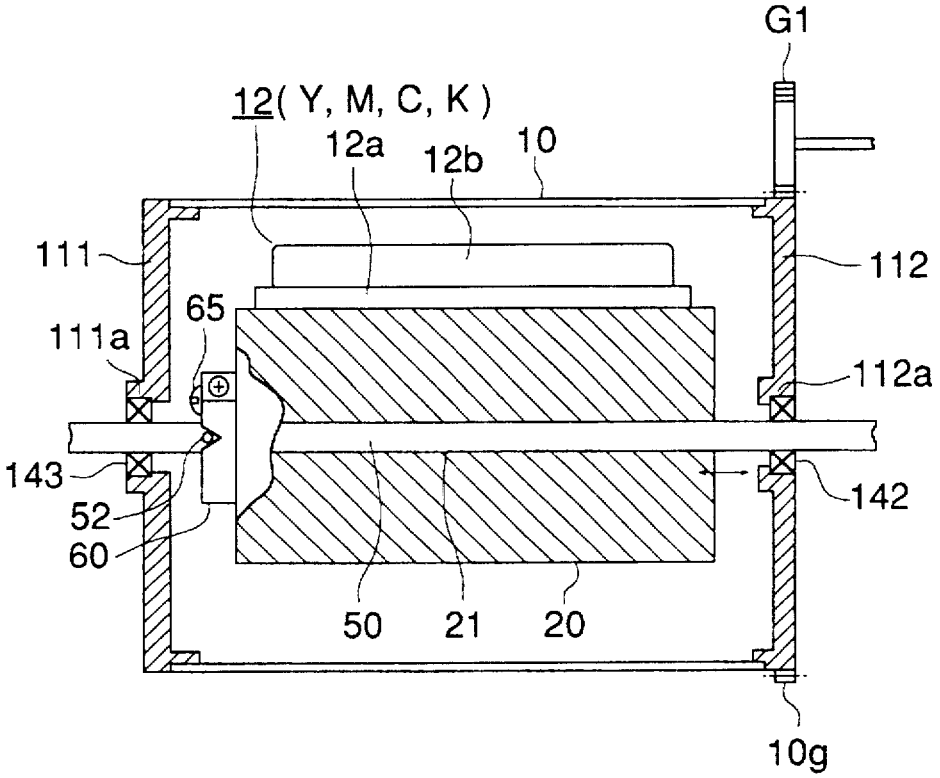
FIG. 29 is a diagram showing a section of primary portions of an image forming body shown in FIG. 1 for attaining the third object.
Figure 30:
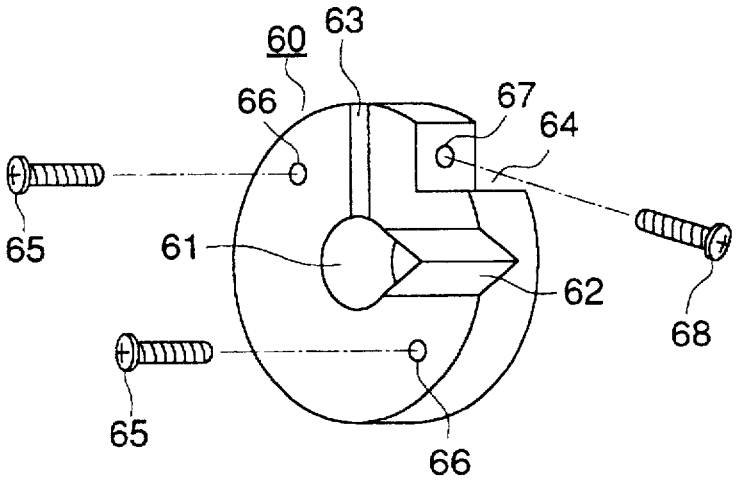
FIG. 30 is a diagram showing a positioning member for a holding member for exposure optical systems.

Referring to FIGS. 1, 29 and 30. FIG. 29 is a diagram showing sections of primary portions in FIG. 1, and FIG. 30 is a diagram showing a positioning member of a holding member for an exposure optical system.

In FIG. 29, supporting shaft 50 is inserted in ring-shaped positioning member 60 through its hole 61 and in cylindrical holding member 20 on which exposure optical systems 12Y, 12M, 12C and 12K are fixed through its through-hole 21. As shown in FIG. 30, the positioning member 60 is screwed on the holding member 20 to be fixed and united therewith by screw 65 that goes through hole 66.

Under the condition that positioning pin 52 provided on supporting shaft 50 is engaged with prismatic cut-out portion 62 provided on positioning member 60, screw 68 is screwed in an unillustrated female screw provided on the left side of slit 63 in FIG. 30 on holding member 60 through the hole 67 provided on cut-out portion 64, thus, the slit 63 is narrowed and thereby central hole 61 squeezes the supporting shaft 50, so that the positioning member 60 united with holding member 20 for exposure optical systems 12Y, 12M, 12C and 12K is fixed on the supporting shaft 50.

As shown in FIG. 29, photoreceptor drum 10 is inserted under the condition that it contains therein exposure optical systems 12Y, 12M, 12C and 12K all fixed on supporting shaft 50, then, front flange 111 wherein bearing 143 is press-fitted in receiving portion 111a on the front flange and rear flange 112 wherein bearing 142 is press-fitted in receiving portion 112a on the rear flange are inserted in photoreceptor drum 10 while the bearing 143 and bearing 142 are press-fitted on supporting shaft from left and right respectively, thus, the photoreceptor drum 10 is mounted on the supporting shaft 50 rotatably.

The supporting shaft 50 is fixed on the front plate and rear plate of the apparatus main body with the apparatus main body and the exposure optical systems 12Y, 12M, 12C and 12K positioned each other, and gear 10 g provided on rear flange 112 of photoreceptor drum 10 and gear GI connected with an unillustrated driving motor for a photoreceptor drum provided on the apparatus main body are engaged each other, so that the photoreceptor drum 10 is driven.

The holding member 20 is fixed at one end of supporting shaft 50 by positioning member 60 for the holding member 20, and even when the holding member 20 for the exposure optical systems 12Y, 12M, 12C and 12K is subjected to thermal expansion by heat generated from exposure element 12a that emits exposure light, the holding member 20 can be moved in the axial direction of the supporting shaft 50 shown with an arrow in FIG. 29 with the other end as a free end, for the supporting shaft 50. Therefore, deformation of the exposure optical systems 12Y, 12M, 12C and 12K caused by a difference of thermal expansion between the holding member 20 for the exposure optical systems 12Y, 12M, 12C and 12K and the supporting shaft 50 can be prevented.

EXAMPLE 2

Figure 31:
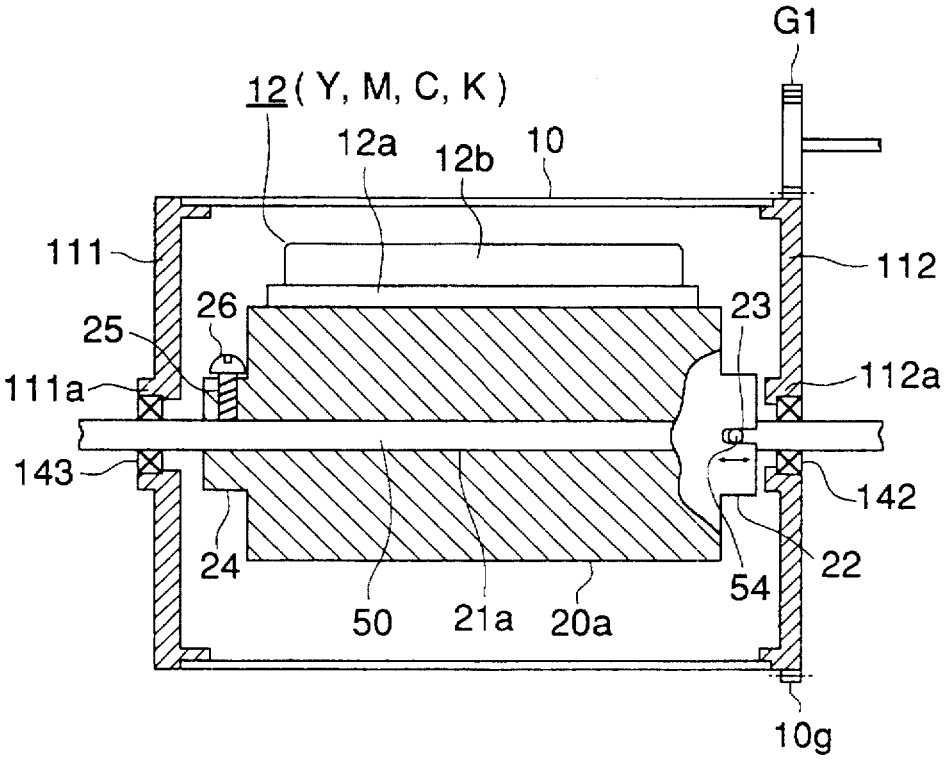
FIG. 31 is a diagram showing primary portions of an image forming body in the second example for a method of connection between a holding member for exposure optical systems and a supporting shaft.

FIG. 31 shows primary portions of an image forming body with a second example of how to fix a holding member for exposure optical systems on a supporting shaft. This example also employs the same image forming process and mechanism as those explained in aforesaid Example 1. Members having the same functions and structure as those in Example 1 mentioned above are given the same symbols.

Holding member 20*a* on which exposure optical systems 12Y, 12M, 12C and 12K are provided is a cylindrical member provided on its right and left with step portions 22 and 24, and it is fitted on supporting shaft 50 through the through hole 21*a* provided at the center of the holding member 20*a*. Pin 54 provided on supporting shaft 50 is engaged with groove 23 provided on a step portion 22 on the right side of holding member 20*a* in FIG. 31, and screw 26 is screwed in female screw 25 provided on step portion 24 on the left side of the holding member 20*a* in FIG. 31 until the screw 26 hits the supporting shaft 50, thus, the holding member 20*a* is fixed on the supporting shaft 50.

The holding member 20 is fixed at one end of supporting shaft 50 by screw 26, and even when the holding member 20*a* for the exposure optical systems 12 is subjected to thermal expansion by heat generated from exposure element 12*a* that emits exposure light, the holding member 20 is expanded and contracted with groove 23 as a guide in the axial direction of the supporting shaft 50 shown with an arrow in FIG. 31 with the other end as a free end, for the supporting shaft 50. Therefore, deformation of the exposure optical systems 12Y, 12M, 12C and 12K caused by a difference of thermal expansion between the holding member 20 a for the expansion systems 12Y, 1systems 12Y, 12M, 12C and 12K and the supporting shaft 50 can be prevented.

Figure 32:
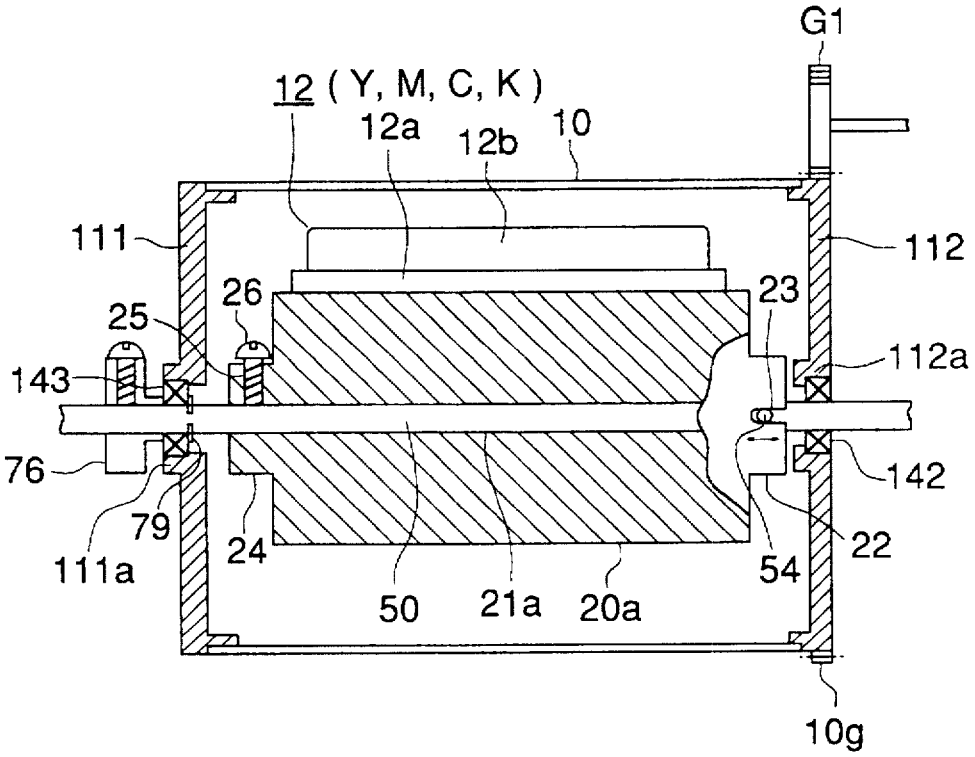
FIG. 32 is a diagram showing how a photoreceptor drum is fixed on a supporting shaft.

Further, a method of fitting a photoreceptor drum on a supporting shaft is shown in FIG. 32 wherein an internal ring portion of bearing 143 that is press-fitted in receiving portion 111*a* of front flange 111 of photoreceptor drum 10 is fixed through E-ring 79 and screw-setting by means of fitting member 76, and fitting of bearing 142 on the other end on supporting shaft 50 is made to be clearance-fitting.

Photoreceptor drum 10 is fixed at one end of supporting shaft 50 by E-ring 79 and fitting member 76, and even when the photoreceptor drum 10 is subjected to thermal expansion by heat generated from exposure element 12*a* that emits exposure light, the photoreceptor drum 10 is expanded and contracted in the axial direction of the supporting shaft 50 shown with an arrow in FIG. 32 with the other end as a free end, for the supporting shaft 50. Therefore, deformation of the photoreceptor drum 10 caused by a difference of thermal expansion between the photoreceptor drum 10 and the supporting shaft 50 can be prevented. The same constitution is employed in the aforementioned example.

EXAMPLE 3

FIGS. 33(*a*)–33(*b*) show a method of connection between an exposure element of an exposure optical system and a fixing member for the exposure element. This example also employs the same image forming process and mechanism as those explained in aforesaid example. Members having the same functions and structure as those in Example 1 mentioned above are given the same symbols.

Each of exposure optical systems 12Y, 12M, 12C and 12K representing an imagewise exposure means for each color is structured to be a unit composed of exposure-light-emitting exposure element 12*a* such as a linear exposure element wherein light-emitting elements such as FL (phosphor luminescence), EL (electro-luminescence), PL (plasma-discharge luminescence) and LED (light emitting diode) all standing in line in the axial direction of photoreceptor drum 10 are arranged in a form of an array, or a linear exposure element wherein elements having light-shutter function such as LISA (photo-electro-magnetic effect light shutter array), PLZT (transmittable piezoelectric element shutter array) or LCS (liquid crystal shutter) are arrayed, and of SELFOC lens 12*b* serving as life-size image forming element, and it is contained in casing 121*b* to be fixed on holding member 20 that holds exposure optical systems, and is enveloped in photoreceptor drum 10 as explained in aforesaid Examples 1 and 2.

As base plate 121*a* for linear exposure element 12*a* wherein exposure optical systems 12Y, 12M, 12C and 12K are arrayed, such as for LED, for example, there is used glass or ceramics. Base plate 121*a* of exposure element 12*a* is attached directly on the bottom surface of casing 121*b* or on a fixing member of holding member 20. When attaching it, its one end is fixed through gluing shown as a hatched portion in FIG. 33(*b*) or through screwing, and the other end is made to be a free end guided by guide portions 121*c* and 121*d* representing a guide member that restricts skewing of the base plate in the direction perpendicular to the center axis of a photoreceptor drum. As a guide member, projections such as pins and rails, or grooves are used.

Base plate 121*a* of exposure element 12*a* is fixed with its one end on a bottom of casing 121*b* that is a fixing member for the base plate 121*a* and on holding member 20 which is a fixing member, and even when the base plate 121*a* is subjected to thermal expansion by heat generated from exposure element 12*a*, the base plate 121*a* of exposure element 12*a* is expanded and contracted by guide portions 121*c* and 121*d* serving as a guide member in the direction of an array of linear exposure elements of linear exposure element 12*a* shown with an arrow in FIG. 33(*b*) with the other end as a free end, for the casing 121*b* and holding member 20. Therefore, deformation of the exposure element 12*a* caused by a difference of thermal expansion between the base plate 121*a* of exposure element 12*a* and the casing 121*b* can be prevented.

Even in the case of connection between casing 121*b* of exposure element 12*a* and holding member 20, one end of the casing 121*b* is fixed as in the above case, and the other end is made a free end guided by a guide member that regulates in the direction perpendicular to the center axis of an unillustrated photoreceptor drum. Therefore, even when the casing 121*b* is subjected to thermal expansion by heat generated by exposure element 12*a*, the casing 121*b* that is a fixing member of the exposure element 12*a* extends or shrinks in the arraying direction of linear exposure element 12*a*. Thereby, deformation of the exposure element 12*a* caused by a difference of thermal expansion between the casing 121*b* and holding member 20 can be prevented. As a guide member, projections such as pins and rails, or grooves are used. The present example can naturally be applied to all examples mentioned above.

According to the invention, one end of a holding member is fixed on a supporting shaft, and even when the holding member for exposure optical systems is subjected to thermal expansion by heat generated by an exposure element, the holding member is extended or shrunk with its other end serving as a free end in the axial direction of the supporting shaft. Therefore, deformation of the exposure optical systems caused by a difference of thermal expansion between the holding member for exposure optical systems and the supporting shaft can be prevented.

Furthermore, one end of a photoreceptor drum is fixed on a supporting shaft, and even when the photoreceptor drum is subjected to thermal expansion by heat generated by exposure elements, the photoreceptor drum is extended or shrunk with its other end serving as a free end in the axial direction of the supporting shaft. Therefore, deformation of the photoreceptor drum caused by a difference of thermal expansion between the photoreceptor drum and the supporting shaft can be prevented.

Moreover, one end of an exposure element is fixed on a fixing member for the exposure element, and even when the exposure element is subjected to thermal expansion caused by the exposure element, the exposure element is extended or shrunk wit its other end serving as a free end in the arraying direction of linear light-emitting elements of the exposure element. Therefore, deformation of the exposure element caused by a difference of thermal expansion between the exposure element and a casing or a holding member can be prevented.

Examples for attaining the fourth object of the invention will be explained as follows, referring to FIGS. 34–52.

Figure 34:
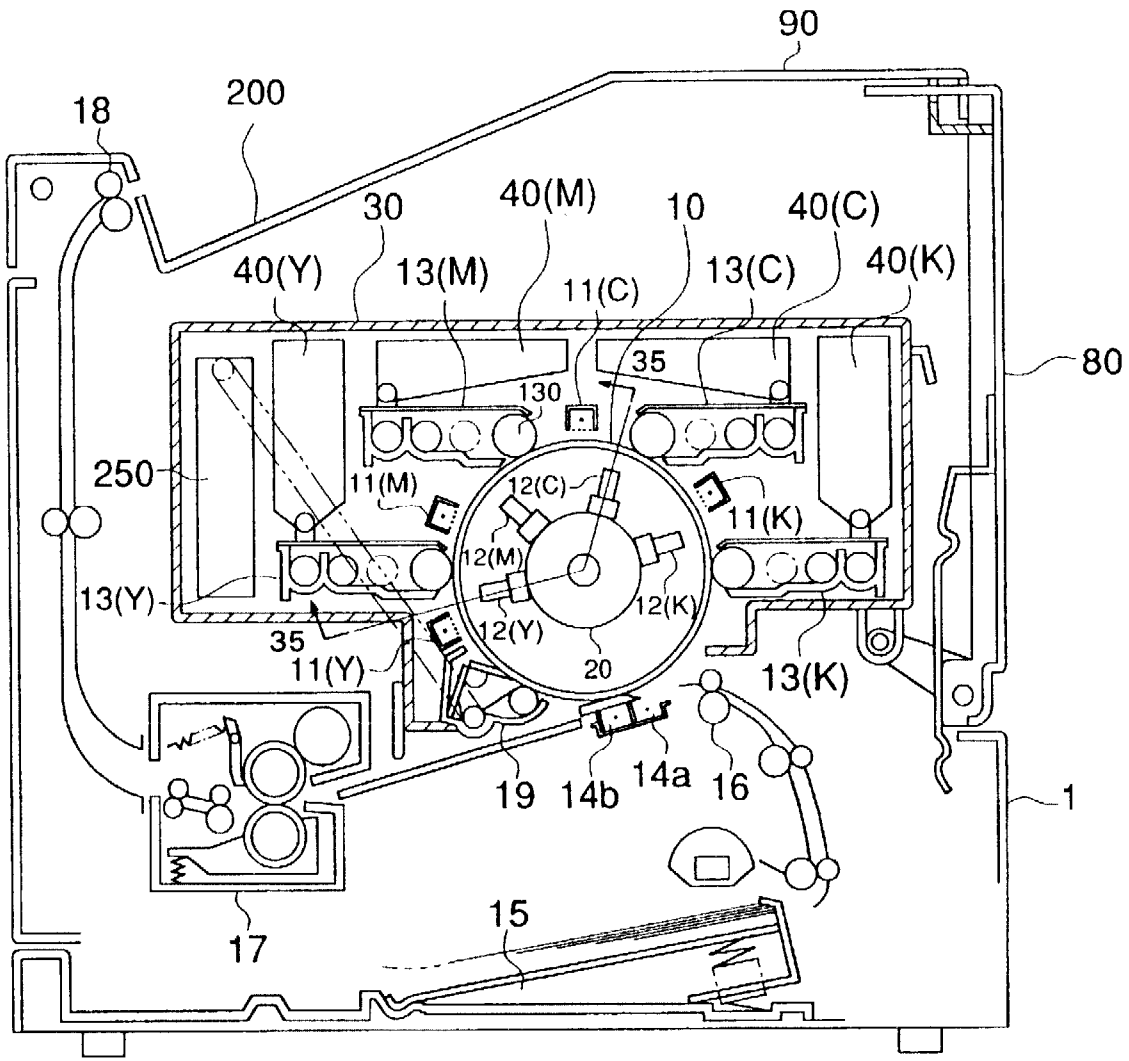
FIG. 34 is a cross-sectional structural diagram of an example showing a color image forming apparatus for attaining the fourth object wherein a unit of the invention is incorporated.

FIG. 34 is a cross-sectional view of the structure of an example showing a color image forming apparatus in which a unit of the invention is incorporated. An image forming body in this case is a drum-shaped image forming body, namely, photoreceptor drum 10 wherein an organic photoconductor layer (OPC) composed of a transparent conductive layer is provided through coating on the outer circumferential surface of a base body made of transparent material such as optical glass or transparent acrylic resin, and it is rotated clockwise while it is grounded.

Aforesaid photoreceptor drum 10 is housed in process cartridge 30 together with charging units 11Y, 1M, 11C and 11K, developing units 13Y, 13M, 13C and 13K, cleaning unit 19, toner containers 40Y, 40M, 40C and 40K each supplying toner respectively to aforesaid developing units 13Y, 13M, 13C and 13K, and with waste toner container 250 in which the toner collected by the cleaning unit 19 is contained. Therefore, it can be drawn out of the apparatus main body and moved horizontally together with others, for example, and can further be taken out of the apparatus main body.

Incidentally, the process cartridge is one containing a unit having therein an image forming body and imagewise exposure means, and it can also contain aforesaid charging unit and cleaning unit as well as a part of developing units.

Next, examples 1–5 will be explained concretely as follows.

Figure 35:
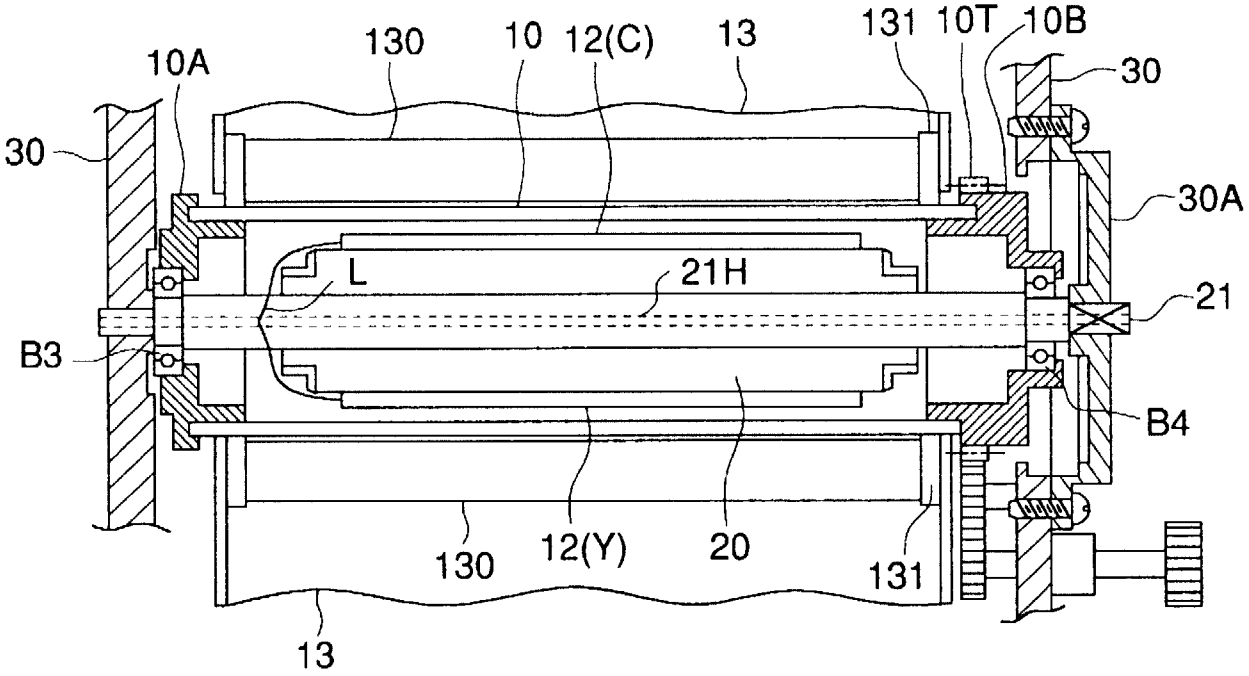
FIG. 35 is a sectional view in the axial direction taken along line 35-0-35 in FIG. 34, of an example showing how a unit wherein a photoreceptor drum and exposure optical systems are incorporated is structured.

FIG. 35 shows section A—A in FIG. 34, and photoreceptor drum 10 is fitted concentrically with flange member 10A at the front end to be fixed, while the flange member 10A supports concentrically an intermediate portion near the end of fixing shaft member 21 of supporting member 20 for exposure optical systems 12Y, 12M, 12C and 12K representing imagewise exposure means through bearing B3, and further, the end of the fixing shaft member 21 is fitted concentrically in a fixing hole on the wall of aforesaid process cartridge 30 to be supported directly. Flange member 10B at the rear end supports concentrically an intermediate portion near an end on the opposite side of the fixing shaft member 21 through bearing B4. Under this condition, the end on the opposite side of the fixing shaft member 21 is fixed to be supported in a concentric fitting hole located at the center of disk member 30A capable of being mounted on or dismounted from the process cartridge 30. The assembling structure for this portion is example 2.

Figure 36:
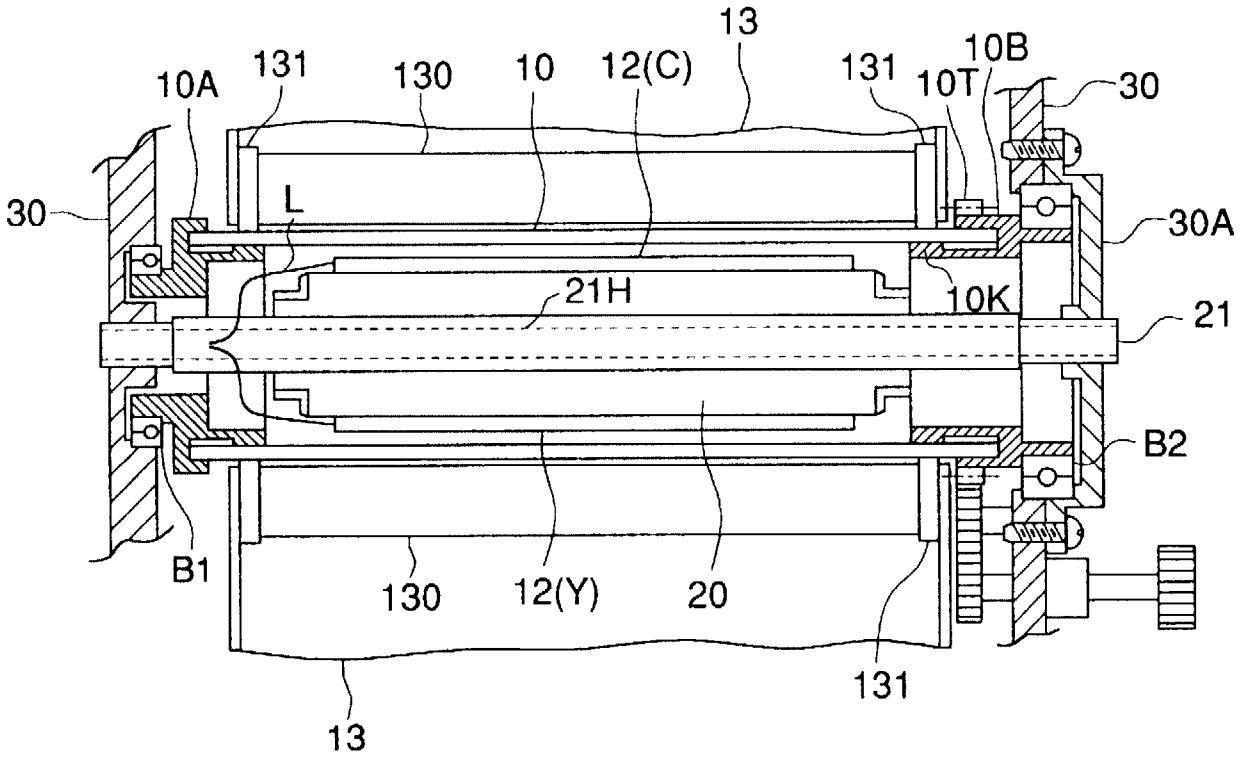
FIG. 36 is a sectional view in the axial direction of an example showing how a unit wherein a photoreceptor drum and exposure optical systems are incorporated is structured.

On the other hand, what is shown in FIG. 36 is also one showing a sectional view taken on line A—A in another example, wherein aforesaid exposure optical systems 12Y, 12M, 12C and 12K are engaged with and supported by a hole on the wall of process cartridge 30 concentrically and directly with a front end and a rear end of shaft member 21 piercing and supporting aforesaid supporting member 20 being not supported by flange members 10A and 10B, differently from the foregoing. In this case, the rear end portion interfits with a hole located at the center of aforesaid disk member 30A and is supported thereby to be regulated in terms of rotation.

In this case, the front flange member 10A and the rear flange member 10B are subjected to press-fitting concentrically with both ends of photoreceptor drum 10 and are supported therein so that they do not come in contact with aforesaid shaft member. The front flange member 10A is arranged to be rotatable through concentric bearing Al located between the wall of process cartridge 30 and the front flange member. The rear flange member 10B on the opposite side is arranged similarly to be rotatable through bearing B2 inserted concentrically in a bearing box formed by the rear wall of aforesaid process cartridge 30 and by aforesaid disk member 30A.

Accordingly, in the one with a type shown by either FIG. 35 or FIG. 36, photoreceptor drum 10 and exposure optical systems 12Y, 12M, 12C and 12K can be taken out of the rear side of process cartridge 30 as a unit easily by removing aforesaid disk member 30A.

Further, a driving member that rotates an image forming body is provided either on flange member 10A or on flange member 10B. In this particular case, driving gear 10T is provided on the flange member 10B as a driving member to be concentric and solid with the flange. In addition to this, it is also possible to provide a driving member having irregularity to be concentric and solid with a flange when an image forming body is rotated by a timing belt. The foregoing indicates example 1.

In example 3 of the invention, it is so arranged that both ends of photoreceptor drum 10 shown in a partial cross section showing arrangement of the surrounding of a photoreceptor drum in FIGS. 35 and 36 are caused by flange members 10A and 10B to rotate concentrically, uniformly and correctly without any eccentricity, and assembling and adjustment thereof can be carried out under the simple state.

Namely, photoreceptor drum 10 is highly accurate in terms of its outside diameter because it is plastic-molded through a centrifugal polymerization method, except an occasion where the photoreceptor drum is made of glass. Therefore, when photoreceptor drum 10 is interfitted in flange members 10A and 10B with its outside diameter serving as a reference for interfitting, it is relatively easy to attain a highly accurate combination wherein eccentricity is hardly caused.

Figure 37:
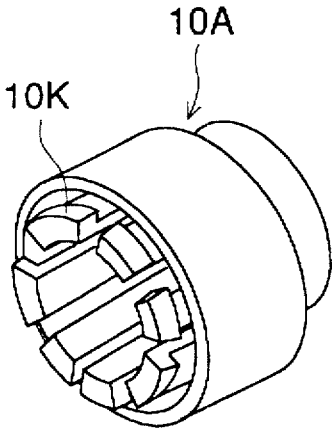
FIG. 37 is a perspective view showing an example of a flange member.
Figure 38:
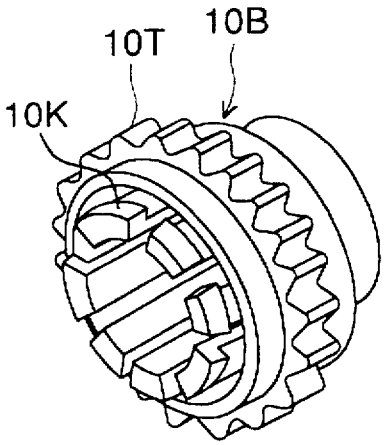
FIG. 38 is a perspective view showing an example of a flange member.

In addition to the foregoing, outside diameter portions of photoreceptor drum 10 are subjected to slight press-fitting with flange members 10A and 10B as shown in FIGS. 37 and 38, and pressure member 10K is formed to be solid with the flange members 10A and 10B so that the pressure member 10K may come, from the inside of the flange members 10A and 10B, in contact elastically with a point on an inner surface of photoreceptor drum 10 corresponding to the place where stopper roller 131 comes in contact with an outer surface of photoreceptor drum 10. Driving gear 10T is provided concentrically and solidly with the flange member 10B. The stopper roller 131 represents rollers which are provided concentrically at both ends of sleeve roller 130 and regulate a gap between the photoreceptor drum 10 and sleeve roller 130 located at its developing position. Force for bringing the stopper roller into contact is considerably great, and it sometimes causes a thin photoreceptor drum to be deformed and strained. However, being reinforced with aforesaid flange members 10A and 10B, the correct form can be maintained constantly and stably, thus, high image quality can be kept.

In example 4, hollow portion 21H is provided at the center of supporting shaft 21 as shown in FIGS. 35 and 36, and controlling wiring L for exposure optical systems 12Y, 12M, 12C and 12K is threaded through the follow portion to be led to the outside of a unit or a process cartridge.

Next, example 5 will be explained as follows, referring to FIGS. 39(*a*), 39(*b*) and 40. Namely, photoreceptor drum 10 serving as an image forming body having therein imagewise exposure means is attached and housed in process cartridge 30 to be a unit, and the cartridge is arranged to be movable on a color image forming apparatus obliquely or horizontally. Namely, the photoreceptor drum 10 is arranged to be movable in the direction perpendicular to its rotary shaft. A mechanism of this movement will be explained in detail to a certain extent.

After side cover 80 that forms a side member of the main body of an image forming apparatus is opened, aforesaid process cartridge 30 moves upward obliquely once, and when it is drawn out from that position, it can be moved horizontally toward the outside of the apparatus main body.

FIG. 39(*a*) shows how the process cartridge 30 is supported, while FIG. 39(*b*) show sectional view 39B—39B that is a primary portion in FIG. 39(*a*). On each of front and rear base plates 60, there are provided a pair of slanting elongated holes 60A so that they face each other, and a pair of elevating plates 161 connected by causing pin P1 to be engaged with the elongated hole 60A from the inner side are supported to be slidable diagonally from the top to the bottom.

On the inner side of aforesaid each elevating plate 161, there is provided guide member 70 which can expand or contract for two steps by means of three rails called Arcuride rail, and on each rail on each inner side, there is fixed moving plate 171.

Each moving plate 171 mentioned above is provided with a pair of U-shaped cut-outs at the locations facing each other, and by causing each cut-out to be engaged with pin P2, aforesaid process cartridge 30 can be supported.

On the other hand, each elevating plate 61 mentioned above is provided on its upper and lower portions with elongated holes 61A each of which is subjected to loose-fit with pin P3 on an arm that swivels around rotary shaft H together with aforesaid side cover 80.

When the side cover 80 is rotated clockwise to be opened at its horizontal stop position, due to the movement of the pin P3, the slide plate 161 moves diagonally from the top to the bottom while pin P1 slides along the aforesaid elongated hole 160A, and stops. During this process, the process cartridge 30 moves from image forming position (I) to drawn-out position (II) to be set there, while evading aforesaid timing roller 16, transfer unit 14*a* and neutralizing unit 14*b*.

The process cartridge 30, after it is drawn out of aforesaid drawn-out position (II), is moved to the outside of an image forming apparatus main body by extension of the guide member 170 while keeping its horizontal attitude as shown in FIG. 40. During this process, positioning member 30B located at the bottom of the process cartridge 30 is engaged successively with recessed portions 81A and 81B formed on elastic member 81 provided on the inner surface of side cover 80 so that the process cartridge 30 can be regulated and stopped at its specific position.

Namely, when the positioning member 30B is at the position where it engages with the recessed portion 81A of elastic member 81, a transfer area of the image forming apparatus main body is opened, then opening of top cover 90 makes it possible to clear jammed paper. While when the positioning member 30B is at the position where it engages with the recessed portion 81B, exposure optical systems 12Y, 12M, 12C and 12K can be replaced from the rear side of process cartridge 30, and when the process cartridge 30 drawn out is at the stop position (III) where it comes in contact with elevated portion 80A of side cover 80, the waste toner container 250 mentioned above can also be taken out. Further, at the stop position (III), pin P2 is disengaged from moving plate 171 and the process cartridge 30 itself can be taken out upward separately.

When the process cartridge 30 regulated and located at aforesaid specified position to be stopped is moved forcibly in the image forming apparatus main body, it is returned to its drawn-out position due to contraction and retreat of the guide member 170. During this period, the elevating plate 161 is kept by its own weight at its stationary state because pin P1 is engaged with an end of elongated hole 160A of base plate 160. Then, when the side cover 80 is rotated counterclockwise to be closed in its vertical position, the elevating plate 61 moves diagonally from the top to the bottom due to movement of the pin P3 and to sliding of pin P1 along the inside of the elongated hole 160A to stop at its initial position, thus, the process cartridge 30 can be returned again to the image forming position (I) without touching transfer unit 14*a* or the like.

Therefore, maintenance works such as inspection of process cartridge 30, replacement, clearance of jammed paper, toner supply and collection of waste toner can be done easily through operation from one side of the apparatus main body.

Next, examples 6–14 will be explained in succession, referring to FIGS. 34, 35, 36, 39(*a*), 39(*b*) and 40 and further to FIGS. 41–51.

A unit of example 6 is structured as shown in FIGS. 34, 35 and 36 and has constitution wherein even when exposure optical systems 12(Y), 12(M), 12(C) and 12(K) to be mounted on supporting member 20 are adjusted correctly to prescribed positions and when they are needed to be adjusted again in the case of maintenance, these adjustments can be done simply and accurately, namely, the adjustments can be done from the outside of the photoreceptor drum 10 under the condition that exposure optical systems 12(Y), 12(M), 12(C) and 12(K) are incorporated in the photoreceptor drum 10. These adjustments represent one wherein units each including light-emitting elements and converging light transmitting bodies (SELFOC lens) arrayed in a form of a line in the axial direction of photoreceptor drum 10 are moved in the main-scanning direction, sub-scanning direction, and in the height direction (the direction of focusing surface) to be positioned in a mechanical and electrical manner.

Example of 7 stipulates an adjusting method wherein mechanism of example 6 is used.

Next, example 7 will be explained as follows, referring to FIG. 41 that is a sectional view of a photoreceptor drum and exposure optical systems incorporated therein which are perpendicular to their axis, FIG. 42 showing their top side and FIG. 43 which is a sectional view of the side thereof.

For simplifying the explanation, aforesaid figures show only one exposure optical system represented by 12 out of the exposure optical systems 12(Y), 12(M), 12(C) and 12(K).

On the outer circumferential surface of supporting member 20 formed solidly with supporting shaft 21, there are provided channel-shaped grooves 21A in parallel in the axial direction, and in each groove, a unit including light-emitting elements such as LED and converging light transmitting bodies (SELFOC lens) arrayed in a line form as exposure optical system 12 is dropped through each of springs 226, 233, 234, 235 and 236. A top end surface of the exposure optical system 12 is adjusted for its position by means of a screwing amount of screws screwed in L-shaped metal fittings 224R and 225R fixed on the end of supporting member 20 and of springs 235 and 236 located in the bottom of the groove and urged upward.

On the other hand, adjustment in the main-scanning direction is attained by an amount of screwing-in against urging of spring 226 located at the end on the opposite side of screw 223R which touches an end on one side of an exposure optical system and has tapered portion.

Further, adjustment in the sub-scanning direction is attained by an amount of screwing-in against urging of springs 233 and 234 located at opposing position on the opposite side of screws 231R and 232R which touch portions near both ends respectively in the main-scanning direction of an exposure optical system.

Further, in the adjustment in the sub-scanning direction, as shown in FIG. 44, a portion near one end of exposure optical system 12 is supported rotatably by pin 237, and an end on the opposite side is adjusted for positioning against spring 234 by turning screw 232R.

Screws for such adjustment are planted so that they face the drum surface of the photoreceptor drum 10, and it is possible to adjust on the unit wherein exposure optical systems are incorporated in the photoreceptor drum 10 by the use of a screwdriver that is passed through holes for adjustment made on the end of the photoreceptor or on a flange member.

As explained above example 5 by using FIGS. 39(*a*), 39(*b*) and 40, process cartridge 30 is moved in the direction perpendicular to photoreceptor drum 10 so that it can be taken out the color image forming apparatus main body 1.

When the cartridge in FIG. 40 is in the state of 30 (IV), it is possible to conduct adjustment operations, either by opening an unillustrated cover located at the upper portion of cartridge 30 (IV), for example, or by turning aforesaid screws 221R, 222R, 223R, 231R and 232R by inserting adjusting jig AD such as a screwdriver through shielding cover 151 made of rubber as shown in FIG. 50 which is for dust-proofing representing example 14.

In examples 9, 10 and 11, adjustment of each exposure optical system 12 in the height direction (focusing), the main-scanning direction and sub-scanning direction can also be done from the outside of the photoreceptor drum 10 under the condition that the exposure optical system is incorporated in photoreceptor drum 10, and in this case, screws for adjustment are turned in the axial direction at an external end of a photoreceptor.

In example 9, adjustment can be made either at one end on one side or at both ends at both sides of a photoreceptor, while in the case of example 10, adjustment is made at either one end on one side, and in the case of example 11, adjustment is made at both ends at both sides. Examples of adjustment mechanism for exposure optical systems used in examples 9, 10 and 11 will be explained as follows, referring to FIG. 45 representing a sectional view of a photoreceptor drum and exposure optical systems housed in the photoreceptor drum, FIG. 46 representing a diagram of its top side and FIG. 47 which is a sectional view of the side thereof.

For simplifying the explanation, aforesaid figures show only one exposure optical system represented by 12 out of the exposure optical systems 12(Y), 12(M), 12(C) and 12(K), in the same manner as in example 8.

On the outer circumferential surface of supporting member 20 formed solidly with supporting shaft 21, there are provided channel-shaped grooves 21A in parallel in the axial direction, and in each groove, a unit including light-emitting elements and converging light transmitting bodies (SELFOC lens) arrayed in a line form as exposure optical system 12 is dropped through each of springs 226, 233 and 234. A top end surface of the exposure optical system 12 is fixed on the supporting member 20 and is pressed by leaf springs 224 and 225 urging toward the bottom of the groove.

On the other hand, adjustment in the direction of height of exposure optical system 12, namely adjustment of the focusing position can be completed through adjustment of an amount of screwing-in of screws 221 and 222 having a tapered portion on their tips screwed in supporting member 20 through opening for adjustment 150 for process cartridge 30 and disk member 30A capable of being mounted on or dismounted from the process cartridge 30.

Adjustment in the main-scanning direction, on the other hand, can be made by pressing an end on one side of an exposure optical system with a tip of screw 223 screwed in the supporting member 20, against urging of spring 226 provided on an end on the opposite side, through opening for adjustment 150 located on the side of the disk member 30A.

Further, adjustment in the sub-scanning direction can be attained by pressing the side of both side ends of a unit of an exposure optical system with screws 231 and 232 having a tapered portion on their tips screwed in supporting member 20 through opening for adjustment 150 from the outer side of each of the wall surface of the process cartridge 30 and the wall surface of the disk member 30A on the opposite side, in the axial direction of the photoreceptor drum, against urging of springs 233 and 234 provided on the side of the groove 21A on the opposite side, while adjusting an amount of screwing-in of the screws.

Each of these screws for adjustment is projected toward the wall surface of a process cartridge outside in the axial direction of the photoreceptor drum 10, which makes it possible to adjust under the condition that exposure optical systems are incorporated in the photoreceptor drum 10.

This is example 11, wherein it is possible to adjust from the outside of an end at both sides in the axial direction of photoreceptor drum 10.

In example 10, it is possible to adjust from the outside of an end at one side only. Namely, adjustment in the direction of height is attained by screw for adjustment 221A provided in place of screw 221 for height adjustment located on the opposite side as shown in FIG. 48 in place of FIG. 47, a thread of that screw for adjustment 221A being provided on the same side as for another screw 223 and a tapered portion thereof and the thread being connected solidly by a long shaft.

As shown in FIG. 49 in place of FIG. 48, adjustment in the sub-scanning direction is made to be possible from the outside on one side only of a process cartridge with exposure optical system 12 whose one end is fixed by pin 237 and the other end only is caused to have screw 232.

Though it is possible to adjust each exposure optical system from the outside on one side or both sides of process cartridge 30 as stated above, adjustment can be carried out properly only when the process cartridge 30 is moved to the position of 30 (III) or 30 (IV) shown in FIG. 40.

Example 12 shows that the adjustment mentioned above can be carried out for all cases of directions including any one, all or a partial combination of the height direction, the main-scanning direction and the sub-scanning direction.

Example 13 shows that it is preferable to provide electrical timing adjustment by observing overlapping by an electrical measuring instrument such as an oscillator for the correction for overlapping of Y, M, C and K.

In example 14, it is stated that an adjusting portion for adjusting an amount of screwing-in of the screw is a portion for operating from the outside of a process cartridge and it should be provided with shielding cover 151 as shown in a partial cross section in FIG. 50 because it needs to be protected against dust. Namely, the shielding cover 151 is provided with a hole through which an adjustment jig such as a screwdriver can pass, and this hole on the shielding cover 151 is closed to prevent dust from entering when the jig is removed from it but it is opened easily when a screwdriver is inserted through hole for adjustment 150, because a material of the shielding cover 151 is an elastic body such as rubber In example 15, as shown in FIGS. 34, 35 and 36, exposure optical systems 12(Y), 12(M), 12(C) and 12(K) to be mounted on supporting member 20 are set at prescribed positions to be incorporated in photoreceptor drum 10 and to be further incorporated in a color image forming apparatus under the state of a unit, and there is further provided moving means for moving exposure optical systems in their focusing directions, the main-scanning direction and the sub-scanning direction In this case, an adjusting portion for conducting moving operation of the moving means is provided outside photoreceptor drum 10 so that moving operations may be conducted from the outside of the photoreceptor drum 10 under the condition that the exposure optical systems 12 are incorporated in the photoreceptor drum 10. Though example 6 shows that the exposure optical systems are incorporated in a photoreceptor and the photoreceptor is further incorporated in process cartridge 30 which is capable of being mounted on or dismounted from color image forming apparatus main body 1, the process cartridge is not always needed in example 15, and a unit wherein imagewise exposure devices are incorporated in a photoreceptor drum may either be incorporated directly in a color image forming apparatus or be in the state that it is incorporated in a process cartridge as in example 6.

The unit wherein exposure optical systems are incorporated in a photoreceptor drum is not incorporated in a process cartridge, but both ends of supporting shaft 21 of supporting member 20 for exposure optical systems 12 are arranged to be engaged with and fixed by front wall portion 3A of color image forming apparatus main body 1 and by disk member 30A capable of being mounted on or dismounted from rear wall portion 3B respectively as shown in cross sections in FIGS. 51 and 52.

Namely, only difference between those shown in FIGS. 35 and 36 and those shown in FIGS. 51 and 52 is that whether the supporting shaft 21 is supported by a wall portion of process cartridge 30 or it is supported by wall portion 3A of apparatus main body 1. Parts structures other than that are exactly the same as those wherein a process cartridge is provided.

In this case, therefore, it is possible to adjust the moving means in accordance with examples 6–14, after removing a unit wherein exposure optical systems are incorporated in a photoreceptor drum by removing connecting screws between the disk member 30A and rear wall portion 3B of the main body 1.

The foregoing represents example 15.

Example 16 is represented by a method of adjusting a color image wherein exposure optical systems are moved for adjustment of a focusing position, a position in the main-scanning direction, and a position in the sub-scanning direction, and timing of overlapping of Y, M, C and K of exposure optical systems are electrically synchronized, by using an apparatus of example 15.

Since examples 17, 18, 19, 29, 21, 22 and 23 are almost the same as those of example respectively, 11, 12, 13 and 14 respectively, detailed explanations therefor will be omitted.

In example 24, it is possible to adjust through an adjusting portion by means of adjusting means in examples 8–14 without removing from color image forming apparatus main body 1 a unit wherein imagewise exposure means 12 are incorporated in a photoreceptor drum, when there is opened the main body 1 assumed, for example, to be a clamshell type which is not illustrated.

Explanation of example 25 will be omitted here to avoid overlapping because it was explained in the example of example 15.

Owing to the invention, it has become possible to assemble after making the center of a photoreceptor drum serving as an image forming body and the center of a flange portion holding solidly the photoreceptor drum to be concentric and to operate transmission means for driving power and that for control signals simply, accurately, easily and inexpensively.

It has further become possible to adjust mechanically the focusing position and main- and sub-scanning direction positions of imagewise exposure means in an easy and accurate manner under the condition that the imagewise exposure means and the image forming body are assembled as a unit, then, to conduct easily the overlapping of images of Y, M, C and K through electrical timing adjustment based on the foregoing, and to maintain easily high image quality of color images.

In addition, adjustment can be carried out on an assembled unit, resulting in maintenance which is extremely easy.

What is claimed is:

1. A color image forming apparatus, comprising:

a photoreceptor drum having an outer surface and two ends;

a plurality of charger devices for charging an outer surface of the photoreceptor drum;

a plurality of image exposure devices each provided inside the photoreceptor drum for exposing the photoreceptor drum so as to form a latent image thereon;

plurality of developing devices each for developing the latent image with different colored toner from each other so as to form a toner image on the outer surface of the photoreceptor drum;

an image exposure device supporting member on which the plurality of image exposure devices are mounted, wherein the image exposure device supporting member and the photoreceptor drum are connected through bearing members provided on both ends of the photoreceptor drum, and the image exposure device supporting member has engaging portions at both ends thereof; and side plates provided on the image forming apparatus for engaging with the engaging portions to support the image exposure device supporting member, while the photoreceptor drum is rotated around the image exposure devices through the bearing members.

2. The color image forming apparatus of claim 1, further comprising a transfer device for transferring superimposed toner images onto a recording sheet.

3. The color image forming apparatus of claim 2, wherein the photoreceptor drum with the plurality of image exposure devices mounted on the image exposure device supporting member is attachable to or detachable from the apparatus.

4. The color image forming apparatus of claim 3, wherein:

the plurality of developing devices and the plurality of charger devices are removable from the outer surface of the photoreceptor drum; and after the plurality of developing devices and the plurality of charger devices are removed from the apparatus, the photoreceptor drum with the plurality of image exposure devices are attached to the apparatus in a downward direction.

5. The color image forming apparatus of claim 4, wherein:

the apparatus is capable of being opened at a transferring portion of the transfer device; and the photoreceptor with the plurality of image exposure devices are detachable from or attachable to the transferring portion.

6. The color image forming apparatus of claim 4, wherein:

the photoreceptor drum and the plurality of image exposure devices form a detachable unit, and the detachable unit further includes a cleaning device for cleaning the photoreceptor drum or the charger devices; and the detachable unit is integrally attachable to or detachable from the main body.

7. The color image forming apparatus of claim 6, further comprising a process unit containing the detachable unit and the developing devices; and wherein the process unit is detachable from the main body, before the detachable unit and the developing devices are detached from the process unit.

8. The color image forming apparatus of claim 4, further comprising a process cartridge integrally containing the photoreceptor drum and the image exposure devices; and wherein the process cartridge is detachably attachable to the main body after the apparatus is opened at a transferring portion of the transfer device, and when the plurality of developing devices are retreated, the process cartridge is detachable from or attachable to the transferring portion.

9. The color image forming apparatus of claim 8, wherein an opening operation of the main body of the apparatus is conducted by moving the process cartridge away from the transferring portion.

10. The color image forming apparatus of claim 8, wherein an opening operation of the main body of the apparatus is conducted by moving the transferring portion away from the process cartridge.

11. The color image forming apparatus of claim 8, wherein the process cartridge integrally contains the charger devices or a cleaning device.

12. The color image forming apparatus of claim 8, wherein an opening operation of the main body of the apparatus is conducted from a feeding side of recording sheets.

13. The color image forming apparatus of claim 8, wherein the developing devices are detachably mountable to the main body in a same direction as that of the process cartridge.

14. The color image forming apparatus of claim 8, wherein the developing devices are detachably mountable to the main body at a retreated position thereof.

15. The color image forming apparatus of claim 1, further comprising a protective cover for housing the photoreceptor drum and the image exposure device therein, which forms a unit.

16. The color image forming apparatus of claim 15, wherein the protective cover further houses the charger devices.

17. The color image forming apparatus of claim 15, wherein the protective cover has a portion defining an opening opposite to the developing devices provided on the main body of the apparatus.

18. The color image forming apparatus of claim 1, wherein the photoreceptor drum has a gear thereon which receives a drive force from the main body and thereby drives the photoreceptor drum to rotate with respect to the image exposure devices.

19. The color image forming apparatus of claim 1, wherein the photoreceptor drum has a rotation axis and wherein first and second developing devices of the plurality of developing devices are arranged around the outer surface of the photoreceptor drum;

and wherein the apparatus further comprises a first driving gear arranged in the housing at a position corresponding to the rotation axis of the photoreceptor drum, and a first driving force transmitting unit for engaging with the first driving gear and for transmitting a driving force to the first and second developing devices.

20. The color image forming apparatus of claim 1, further comprising a second gear arranged in the housing and a second driving force transmitting unit for engaging with the second gear and for transmitting a driving force to the photoreceptor drum.

21. The color image forming apparatus of claim 1, wherein the photoreceptor drum comprises a gear formed integrally with the photoreceptor drum.

22. The color image forming apparatus of claim 1, further comprising a supporting shaft which passes through an inside of the photoreceptor drum and inside of the image exposure device supporting member, for supporting the photoreceptor drum and the supporting member; and wherein one end of the supporting member is fixed on the supporting shaft and another end of the supporting member is free from the supporting shaft.

23. The color image forming apparatus of claim 22, wherein one end of the photoreceptor drum is fixed on the supporting shaft and another end of the photoreceptor drum is free from the supporting shaft.

24. The color image forming apparatus of claim 1, wherein the image exposure devices each comprise an exposure element, the exposure element having one end which is fixed on a fixing member provided on the image exposure device supporting member and another end of which is free from the fixing member.

25. The color image forming apparatus of claim 24, wherein the fixing member comprises a casing for accommodating the exposure element and for restricting skewing of the exposure element in a direction perpendicular to a center axis of the photoreceptor drum.

26. The color image forming apparatus of claim 24, wherein the fixing member comprises the image exposure device supporting member for supporting the exposure element and for restricting skewing of the exposure element in a direction perpendicular to a center axis of the photoreceptor drum.

27. The color image forming apparatus of claim 1, further comprising:

flange members through which a supporting shaft of the supporting member passes, the flange members being infitted concentrically with the photoreceptor drum from both ends of the photoreceptor drum so as to be fixed in the photoreceptor drum;

side plates for supporting both ends of the supporting shaft of the supporting member, the side plates being provided on a process cartridge or the apparatus; and a driving member provided concentrically and integrally with the flange members for rotating the photoreceptor drum.

28. The color image forming apparatus of claim 27, wherein the flange members are press-fitted to the photoreceptor drum at outer diameter portions of the photoreceptor drum.

29. The color image forming apparatus of claim 27, wherein the flange members with a bearing are press-fitted concentrically to the photoreceptor drum at a position corresponding to the supporting shaft inside the photoreceptor drum.

30. The color image forming apparatus of claim 27, wherein the supporting shaft has a hollow space in which a control wire is provided.

31. The color image forming apparatus of claim 27, wherein the photoreceptor drum is movable in a direction perpendicular to a rotation axis thereof.

32. The color image forming apparatus of claim 1, further comprising a moving device for moving each position of the image exposure devices mounted on the supporting member from an outside of the photoreceptor drum.

33. The color image forming apparatus of claim 32, further comprising an adjusting section for adjusting the moving device, the adjusting section being provided in a position opposite to an end portion in a shaft direction of the outer surface of the photoreceptor drum.

34. The color image forming apparatus of claim 32, further comprising an adjusting section for adjusting the moving device, the adjusting section being provided in a position outside an end portion in a shaft direction of the photoreceptor drum.

35. The color image forming apparatus of claim 32, further comprising an adjusting section for adjusting the moving device, the adjusting section being provided in a position outside only one end portion in a shaft direction of the photoreceptor drum.

36. The color image forming apparatus of claim 32, further comprising an adjusting section for adjusting the moving device, the adjusting section being provided in a position outside both end portions in a shaft direction of the photoreceptor drum.

37. The color image forming apparatus of claim 32, further comprising an adjusting section for adjusting the moving device; and wherein an adjusting operation of the moving device is conducted by the adjusting section with respect to at least one of parallelism, a focus point, a position in a primary scanning direction and a position in a secondary scanning direction.

38. The color image forming apparatus of claim 37, wherein the adjusting section further adjusts an electrical timing in at least one of the primary and secondary scanning directions.

39. The color image forming apparatus of claim 32, further comprising a dust-proof cover provided on the adjusting section for preventing dust from entering inside the process cartridge.

40. The color image forming apparatus of claim 32, further comprising an outer cover for the apparatus, wherein when the outer cover is opened or the apparatus is divided, the adjusting section is exposed.

41. The color image forming apparatus of claim 32, wherein when the image exposure device and the photoreceptor drum are integrally drawn out of the apparatus, the adjusting section is exposed.

* * * * *